US012390703B2

(12) United States Patent
Johnson et al.

(10) Patent No.: US 12,390,703 B2
(45) **Date of Patent: *Aug. 19, 2025**

(54) GOLF CLUB HEADS

(71) Applicant: Taylor Made Golf Company, Inc., Carlsbad, CA (US)

(72) Inventors: Matthew David Johnson, San Diego, CA (US); Todd P. Beach, Encinitas, CA (US); Christopher John Harbert, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 66 days.

This patent is subject to a terminal disclaimer.

(21) Appl. No.: 18/449,207

(22) Filed: Aug. 14, 2023

(65) Prior Publication Data

US 2024/0058664 A1 Feb. 22, 2024

Related U.S. Application Data

(63) Continuation of application No. 17/390,615, filed on Jul. 30, 2021, now Pat. No. 11,759,685, which is a (Continued)

(51) Int. Cl.

| | |
|---|---|
| ***A63B 53/06*** | (2015.01) |
| ***A63B 53/04*** | (2015.01) |
| *A63B 102/32* | (2015.01) |

(52) U.S. Cl.

CPC ..... *A63B 53/06* (2013.01); *A63B 53/0433* (2020.08); *A63B 53/0466* (2013.01); *A63B 2053/0491* (2013.01); *A63B 2102/32* (2015.10)

(58) Field of Classification Search

CPC ..... A63B 2053/0491; A63B 2053/0495

(Continued)

(56) References Cited

U.S. PATENT DOCUMENTS

| | | | |
|---|---|---|---|
| 411,000 | A | 9/1889 | Anderson |
| 1,133,129 | A | 3/1915 | Govan |

(Continued)

FOREIGN PATENT DOCUMENTS

| | | | |
|---|---|---|---|
| CN | 2436182 | Y | 6/2001 |
| CN | 2742991 | Y | 11/2005 |

(Continued)

OTHER PUBLICATIONS

Adams Golf Speedline F11 Ti 14.5 degree fairway wood (www.bombsquadgolf.com, posted Oct. 18, 2010).

(Continued)

*Primary Examiner* — Alvin A Hunter

(74) *Attorney, Agent, or Firm* — Klarquist Sparkman, LLP

(57) ABSTRACT

Disclosed golf club heads include a weight channel positioned in the sole and defining a path along the sole. A weight member positioned in the weight channel can be adjusted to any of a range of selectable positions to adjust mass properties of the golf club head. A fastener secures the weight member in any of the selectable positions, while the fastener itself, regardless of where the weight member is positioned along the path, is secured to the body at a fixed location that is independent of the position of the weight member along the path. Part of the weight channel and weight member can be covered by an overhanging portion of the sole, which can form a sit pad. The overhanging portion can be part of a composite sole insert.

24 Claims, 29 Drawing Sheets

Related U.S. Application Data continuation-in-part of application No. 17/135,666, filed on Dec. 28, 2020, now Pat. No. 11,406,881.

(58) Field of Classification Search
USPC ..... 473/338
See application file for complete search history.

(56) References Cited

U.S. PATENT DOCUMENTS 1,135,621 A 4/1915 Roberts et al.
1,213,382 A 1/1917 Kent
1,320,163 A 10/1919 Fitz
1,349,806 A 8/1920 Booth
1,518,316 A 12/1924 Ellingham
1,526,438 A 2/1925 Scott
1,538,312 A 5/1925 Beat
1,552,297 A 9/1925 Elzie
1,555,425 A 9/1925 McKenzie
1,592,463 A 7/1926 Marker
1,658,581 A 2/1928 Tobia
1,697,846 A 1/1929 Anderson
1,704,119 A 3/1929 Buhrke
1,705,997 A 3/1929 Quynn
1,854,548 A 4/1932 Hunt
1,970,409 A 8/1934 Wiedemann
D107,007 S 11/1937 Cashmore
2,098,445 A 11/1937 Wettlaufer
2,163,091 A 6/1939 Held
2,171,383 A 8/1939 Wettlaufer
2,214,356 A 9/1940 Wettlaufer
2,225,930 A 12/1940 Sexton
2,257,575 A 9/1941 Reach
2,328,583 A 9/1943 Reach
2,360,364 A 10/1944 Reach
2,375,249 A 5/1945 Richer
2,460,435 A 2/1949 Schaffer
2,652,256 A 9/1953 Thomas
2,681,523 A 6/1954 Sellers
2,691,525 A 10/1954 Callaghan
3,064,980 A 11/1962 Steiner
3,084,940 A 4/1963 Cissel
3,199,874 A 8/1965 Blasing
3,466,047 A 9/1969 Rodia et al.
3,486,755 A 12/1969 Hodge
3,556,533 A 1/1971 Hollis
3,589,731 A 6/1971 Chancellor
3,606,327 A 9/1971 Gorman
3,610,630 A 10/1971 Glover
3,652,094 A 3/1972 Glover
3,672,419 A 6/1972 Fischer
3,680,868 A 8/1972 Jacob
3,692,306 A 9/1972 Glover
3,743,297 A 7/1973 Dennis
3,810,631 A 5/1974 Braly
3,860,244 A 1/1975 Cosby
3,897,066 A 7/1975 Belmont
3,976,299 A 8/1976 Lawrence et al.
3,979,122 A 9/1976 Belmont
3,979,123 A 9/1976 Belmont
3,997,170 A 12/1976 Goldberg
4,008,896 A 2/1977 Gordos
4,021,047 A 5/1977 Mader
4,043,563 A 8/1977 Churchward
4,052,075 A 10/1977 Daly
4,067,572 A 1/1978 Coleman
4,076,254 A 2/1978 Nygren
4,085,934 A 4/1978 Churchward
4,121,832 A 10/1978 Ebbing
4,150,702 A 4/1979 Holmes
4,189,976 A 2/1980 Becker
4,214,754 A 7/1980 Zebelean
4,262,562 A 4/1981 MacNeill
D259,698 S 6/1981 MacNeill
4,280,700 A * 7/1981 Plagenhoef ..... A63B 60/24 473/289
4,322,083 A 3/1982 Imai
4,340,229 A 7/1982 Stuff, Jr.
4,398,965 A 8/1983 Campau
4,411,430 A 10/1983 Dian
4,423,874 A 1/1984 Stuff, Jr.
4,438,931 A 3/1984 Motomiya
4,471,961 A 9/1984 Masghati et al.
4,489,945 A 12/1984 Kobayashi
4,530,505 A 7/1985 Stuff
4,535,990 A 8/1985 Yamada
4,553,755 A 11/1985 Yamada
D284,346 S 6/1986 Masters
4,602,787 A 7/1986 Sugioka et al.
4,607,846 A 8/1986 Perkins
4,712,798 A 12/1987 Preato
4,730,830 A 3/1988 Tilley
4,736,093 A 4/1988 Braly
4,736,951 A 4/1988 Grant
4,754,974 A 7/1988 Kobayashi
4,754,977 A 7/1988 Sahm
4,762,322 A 8/1988 Molitor et al.
4,795,159 A * 1/1989 Nagamoto ..... A63B 60/00 473/348
4,803,023 A 2/1989 Enomoto et al.
4,809,983 A 3/1989 Langert
4,867,457 A 9/1989 Lowe
4,867,458 A 9/1989 Sumikawa et al.
4,869,507 A 9/1989 Sahm
4,877,249 A 10/1989 Thompson
4,878,666 A 11/1989 Hosoda
4,890,840 A 1/1990 Kobayashi
4,895,371 A 1/1990 Bushner
4,915,558 A 4/1990 Muller
4,962,932 A 10/1990 Anderson
4,994,515 A 2/1991 Washiyama et al.
5,000,454 A 3/1991 Soda
5,006,023 A 4/1991 Kaplan
5,020,950 A 6/1991 Ladouceur
5,028,049 A 7/1991 McKeighen
5,039,267 A 8/1991 Wollar
5,042,806 A 8/1991 Helmstetter
5,050,879 A 9/1991 Sun et al.
5,058,895 A 10/1991 Igarashi
5,067,715 A 11/1991 Schmidt et al.
5,076,585 A 12/1991 Bouquet
5,078,400 A 1/1992 Desbiolles et al.
5,121,922 A 6/1992 Harsh, Sr.
5,122,020 A 6/1992 Bedi
5,193,810 A 3/1993 Antonious
5,213,328 A 5/1993 Long et al.
5,219,408 A 6/1993 Sun
5,221,086 A 6/1993 Antonious
5,232,224 A 8/1993 Zeider
5,244,210 A 9/1993 Au
5,251,901 A 10/1993 Solheim et al.
5,253,869 A 10/1993 Dingle et al.
5,255,913 A 10/1993 Tsuchida
D343,558 S 1/1994 Latraverse et al.
5,297,794 A 3/1994 Lu
5,301,941 A 4/1994 Allen
5,306,008 A 4/1994 Kinoshita
5,316,305 A 5/1994 McCabe
5,320,005 A 6/1994 Hsiao
5,328,176 A 7/1994 Lo
5,330,187 A 7/1994 Schmidt et al.
5,346,216 A 9/1994 Aizawa
5,346,217 A 9/1994 Tsuchiya et al.
5,385,348 A 1/1995 Wargo
5,395,113 A 3/1995 Antonious
5,410,798 A 5/1995 Lo
5,419,556 A 5/1995 Take
5,421,577 A 6/1995 Kobayashi
5,429,365 A 7/1995 McKeighen
5,439,222 A 8/1995 Kranenberg
5,441,274 A 8/1995 Clay
5,447,309 A 9/1995 Vincent
5,449,260 A 9/1995 Whittle
5,451,056 A 9/1995 Manning
5,464,211 A 11/1995 Atkins

(56) References Cited

U.S. PATENT DOCUMENTS 5,467,983 A 11/1995 Chen
D365,615 S 12/1995 Shimatani
5,472,201 A 12/1995 Aizawa et al.
5,472,203 A 12/1995 Schmidt et al.
5,480,152 A 1/1996 Schmidt et al.
5,511,786 A 4/1996 Antonious
5,518,243 A 5/1996 Redman
5,533,730 A 7/1996 Ruvang
5,538,245 A 7/1996 Moore
5,564,705 A 10/1996 Kobayashi et al.
5,571,053 A 11/1996 Lane
5,573,467 A 11/1996 Chou et al.
5,582,553 A 12/1996 Ashcraft et al.
5,603,668 A 2/1997 Antonious
5,613,917 A 3/1997 Kobayashi et al.
5,616,088 A 4/1997 Aizawa et al.
5,620,379 A 4/1997 Borys
5,624,331 A 4/1997 Lo et al.
5,629,475 A 5/1997 Chastonay
5,632,694 A 5/1997 Lee
5,658,206 A 8/1997 Antonious
5,669,827 A 9/1997 Nagamoto
5,681,228 A 10/1997 Mikame et al.
5,683,309 A 11/1997 Reimers
5,688,189 A 11/1997 Bland
5,709,613 A 1/1998 Sheraw
5,718,641 A 2/1998 Lin
5,720,674 A 2/1998 Galy
D392,526 S 3/1998 Nicely
5,735,754 A 4/1998 Antonious
5,746,664 A 5/1998 Reynolds, Jr.
5,749,795 A 5/1998 Schmidt et al.
5,755,627 A 5/1998 Yamazaki et al.
5,762,567 A 6/1998 Antonious
5,766,095 A 6/1998 Antonious
5,769,737 A 6/1998 Holladay et al.
5,776,010 A 7/1998 Helmstetter et al.
5,776,011 A 7/1998 Su et al.
5,788,584 A 8/1998 Parente et al.
5,788,587 A 8/1998 Tseng
5,798,587 A 8/1998 Lee
5,803,829 A 9/1998 Hayashi
RE35,955 E 11/1998 Lu
5,851,160 A 12/1998 Rugge et al.
5,873,791 A 2/1999 Allen
5,888,148 A 3/1999 Allen
D409,463 S 5/1999 McMullin
5,908,356 A 6/1999 Nagamoto
5,911,638 A 6/1999 Parente et al.
5,913,735 A 6/1999 Kenmi
5,916,042 A * 6/1999 Reimers ..... A63B 53/04 473/345
5,924,938 A 7/1999 Hines
D412,547 S 8/1999 Fong
5,935,019 A 8/1999 Yamamoto
5,935,020 A 8/1999 Stites et al.
5,941,782 A 8/1999 Cook
5,947,840 A 9/1999 Ryan
5,967,904 A 10/1999 Nagai et al.
5,967,905 A 10/1999 Nakahara et al.
5,971,867 A 10/1999 Galy
5,976,033 A 11/1999 Takeda
5,997,415 A 12/1999 Wood
6,015,354 A 1/2000 Ahn et al.
6,017,177 A 1/2000 Lanham
6,019,686 A 2/2000 Gray
6,023,891 A 2/2000 Robertson et al.
6,032,677 A 3/2000 Blechman et al.
6,033,318 A 3/2000 Drajan, Jr. et al.
6,033,321 A 3/2000 Yamamoto
6,042,486 A 3/2000 Gallagher
6,056,649 A 5/2000 Imai
6,059,669 A 5/2000 Pearce
6,062,988 A 5/2000 Yamamoto
6,074,308 A 6/2000 Domas
6,077,171 A 6/2000 Yoneyama
6,086,485 A 7/2000 Hamada et al.
6,089,994 A 7/2000 Sun
6,120,384 A 9/2000 Drake
6,123,627 A 9/2000 Antonious
6,139,445 A 10/2000 Werner et al.
6,149,533 A 11/2000 Finn
6,162,132 A 12/2000 Yoneyama
6,162,133 A 12/2000 Peterson
6,171,204 B1 1/2001 Starry
6,186,905 B1 2/2001 Kosmatka
6,190,267 B1 2/2001 Marlowe et al.
6,193,614 B1 2/2001 Sasamoto et al.
6,203,448 B1 3/2001 Yamamoto
6,206,789 B1 3/2001 Takeda
6,206,790 B1 3/2001 Kubica et al.
6,210,290 B1 4/2001 Erickson et al.
6,217,461 B1 4/2001 Galy
6,238,303 B1 5/2001 Fite
6,244,974 B1 6/2001 Hanberry, Jr.
6,248,025 B1 6/2001 Murphy et al.
6,254,494 B1 7/2001 Hasebe et al.
6,264,414 B1 7/2001 Hartmann et al.
6,270,422 B1 8/2001 Fisher
6,277,032 B1 * 8/2001 Smith ..... A63B 53/047 473/336
6,290,609 B1 9/2001 Takeda
6,296,576 B1 10/2001 Capelli
6,296,579 B1 10/2001 Robinson
6,299,546 B1 10/2001 Wang
6,299,547 B1 10/2001 Kosmatka
6,306,048 B1 10/2001 McCabe et al.
6,319,149 B1 11/2001 Lee
6,319,150 B1 11/2001 Werner et al.
6,334,817 B1 1/2002 Ezawa et al.
6,338,683 B1 1/2002 Kosmatka
6,340,337 B2 1/2002 Hasebe et al.
6,344,000 B1 2/2002 Hamada et al.
6,344,001 B1 2/2002 Hamada et al.
6,344,002 B1 2/2002 Kajita
6,348,012 B1 2/2002 Erickson et al.
6,348,013 B1 2/2002 Kosmatka
6,348,014 B1 2/2002 Chiu
6,354,961 B1 3/2002 Allen
6,354,963 B1 3/2002 Kodama et al.
6,364,788 B1 4/2002 Helmstetter et al.
6,379,264 B1 4/2002 Forzano
6,379,265 B1 4/2002 Hirakawa et al.
6,383,090 B1 5/2002 O'Doherty et al.
6,386,987 B1 5/2002 Lejeune, Jr.
6,386,990 B1 5/2002 Reyes et al.
6,390,933 B1 5/2002 Galloway
6,409,612 B1 6/2002 Evans et al.
6,422,951 B1 7/2002 Burrows
6,425,832 B2 7/2002 Cackett et al.
6,434,811 B1 8/2002 Helmstetter et al.
6,436,142 B1 8/2002 Paes et al.
6,440,009 B1 8/2002 Guibaud et al.
6,440,010 B1 8/2002 Deshmukh
6,443,851 B1 9/2002 Liberatore
6,447,405 B1 9/2002 Chen
6,458,044 B1 10/2002 Vincent et al.
6,461,249 B2 10/2002 Liberatore
6,471,604 B2 10/2002 Hocknell et al.
6,475,101 B2 11/2002 Burrows
6,475,102 B2 11/2002 Helmstetter et al.
6,478,692 B2 11/2002 Kosmatka
6,491,592 B2 12/2002 Cackett et al.
6,508,978 B1 1/2003 Deshmukh
6,514,154 B1 2/2003 Finn
6,524,197 B2 2/2003 Boone
6,524,198 B2 2/2003 Takeda
6,527,649 B1 3/2003 Neher et al.
6,530,847 B1 3/2003 Antonious
6,530,848 B2 3/2003 Gillig
6,533,679 B1 3/2003 McCabe et al.
6,547,676 B2 4/2003 Cackett et al.
6,558,273 B2 5/2003 Kobayashi et al.
6,565,448 B2 5/2003 Cameron et al.

(56) References Cited

U.S. PATENT DOCUMENTS 6,565,452 B2 5/2003 Helmstetter et al.
6,569,029 B1 5/2003 Hamburger
6,569,040 B2 5/2003 Bradstock
6,572,489 B2 6/2003 Miyamoto et al.
6,575,845 B2 6/2003 Galloway et al.
6,575,854 B1 6/2003 Yang et al.
6,582,323 B2 6/2003 Soracco et al.
6,592,468 B2 7/2003 Vincent et al.
6,602,149 B1 8/2003 Jacobson
6,602,150 B1 8/2003 Kosmatka
6,604,568 B2 8/2003 Bliss et al.
6,605,007 B1 8/2003 Bissonnette et al.
6,607,452 B2 8/2003 Helmstetter et al.
6,612,938 B2 9/2003 Murphy et al.
6,616,547 B2 9/2003 Vincent et al.
6,623,378 B2 9/2003 Beach et al.
6,638,180 B2 10/2003 Tsurumaki
6,638,183 B2 10/2003 Takeda
D482,089 S 11/2003 Burrows
D482,090 S 11/2003 Burrows
D482,420 S 11/2003 Burrows
6,641,487 B1 11/2003 Hamburger
6,641,490 B2 11/2003 Ellemor
6,648,772 B2 11/2003 Vincent et al.
6,648,773 B1 11/2003 Evans
6,652,387 B2 11/2003 Liberatore
D484,208 S 12/2003 Burrows
6,663,506 B2 12/2003 Nishimoto et al.
6,669,571 B1 12/2003 Cameron et al.
6,669,578 B1 12/2003 Evans
6,669,580 B1 12/2003 Cackett et al.
6,676,536 B1 1/2004 Jacobson
6,679,786 B2 1/2004 McCabe
6,695,712 B1 2/2004 Iwata et al.
6,716,111 B2 4/2004 Liberatore
6,716,114 B2 4/2004 Nishio
6,719,510 B2 4/2004 Cobzaru
6,719,641 B2 4/2004 Dabbs et al.
6,739,982 B2 5/2004 Murphy et al.
6,739,983 B2 5/2004 Helmstetter et al.
6,743,118 B1 6/2004 Soracco
6,749,523 B1 6/2004 Forzano
6,757,572 B1 6/2004 Forest
6,758,763 B2 7/2004 Murphy et al.
6,773,360 B2 8/2004 Willett et al.
6,773,361 B1 8/2004 Lee
6,776,726 B2 8/2004 Sano
6,800,038 B2 10/2004 Willett et al.
6,805,643 B1 10/2004 Lin
6,808,460 B2 10/2004 Namiki
6,824,475 B2 11/2004 Burnett et al.
6,835,145 B2 12/2004 Tsurumaki
D501,036 S 1/2005 Burrows
6,855,068 B2 2/2005 Antonious
6,860,818 B2 3/2005 Mahaffey et al.
6,860,823 B2 3/2005 Lee
6,860,824 B2 3/2005 Evans
6,875,124 B2 4/2005 Gilbert et al.
6,875,129 B2 4/2005 Erickson et al.
6,881,158 B2 4/2005 Yang et al.
6,881,159 B2 4/2005 Galloway et al.
6,887,165 B2 5/2005 Tsurumaki
6,890,267 B2 5/2005 Mahaffey et al.
6,902,497 B2 6/2005 Deshmukh et al.
6,904,663 B2 6/2005 Willett et al.
6,923,734 B2 8/2005 Meyer
6,926,619 B2 8/2005 Helmstetter et al.
6,929,565 B2 8/2005 Nakahara et al.
6,939,247 B1 9/2005 Schweigert et al.
6,960,142 B2 11/2005 Bissonnette et al.
6,964,617 B2 11/2005 Williams
6,969,326 B2 11/2005 De Shiell
6,974,393 B2 12/2005 Caldwell et al.
6,988,960 B2 1/2006 Mahaffey et al.
6,991,558 B2 1/2006 Beach et al.
D515,165 S 2/2006 Zimmerman et al.
6,997,820 B2 2/2006 Willett et al.
7,004,852 B2 2/2006 Billings
7,025,692 B2 4/2006 Erickson et al.
7,029,403 B2 4/2006 Rice et al.
7,063,629 B2 6/2006 Nakahara et al.
7,070,514 B1 7/2006 Borunda
7,077,762 B2 7/2006 Kouno et al.
7,086,964 B2 8/2006 Chen et al.
7,108,609 B2 9/2006 Stites et al.
7,108,614 B2 9/2006 Lo
7,128,662 B2 10/2006 Kumamoto
7,128,664 B2 10/2006 Onoda et al.
7,134,971 B2 11/2006 Franklin et al.
7,137,905 B2 11/2006 Kohno
7,137,906 B2 11/2006 Tsunoda et al.
7,140,974 B2 11/2006 Chao et al.
7,147,572 B2 12/2006 Kohno
7,147,573 B2 12/2006 DiMarco
7,153,220 B2 12/2006 Lo
7,163,468 B2 1/2007 Gibbs et al.
7,166,038 B2 1/2007 Williams et al.
7,166,040 B2 1/2007 Chao et al.
7,166,041 B2 1/2007 Evans
7,169,060 B2 1/2007 Stevens et al.
7,179,034 B2 2/2007 Ladouceur
7,186,190 B1 3/2007 Beach et al.
7,189,169 B2 3/2007 Billings
7,198,575 B2 4/2007 Beach et al.
7,201,669 B2 4/2007 Stites et al.
7,223,180 B2 5/2007 Willett et al.
7,252,600 B2 8/2007 Murphy et al.
7,255,654 B2 8/2007 Murphy et al.
7,267,620 B2 9/2007 Chao et al.
7,273,423 B2 9/2007 Imamoto
7,278,926 B2 10/2007 Frame
7,278,927 B2 10/2007 Gibbs et al.
7,294,064 B2 11/2007 Tsurumaki et al.
7,294,065 B2 11/2007 Liang et al.
7,314,418 B2 1/2008 Galloway et al.
7,351,161 B2 4/2008 Beach
7,371,191 B2 5/2008 Sugimoto
7,377,860 B2 5/2008 Breier et al.
7,396,293 B2 7/2008 Soracco
7,404,772 B2 7/2008 Koide et al.
7,407,447 B2 8/2008 Beach et al.
7,419,441 B2 9/2008 Hoffman et al.
7,438,647 B1 10/2008 Hocknell
7,445,563 B1 11/2008 Werner
7,448,963 B2 11/2008 Beach et al.
7,462,109 B2 12/2008 Erickson et al.
D588,223 S 3/2009 Kuan
7,500,924 B2 3/2009 Yokota
7,500,926 B2 3/2009 Rae et al.
7,520,820 B2 4/2009 Dimarco
7,530,901 B2 5/2009 Imamoto et al.
7,530,903 B2 5/2009 Imamoto et al.
7,530,904 B2 5/2009 Beach et al.
7,540,811 B2 6/2009 Beach et al.
7,563,175 B2 7/2009 Nishitani et al.
7,568,985 B2 8/2009 Beach et al.
7,572,193 B2 8/2009 Yokota
7,578,753 B2 8/2009 Beach et al.
7,582,024 B2 9/2009 Shear
7,585,233 B2 9/2009 Horacek
7,588,502 B2 * 9/2009 Nishino ..... A63B 60/02 473/332
7,591,737 B2 9/2009 Gibbs et al.
7,591,738 B2 9/2009 Beach et al.
7,611,424 B2 * 11/2009 Nagai ..... A63B 60/02 473/335
7,621,823 B2 11/2009 Beach et al.
7,628,707 B2 12/2009 Beach et al.
7,632,193 B2 12/2009 Thielen
7,632,194 B2 12/2009 Hoffman et al.
7,632,196 B2 12/2009 Reed et al.
7,641,569 B2 1/2010 Best et al.
D612,440 S 3/2010 Oldknow
7,670,235 B2 3/2010 Lo

(56) References Cited

U.S. PATENT DOCUMENTS 7,674,189 B2 3/2010 Beach et al.
7,682,264 B2 3/2010 Hsu et al.
7,691,006 B1 4/2010 Burke
7,695,378 B2 4/2010 Nakano
7,699,719 B2 4/2010 Sugimoto
7,717,803 B2 5/2010 DiMarco
7,744,484 B1 6/2010 Chao
7,749,096 B2 7/2010 Gibbs et al.
7,749,101 B2 7/2010 Imamoto et al.
7,753,806 B2 7/2010 Beach et al.
7,758,451 B2 7/2010 Liang et al.
7,758,452 B2 * 7/2010 Soracco ..... A63B 60/02 473/335
7,771,291 B1 8/2010 Willett et al.
7,775,905 B2 8/2010 Beach et al.
7,775,907 B2 8/2010 Hirano
7,798,914 B2 9/2010 Noble et al.
7,806,782 B2 * 10/2010 Stites ..... A63B 53/0466 473/409
7,824,277 B2 11/2010 Bennett et al.
7,824,280 B2 * 11/2010 Yokota ..... A63B 60/02 473/334
7,854,364 B2 12/2010 DeShiell et al.
7,857,711 B2 12/2010 Shear
7,857,713 B2 12/2010 Yokota
7,867,105 B2 1/2011 Moon
7,871,339 B2 1/2011 Sanchez et al.
7,887,431 B2 2/2011 Beach et al.
7,887,434 B2 2/2011 Beach et al.
7,896,753 B2 3/2011 Boyd et al.
7,914,393 B2 3/2011 Hirsch et al.
7,934,999 B2 5/2011 Cackett et al.
7,946,931 B2 5/2011 Oyama
7,988,565 B2 8/2011 Abe
7,993,216 B2 8/2011 Lee
8,012,038 B1 9/2011 Beach et al.
8,012,039 B2 9/2011 Greaney et al.
8,016,694 B2 9/2011 Llewellyn et al.
8,025,587 B2 9/2011 Beach et al.
8,057,323 B2 11/2011 Liang et al.
8,070,623 B2 12/2011 Stites et al.
8,083,609 B2 12/2011 Burnett et al.
8,088,021 B2 1/2012 Albertsen et al.
8,105,175 B2 1/2012 Breier et al.
8,118,689 B2 2/2012 Beach et al.
8,133,128 B2 3/2012 Boyd et al.
8,147,350 B2 4/2012 Beach et al.
8,157,672 B2 4/2012 Greaney et al.
8,167,737 B2 5/2012 Oyama
8,177,661 B2 5/2012 Beach et al.
8,182,364 B2 5/2012 Cole et al.
8,192,303 B2 6/2012 Ban
8,197,358 B1 6/2012 Watson et al.
8,202,175 B2 * 6/2012 Ban ..... A63B 53/0466 473/345
8,206,243 B2 6/2012 Stites
8,206,244 B2 6/2012 Honea et al.
8,235,831 B2 8/2012 Beach et al.
8,235,841 B2 8/2012 Stites et al.
8,235,844 B2 8/2012 Albertsen et al.
8,241,143 B2 8/2012 Albertsen et al.
8,241,144 B2 8/2012 Albertsen et al.
8,257,195 B1 9/2012 Erickson
8,257,196 B1 9/2012 Abbott et al.
8,262,498 B2 9/2012 Beach et al.
8,262,506 B2 9/2012 Watson et al.
8,277,337 B2 10/2012 Shimazaki
8,292,756 B2 10/2012 Greaney et al.
8,303,431 B2 11/2012 Beach et al.
8,303,433 B2 11/2012 Roach et al.
8,328,659 B2 12/2012 Shear
8,337,319 B2 12/2012 Sargent et al.
8,337,326 B2 12/2012 Lukasiewicz et al.
8,353,786 B2 1/2013 Beach et al.
D675,692 S 2/2013 Oldknow et al.
8,376,878 B2 2/2013 Bennett et al.
8,382,607 B2 * 2/2013 Burnett ..... A63B 53/06 473/288
D678,964 S 3/2013 Oldknow et al.
D678,965 S 3/2013 Oldknow et al.
D678,968 S 3/2013 Oldknow et al.
D678,969 S 3/2013 Oldknow et al.
D678,970 S 3/2013 Oldknow et al.
D678,971 S 3/2013 Oldknow et al.
D678,972 S 3/2013 Oldknow et al.
D678,973 S 3/2013 Oldknow et al.
8,398,503 B2 3/2013 Beach et al.
8,403,771 B1 3/2013 Rice et al.
D679,354 S 4/2013 Oldknow et al.
8,425,348 B2 * 4/2013 Boyd ..... A63B 53/0466 473/335
8,430,763 B2 * 4/2013 Beach ..... A63B 53/02 473/307
8,435,132 B2 5/2013 Oldknow et al.
8,435,134 B2 5/2013 Tang et al.
8,496,541 B2 7/2013 Beach et al.
8,496,544 B2 7/2013 Curtis et al.
8,517,855 B2 8/2013 Beach et al.
8,517,860 B2 8/2013 Albertsen et al.
8,523,702 B2 9/2013 Thomas et al.
8,529,368 B2 9/2013 Rice et al.
8,540,588 B2 9/2013 Rice et al.
8,562,453 B2 10/2013 Sato
8,579,728 B2 11/2013 Morales et al.
8,591,351 B2 11/2013 Albertsen et al.
8,602,907 B2 12/2013 Beach et al.
8,616,999 B2 12/2013 Greaney et al.
D697,152 S 1/2014 Harbert et al.
8,622,847 B2 1/2014 Beach et al.
8,628,433 B2 1/2014 Stites et al.
8,632,419 B2 1/2014 Tang et al.
8,641,555 B2 2/2014 Stites et al.
8,663,029 B2 3/2014 Beach et al.
8,678,949 B2 3/2014 Shimazaki
8,684,863 B2 * 4/2014 Bezilla ..... A63B 53/06 473/335
8,690,704 B2 4/2014 Thomas
8,690,707 B2 * 4/2014 Stites ..... A63B 60/42 473/335
8,695,487 B2 4/2014 Sakane et al.
8,696,487 B2 4/2014 Beach et al.
8,696,491 B1 4/2014 Myers
8,702,531 B2 4/2014 Boyd et al.
8,721,471 B2 5/2014 Albertsen et al.
8,727,900 B2 5/2014 Beach et al.
8,734,271 B2 5/2014 Beach et al.
D707,768 S 6/2014 Oldknow et al.
D707,769 S 6/2014 Oldknow et al.
D707,773 S 6/2014 Oldknow et al.
8,747,250 B2 6/2014 Chao et al.
8,753,222 B2 6/2014 Beach et al.
8,753,226 B2 6/2014 Rice et al.
8,753,229 B2 6/2014 Rae et al.
8,758,153 B2 6/2014 Sargent et al.
8,758,163 B2 6/2014 Stites
D708,281 S 7/2014 Oldknow et al.
8,783,086 B2 7/2014 Hirano
8,790,195 B1 * 7/2014 Myers ..... A63B 53/0466 473/335
8,795,101 B2 8/2014 Nishio
8,821,312 B2 * 9/2014 Burnett ..... A63B 60/52 473/345
8,827,831 B2 9/2014 Burnett et al.
8,834,289 B2 9/2014 de la Cruz et al.
8,834,290 B2 9/2014 Bezilla et al.
8,834,293 B2 9/2014 Thomas et al.
8,834,294 B1 * 9/2014 Seluga ..... A63B 53/04 473/345
8,845,450 B2 9/2014 Beach et al.
8,845,454 B2 9/2014 Boyd et al.
D714,893 S 10/2014 Atwell
8,876,622 B2 11/2014 Beach et al.
8,876,627 B2 11/2014 Beach et al.

(56) References Cited

U.S. PATENT DOCUMENTS 8,888,607 B2 11/2014 Beach et al.
8,900,069 B2 12/2014 Beach et al.
D722,122 S 2/2015 Greensmith
8,944,934 B2 2/2015 Yamamoto
8,956,240 B2 2/2015 Beach et al.
8,956,244 B1 2/2015 Westrum et al.
8,986,133 B2 3/2015 Bennett et al.
8,992,339 B2 * 3/2015 Matsunaga ..... A63B 53/04 473/335
9,033,821 B2 5/2015 Beach et al.
9,061,186 B2 6/2015 Larson
9,072,949 B2 * 7/2015 Stites ..... A63B 53/04
9,095,753 B2 8/2015 Bezilla et al.
9,101,811 B1 8/2015 Goudarzi et al.
9,144,718 B2 * 9/2015 Johnson ..... A63B 60/00
9,162,120 B2 10/2015 Jertson et al.
9,168,438 B2 10/2015 Boyd
9,180,348 B2 11/2015 Beach et al.
9,180,349 B1 * 11/2015 Seluga ..... A63B 53/0466
9,186,560 B2 11/2015 Harbert et al.
9,199,145 B1 12/2015 Myers
9,205,312 B2 * 12/2015 Zimmerman ..... A63B 53/0466
9,211,447 B2 12/2015 Harbert et al.
9,211,453 B1 * 12/2015 Foster ..... A63B 53/06
9,220,953 B2 12/2015 Beach et al.
9,220,955 B2 12/2015 Hayase et al.
9,227,115 B2 1/2016 Cameron
9,238,162 B2 * 1/2016 Breier ..... A63B 60/52
9,259,627 B1 * 2/2016 Myers ..... A63B 53/04
9,289,660 B1 * 3/2016 Myers ..... A63B 53/0466
9,295,885 B2 * 3/2016 Matsunaga ..... A63B 60/52
9,364,728 B1 * 6/2016 Myers ..... A63B 60/52
9,381,406 B2 7/2016 Boggs
9,381,410 B2 * 7/2016 Golden ..... A63B 53/0466
9,387,373 B1 7/2016 DeMille et al.
9,403,069 B2 8/2016 Boyd et al.
9,421,438 B2 8/2016 Beno et al.
9,433,836 B2 * 9/2016 Breier ..... A63B 53/0466
9,440,126 B2 * 9/2016 Boyd ..... A63B 60/04
9,468,816 B2 10/2016 Barelmann et al.
9,486,677 B1 11/2016 Seluga et al.
9,498,688 B2 11/2016 Galvan et al.
9,561,405 B2 2/2017 Rae et al.
9,597,558 B1 3/2017 Seluga et al.
9,597,561 B1 * 3/2017 Seluga ..... A63B 60/52
9,597,563 B2 3/2017 Voshall et al.
9,623,291 B2 4/2017 Greensmith et al.
9,623,294 B1 * 4/2017 Kingston ..... A63B 60/52
9,623,302 B1 * 4/2017 Myers ..... A63B 53/0466
9,630,069 B2 4/2017 Foster et al.
9,636,552 B2 5/2017 Cleghorn et al.
9,636,553 B1 5/2017 Myers
9,662,545 B2 5/2017 Beach et al.
9,687,701 B1 6/2017 Seluga et al.
9,687,702 B1 6/2017 Seluga et al.
9,694,257 B1 7/2017 Seluga et al.
9,694,261 B2 * 7/2017 Nunez ..... A63B 60/52
9,700,763 B2 7/2017 Harbert et al.
9,700,764 B2 * 7/2017 Carter ..... A63B 53/0466
9,700,769 B2 7/2017 Beach et al.
9,700,771 B2 * 7/2017 Murphy ..... A63B 53/06
9,707,457 B2 7/2017 Mata et al.
9,707,459 B1 * 7/2017 Myers ..... A63B 60/52
9,717,962 B1 8/2017 Seluga et al.
9,724,577 B1 8/2017 Kingston et al.
9,731,175 B1 * 8/2017 Myers ..... A63B 60/04
9,764,210 B2 * 9/2017 Curtis ..... A63B 53/0466
9,776,058 B2 10/2017 Seluga et al.
9,795,840 B2 10/2017 Greensmith et al.
9,814,954 B2 11/2017 Westrum et al.
9,855,474 B2 1/2018 Beno et al.
9,855,476 B2 1/2018 Seluga et al.
9,861,864 B2 1/2018 Beach et al.
9,861,865 B1 1/2018 Harbert et al.
9,868,036 B1 * 1/2018 Kleinert ..... A63B 53/06
9,901,794 B2 2/2018 Beno et al.
9,908,017 B2 3/2018 Seluga et al.
9,914,027 B1 3/2018 Harbert et al.
9,914,028 B1 * 3/2018 Cleghorn ..... A63B 60/02
9,914,030 B2 3/2018 Cleghorn et al.
9,931,549 B1 4/2018 Seluga et al.
9,987,533 B2 * 6/2018 Oldknow ..... A63B 60/04
9,993,700 B2 6/2018 Beach et al.
10,004,954 B2 6/2018 Chen et al.
10,035,049 B1 7/2018 Nielson et al.
10,035,051 B2 7/2018 Cleghorn et al.
10,065,094 B2 9/2018 Wallin
10,076,688 B1 9/2018 Harbert et al.
10,086,240 B1 10/2018 Hoffman et al.
10,159,880 B1 * 12/2018 Mine ..... A63B 53/0466
10,173,111 B2 1/2019 Busch et al.
10,183,202 B1 1/2019 Harbert et al.
10,213,665 B1 2/2019 Day et al.
10,398,952 B1 9/2019 Yi et al.
10,398,954 B2 9/2019 Kline et al.
10,463,928 B2 11/2019 Stokke et al.
10,478,679 B2 11/2019 Harbert et al.
10,556,161 B2 2/2020 Jertson et al.
10,569,144 B2 2/2020 Nielson et al.
10,576,337 B2 3/2020 Soracco et al.
10,596,428 B1 * 3/2020 Rumble ..... A63B 60/02
10,639,524 B2 * 5/2020 Penney ..... A63B 53/06
10,653,926 B2 * 5/2020 Story ..... A63B 53/0466
10,668,341 B2 6/2020 Jertson et al.
10,843,048 B1 11/2020 Hoffman et al.
10,898,764 B2 1/2021 Harbert et al.
10,926,143 B2 * 2/2021 Bennett ..... A63B 60/02
10,974,109 B2 * 4/2021 Stokke ..... A63B 53/04
11,090,536 B2 * 8/2021 Bennett ..... A63B 53/08
11,192,005 B2 * 12/2021 Bennett ..... A63B 60/02
11,400,350 B2 8/2022 Story et al.
11,406,881 B2 * 8/2022 Harbert ..... A63B 53/06
11,684,830 B2 * 6/2023 Mizutani ..... A63B 53/04 473/345
11,759,685 B2 * 9/2023 Johnson ..... A63B 53/06 473/282
2001/0049310 A1 12/2001 Cheng et al.
2001/0055995 A1 12/2001 Cackett et al.
2002/0022535 A1 2/2002 Takeda
2002/0025861 A1 2/2002 Ezawa
2002/0032075 A1 3/2002 Vatsvog
2002/0055396 A1 5/2002 Nishimoto et al.
2002/0072434 A1 6/2002 Yabu
2002/0123394 A1 9/2002 Tsurumaki
2002/0137576 A1 9/2002 Dammen
2002/0142859 A1 10/2002 Galloway et al.
2002/0160854 A1 10/2002 Beach et al.
2002/0169036 A1 11/2002 Boone
2002/0183134 A1 12/2002 Allen et al.
2003/0013545 A1 1/2003 Vincent et al.
2003/0032500 A1 2/2003 Nakahara et al.
2003/0036442 A1 2/2003 Chao et al.
2003/0130059 A1 7/2003 Billings
2004/0023729 A1 2/2004 Nagai et al.
2004/0034986 A1 2/2004 Cheng et al.
2004/0087388 A1 5/2004 Beach et al.
2004/0116207 A1 6/2004 De Shiell et al.
2004/0121852 A1 6/2004 Tsurumaki
2004/0157678 A1 8/2004 Kohno
2004/0157680 A1 8/2004 Chen
2004/0176180 A1 9/2004 Yamaguchi et al.
2004/0176183 A1 9/2004 Tsurumaki
2004/0180730 A1 9/2004 Franklin et al.
2004/0192463 A1 9/2004 Tsurumaki et al.
2004/0192467 A1 9/2004 Hocknell et al.
2004/0192468 A1 9/2004 Onoda et al.
2004/0214660 A1 10/2004 Chen
2004/0235584 A1 11/2004 Chao et al.
2004/0242343 A1 12/2004 Chao et al.
2005/0003903 A1 1/2005 Galloway
2005/0049075 A1 3/2005 Chen et al.
2005/0070371 A1 3/2005 Chen et al.
2005/0096151 A1 5/2005 Hou et al.
2005/0096154 A1 5/2005 Chen

(56) References Cited

U.S. PATENT DOCUMENTS

2005/0101404 A1 5/2005 Long et al.
2005/0124435 A1 6/2005 Gambetta et al.
2005/0137024 A1 6/2005 Stites et al.
2005/0176522 A1 8/2005 Erickson et al.
2005/0181884 A1 8/2005 Beach et al.
2005/0209024 A1 9/2005 Oyama
2005/0215350 A1 9/2005 Reyes et al.
2005/0227781 A1 10/2005 Huang et al.
2005/0233830 A1 10/2005 Williams
2005/0239575 A1 10/2005 Chao et al.
2005/0239576 A1 10/2005 Stites et al.
2005/0266933 A1 12/2005 Galloway
2006/0019768 A1 1/2006 Lo
2006/0019770 A1 1/2006 Meyer et al.
2006/0035722 A1 2/2006 Beach et al.
2006/0046869 A1 3/2006 Galloway
2006/0058112 A1 3/2006 Haralason et al.
2006/0068932 A1 3/2006 Rice et al.
2006/0073910 A1 4/2006 Imamoto et al.
2006/0084525 A1 4/2006 Imamoto et al.
2006/0122004 A1 6/2006 Chen et al.
2006/0128500 A1 6/2006 Tavares
2006/0154747 A1 7/2006 Beach
2006/0172816 A1 8/2006 Johnson
2006/0172821 A1 8/2006 Evans
2006/0189407 A1 8/2006 Soracco
2006/0229141 A1 10/2006 Galloway
2006/0240907 A1 10/2006 Latiri
2006/0240908 A1 10/2006 Adams et al.
2007/0021234 A1 1/2007 Tsurumaki et al.
2007/0026961 A1 2/2007 Hou
2007/0049400 A1 3/2007 Imamoto et al.
2007/0049415 A1 3/2007 Shear
2007/0049417 A1 3/2007 Shear
2007/0054750 A1 3/2007 Rice
2007/0105646 A1 5/2007 Beach et al.
2007/0105647 A1 5/2007 Beach et al.
2007/0105648 A1 5/2007 Beach et al.
2007/0105649 A1 5/2007 Beach et al.
2007/0105650 A1 5/2007 Beach et al.
2007/0105651 A1 5/2007 Beach et al.
2007/0105652 A1 5/2007 Beach et al.
2007/0105653 A1 5/2007 Beach et al.
2007/0105654 A1 5/2007 Beach et al.
2007/0105655 A1 5/2007 Beach et al.
2007/0117648 A1 5/2007 Yokota
2007/0117652 A1 5/2007 Beach et al.
2007/0149315 A1 6/2007 Bennett et al.
2007/0178988 A1 8/2007 Tavares et al.
2008/0020861 A1 1/2008 Adams et al.
2008/0132353 A1 6/2008 Hsiao
2008/0146370 A1 6/2008 Beach et al.
2008/0161127 A1 7/2008 Yamamoto
2008/0261715 A1 10/2008 Carter
2008/0261717 A1 10/2008 Hoffman et al.
2008/0280698 A1 11/2008 Hoffman et al.
2009/0048035 A1 2/2009 Stites et al.
2009/0062029 A1 3/2009 Stites et al.
2009/0088269 A1 4/2009 Beach et al.
2009/0088271 A1 4/2009 Beach et al.
2009/0118034 A1* 5/2009 Yokota ..... A63B 53/0466 473/345
2009/0137338 A1 5/2009 Kajita
2009/0170632 A1 7/2009 Beach et al.
2009/0221383 A1 9/2009 Ban et al.
2009/0258725 A1 10/2009 Jones
2009/0264214 A1 10/2009 De La Cruz et al.
2009/0286611 A1 11/2009 Beach et al.
2009/0286618 A1 11/2009 Beach et al.
2009/0286619 A1 11/2009 Beach et al.
2009/0318245 A1 12/2009 Yim et al.
2010/0000071 A1 1/2010 Rice
2010/0016095 A1 1/2010 Burnett et al.
2010/0029402 A1 2/2010 Noble et al.
2010/0029404 A1 2/2010 Shear
2010/0029408 A1 2/2010 Abe
2010/0035701 A1 2/2010 Kusumoto
2010/0048316 A1 2/2010 Honea et al.
2010/0048321 A1 2/2010 Beach et al.
2010/0075774 A1 3/2010 Ban
2010/0113176 A1 5/2010 Boyd et al.
2010/0139073 A1 6/2010 Galloway
2010/0139079 A1 6/2010 Dawson et al.
2010/0144461 A1 6/2010 Ban
2010/0167837 A1 7/2010 Ban
2010/0197423 A1 8/2010 Thomas et al.
2010/0197426 A1 8/2010 De La Cruz et al.
2010/0234126 A1 9/2010 Cackett et al.
2010/0234127 A1 9/2010 Snyder et al.
2010/0273565 A1 10/2010 Stites et al.
2010/0331103 A1 12/2010 Takahashi et al.
2011/0014995 A1 1/2011 Wada et al.
2011/0021284 A1 1/2011 Stites et al.
2011/0081986 A1* 4/2011 Stites ..... A63B 60/00 473/334
2011/0098127 A1 4/2011 Yamamoto
2011/0151989 A1 6/2011 Golden et al.
2011/0151997 A1 6/2011 Shear
2011/0195798 A1 8/2011 Sander et al.
2011/0218053 A1 9/2011 Tang et al.
2011/0294599 A1 12/2011 Albertsen et al.
2011/0312437 A1 12/2011 Sargent et al.
2012/0083359 A1 4/2012 Stites
2012/0083360 A1* 4/2012 Boyd ..... A63B 53/06 473/337
2012/0083362 A1 4/2012 Albertsen et al.
2012/0083363 A1 4/2012 Albertsen et al.
2012/0122601 A1 5/2012 Beach et al.
2012/0142447 A1 6/2012 Boyd et al.
2012/0142452 A1 6/2012 Burnett et al.
2012/0149491 A1 6/2012 Beach et al.
2012/0165110 A1 6/2012 Cheng
2012/0165111 A1 6/2012 Cheng
2012/0196701 A1 8/2012 Stites et al.
2012/0202615 A1 8/2012 Beach et al.
2012/0220387 A1 8/2012 Beach et al.
2012/0244960 A1 9/2012 Tang et al.
2012/0270676 A1 10/2012 Burnett et al.
2012/0277029 A1 11/2012 Albertsen et al.
2012/0277030 A1 11/2012 Albertsen et al.
2012/0289360 A1 11/2012 Breier et al.
2012/0289361 A1 11/2012 Beach et al.
2012/0302366 A1 11/2012 Murphy
2013/0065705 A1 3/2013 Morales et al.
2013/0090185 A1* 4/2013 Boyd ..... A63B 60/02 473/337
2013/0102410 A1 4/2013 Stites et al.
2013/0165254 A1 6/2013 Rice et al.
2013/0210542 A1 8/2013 Harbert et al.
2013/0324284 A1 12/2013 Stites et al.
2014/0031141 A1 1/2014 Myrhum
2014/0080629 A1 3/2014 Sargent et al.
2014/0162809 A1 6/2014 Soracco
2015/0011328 A1 1/2015 Harbert et al.
2015/0065265 A1 3/2015 Motokawa et al.
2015/0105177 A1 4/2015 Beach et al.
2015/0217167 A1 8/2015 Frame et al.
2015/0231453 A1 8/2015 Harbert et al.
2015/0297961 A1 10/2015 Voshall et al.
2015/0306475 A1 10/2015 Curtis et al.
2015/0321055 A1* 11/2015 Golden ..... A63B 60/42 473/334
2016/0001146 A1 1/2016 Sargent et al.
2016/0008682 A1 1/2016 Beach et al.
2016/0023060 A1 1/2016 Harbert et al.
2016/0236047 A1 8/2016 Chen et al.
2016/0250525 A1 9/2016 Motokawa et al.
2016/0271464 A1 9/2016 Murphy et al.
2016/0279490 A1 9/2016 Onuki
2017/0304692 A1 10/2017 Beach et al.
2018/0147461 A1* 5/2018 Stokke ..... A63B 53/04
2021/0086042 A1 3/2021 Story et al.

(56) References Cited

U.S. PATENT DOCUMENTS

| | | | | |
|---|---|---|---|---|
| 2021/0128994 | A1* | 5/2021 | Yi | A63B 53/047 |
| 2022/0111263 | A1* | 4/2022 | Yi | A63B 53/0433 |

FOREIGN PATENT DOCUMENTS

| | | | | | |
|---|---|---|---|---|---|
| CN | 201353407 | Y | | 12/2009 | |
| CN | 203389296 | U | | 1/2014 | |
| CN | 204106986 | U | | 1/2015 | |
| DE | 3711964 | A1 | | 10/1988 | |
| DE | 9012884 | U1 | | 11/1990 | |
| EP | 0470488 | B1 | | 3/1995 | |
| EP | 0617987 | B1 | | 11/1997 | |
| EP | 1001175 | A2 | | 5/2000 | |
| EP | 2377586 | A2 | | 10/2011 | |
| EP | 3434340 | A1 | * | 1/2019 | A63B 53/04 |
| GB | 194823 | A | | 3/1923 | |
| GB | 2327889 | A | | 2/1999 | |
| JP | S57157374 | U | | 10/1982 | |
| JP | H4180778 | A | | 6/1992 | |
| JP | H05317465 | A | | 12/1993 | |
| JP | H06126004 | A | | 5/1994 | |
| JP | H06190088 | A | | 7/1994 | |
| JP | H06238022 | A | | 8/1994 | |
| JP | H06304271 | A | | 11/1994 | |
| JP | 3035480 | U | | 12/1996 | |
| JP | 09-028844 | | | 2/1997 | |
| JP | H09308717 | A | | 12/1997 | |
| JP | H09327534 | A | | 12/1997 | |
| JP | H10234902 | A | | 9/1998 | |
| JP | H10277187 | A | | 10/1998 | |
| JP | H11114102 | A | | 4/1999 | |
| JP | 2000014841 | A | | 1/2000 | |
| JP | 2000197718 | A | | 7/2000 | |
| JP | 2001054595 | A | | 2/2001 | |
| JP | 2001129130 | A | | 5/2001 | |
| JP | 2001170225 | A | | 6/2001 | |
| JP | 2001204856 | A | | 7/2001 | |
| JP | 2001346918 | A | | 12/2001 | |
| JP | 2002003969 | A | | 1/2002 | |
| JP | 2002017910 | A | | 1/2002 | |
| JP | 2002052099 | A | | 2/2002 | |
| JP | 2002248183 | A | | 9/2002 | |
| JP | 2002253706 | A | | 9/2002 | |
| JP | 2003038691 | A | | 2/2003 | |
| JP | 2003093554 | A | | 4/2003 | |
| JP | 2003126311 | A | | 5/2003 | |
| JP | 2003226952 | A | | 8/2003 | |
| JP | 2004174224 | A | | 6/2004 | |
| JP | 2004183058 | A | | 7/2004 | |
| JP | 2004222911 | | | 8/2004 | |
| JP | 2004261451 | A | | 9/2004 | |
| JP | 2004267438 | A | | 9/2004 | |
| JP | 2004313762 | A | | 11/2004 | |
| JP | 2004351054 | A | | 12/2004 | |
| JP | 2004351173 | A | | 12/2004 | |
| JP | 2005028170 | A | | 2/2005 | |
| JP | 2005296458 | A | | 10/2005 | |
| JP | 2005296582 | A | | 10/2005 | |
| JP | 2005323978 | A | | 11/2005 | |
| JP | 2006101918 | A | | 4/2006 | |
| JP | 2006198385 | A | | 8/2006 | |
| JP | 2006231063 | A | | 9/2006 | |
| JP | 2006320493 | A | * | 11/2006 | |
| JP | 2007312846 | A | | 12/2007 | |
| JP | 2008515560 | A | | 5/2008 | |
| JP | 4128970 | B2 | | 7/2008 | |
| JP | 2008200118 | A | | 9/2008 | |
| JP | 2008272274 | A | * | 11/2008 | |
| JP | 2009000281 | A | | 1/2009 | |
| JP | 2010252964 | A | * | 11/2010 | |
| JP | 2010279847 | A | | 12/2010 | |
| JP | 2011005167 | A | * | 1/2011 | A63B 53/0466 |
| JP | 2011024999 | A | | 2/2011 | |
| JP | 2011229914 | | | 11/2011 | |
| JP | 2011229914 | A | * | 11/2011 | |
| JP | 2012-115415 | | | 6/2012 | |
| JP | 2012125291 | A | * | 7/2012 | |
| JP | 2014131766 | A | * | 7/2014 | A63B 53/0466 |
| JP | 2015019998 | A | * | 2/2015 | A63B 53/02 |
| TW | I389719 | B | | 3/2013 | |
| TW | M465945 | U | | 11/2013 | |
| TW | I526236 | B | | 3/2016 | |
| WO | WO 88/02642 | A1 | | 4/1988 | |
| WO | WO 96/22817 | A1 | | 8/1996 | |
| WO | WO 1999/020358 | A1 | | 4/1999 | |
| WO | WO 2001/049376 | A1 | | 7/2001 | |
| WO | WO 01/66199 | A1 | | 9/2001 | |
| WO | WO 02/062501 | A2 | | 8/2002 | |
| WO | WO 03/061773 | A1 | | 7/2003 | |
| WO | WO 2004/043549 | A1 | | 5/2004 | |
| WO | WO 2006/044631 | A2 | | 4/2006 | |
| WO | WO-2013028853 | A1 | * | 2/2013 | A63B 53/00 |
| WO | WO 2014/070343 | A1 | | 5/2014 | |

OTHER PUBLICATIONS

Callaway Golf, World's Straightest Driver: FT-i Driver downloaded from www.callawaygolf.com/ft%2Di/driver.aspx?lang=en on Apr. 5, 2007.

Declaration of Tim Reed, VP of R&D, Adams Golf, Inc., dated Dec. 7, 2012.

Jackson, Jeff, The Modern Guide to Golf Clubmaking, Ohio: Dynacraft Golf Products, Inc., copyright 1994, p. 237.

Nike Golf, Sasquatch 460, downloaded from www.nike.com/nikegolf/index.htm on Apr. 5, 2007.

Nike Golf, Sasquatch Sumo Squared Driver, downloaded from www.nike.com/nikegolf/index.htm on Apr. 5, 2007.

Taylor Made Golf Company, Inc. Press Release, Burner Fairway Wood, www.tmag.com/media/pressreleases/2007/011807_burner_fairway_rescue.html, Jan. 26, 2007.

Taylor Made Golf Company Inc., R7 460 Drivers, downloaded from www.taylormadegolf.com/product_detail.asp?pID=14section=overview on Apr. 5, 2007.

Titleist 907D1, downloaded from www.tees2greens.com/forum/Uploads/Images/7ade3521-192b-4611-870b-395d.jpg on Feb. 1, 2007.

* cited by examiner

GOLF CLUB HEADS

CROSS-REFERENCE TO RELATED APPLICATIONS

This application is a continuation of U.S. patent application Ser. No. 17/390,615, filed Jul. 30, 2021, which is a continuation-in-part of U.S. patent application Ser. No. 17/135,666, filed Dec. 28, 2020, now U.S. Pat. No. 11,406,881. Each of these applications is incorporated by reference herein in its entirety.

In addition, other patents and patent applications concerning golf clubs, including U.S. Pat. Nos. 7,753,806; 7,887,434; 8,118,689; 8,663,029; 8,888,607; 8,900,069; 9,186,560; 9,211,447; 9,220,953; 9,220,956; 9,848,405; and 9,700,763 and U.S. patent application Ser. No. 15/859,071, are incorporated by reference herein in their entirety.

FIELD

This application concerns golf club heads, and more particularly, golf club heads for wood-type clubs including driver-type, fairway-type, and hybrid-type golf clubs.

BACKGROUND

Much of the recent improvement activity in the field of golf has involved the use of new and increasingly more sophisticated materials in concert with advanced club-head engineering. For example, modern "wood-type" golf clubs (notably, "drivers," "fairway woods," and "utility or hybrid clubs"), with their sophisticated shafts and non-wooden club-heads, bear little resemblance to the "wood" drivers, low-loft long-irons, and higher numbered fairway woods used years ago. These modern wood-type clubs are generally called "metalwoods" since they tend to be made primarily of strong, lightweight metals, such as titanium.

An exemplary metalwood golf club such as a driver or fairway wood typically includes a hollow shaft having a lower end to which the golf club head is attached. Most modern versions of these golf club heads are made, at least in part, of a lightweight but strong metal such as titanium alloy. In many cases, the golf club head comprises a body made primarily of such strong metals.

Some current approaches to reducing structural mass of a metalwood club-head are directed to making one or more portions of the golf club head of an alternative material. Whereas the bodies and face plates of most current metalwoods are made of titanium alloys, some golf club heads are made, at least in part, of components formed from either graphite/epoxy-composite (or other suitable composite material) and a metal alloy. Graphite composites have a much lower density compared to titanium alloys, which offers an opportunity to provide more discretionary mass in the club-head.

The ability to utilize such materials to increase the discretionary mass available for placement at various points in the club-head allows for optimization of a number of physical properties of the club-head which can greatly impact the performance obtained by the user. Forgiveness on a golf shot is generally maximized by configuring the golf club head such that the center of gravity ("CG") of the golf club head is optimally located and the moment of inertia ("MOI") of the golf club head is maximized. CG and MOI can also critically affect a golf club head's performance, such as launch angle and flight trajectory on impact with a golf ball, among other characteristics.

In addition to the use of various materials to optimize the strength-to-weight properties and acoustic properties of the golf club heads, advances have been made in the mass distribution properties provided by using thicker and thinner regions of materials, raising and lowering certain portions of the sole and crown, providing adjustable weight members and adjustable head-shaft connection assemblies, and many other golf club head engineering advances.

SUMMARY

This application discloses, among other innovations, wood-type golf club heads that provide, among other attributes, improved forgiveness, ball speed, adjustability and playability, while maintaining durability.

The following describes wood-type golf club heads that include a body defining an interior cavity, a sole positioned at a bottom portion of the golf club head and a crown positioned at a top portion. The body also has a face defining a forward portion extending between a heel portion of the golf club head and a toe portion of the golf club head, a rearward portion opposite the face, and a hosel.

Certain of the described golf club heads have a weight channel formed in the sole and defining a path along the sole. In certain instances, a weight member is positioned in or on the weight channel, and may be configured to be adjusted along the path to any of a range of selectable positions in the weight channel to adjust mass properties of the golf club head. In particular instances, a fastener is configured to secure the weight member to the golf club head body in any of the selectable positions along the path. In certain examples, there are at least five, or in some cases at least ten such selectable positions. The fastener may be secured to the golf club head body at a fixed location that is independent of the position of the weight member along the path, so that this position does not change, regardless of where the weight member is positioned along the path.

In certain instances, the path may comprise a substantially linear path extending in a substantially heel-toe direction, or, alternatively, in a substantially forward-rearward direction. In other instances, the path comprises a curved path extending in a substantially heel-toe direction. In some instances, the weight channel is positioned in a forward portion of the sole, and, in particular instances, the channel comprises a toe and a heel end, and wherein the channel curves rearwardly at the toe and heel ends, away from the face. In other instances, the channel is positioned in a rearward portion of the sole, and, in particular instances, the channel comprises a toe end and a heel end, and wherein the channel curves forwardly at the toe and heel ends. In some instances, the weight channel comprises an outer arc that extends at least half of a length of the golf club head from a heel of the golf club head to a toe of the golf club head, or half of a depth of the golf club head from the face to a trailing edge of the golf club head.

The weight member may comprise a forward side and a rearward side. In particular instances, the forward side of the weight member is curved parallel to a corresponding curved forward edge of the weight channel. In some cases, the rearward side is also curved parallel to a corresponding curved rearward edge of the weight channel. In particular instances, the weight member is positioned entirely external to the interior cavity. In some instances, a lower surface of the weight member is approximately parallel to the sole to serve as a ground contact point when the golf club head is soled.

The golf club may comprise a front channel in the sole positioned forward of the weight channel and extending into the interior cavity of the golf club head, the front channel extending substantially in a heel-toe direction. The front channel, or a similar slot channel in addition to the weight channel may increase or enhance the perimeter flexibility of the striking face of the golf club head in order to increase the coefficient of restitution and/or characteristic time of the golf club head and frees up additional discretionary mass which can be utilized elsewhere in the golf club head. In some instances, the front channel, or similar slot or other mechanism is located in the forward portion of the sole of the golf club head, adjacent to or near to the forwardmost edge of the sole. Also, in some instances, the front channel extends into the interior cavity of the golf club head, and in particular cases extends substantially in a heel-toe direction.

In particular instances, the weight member comprises an elongated weight slot that extends through an interior of the weight member, the fastener extends through the weight slot, and is configured to permit the weight member to translate along the path while the fastener is stationary. In some instances, the fastener comprises a fastener head that is recessed within the weight slot and a threaded fastener shaft that extends from the fastener head and is secured to the body at a fastener port in the body. In certain instances, the fastener port is forward of the fastener head. The fastener may be configured to, in a loosened position, allow the weight member to translate along the path as the fastener remains stationary relative to the fastener port. The fastener may further be configured to, in a secured position, retain the weight member in a selected position. In some instances, the fastener may comprise two or more fasteners each passing through the weight slot and secured to the golf club head body at different locations. In some instances, the fastener may itself comprise a removable weight, which mass can be adjusted as desired to adjust mass properties of the golf club head. In some instances, the fastener at least partially covers the weight member. In particular instances, the fastener does not extend through the weight member. In certain cases, the fastener comprises a tab that extends below at least a portion of either a forward edge or a rearward edge of the weight member, and may in particular instances further comprise a removable screw or bolt that extends through the tab and into the body of the golf club head.

The weight channel may have a path dimension representing a distance of travel for the weight member, wherein the distance comprises the distance between a first path end positioned proximate to a first end of the channel and a second path end positioned proximate to a second end of the channel. In particular instances, the weight member may have a first dimension that is normal to the path dimension and a second dimension that is parallel to the path dimension, and in some cases the second dimension is at least 50 percent of the path dimension. In some cases, the second dimension may be at least 70 percent of the path dimension.

In some cases, translating the weight member from a first position adjacent a first end of the channel to a second position adjacent a second end of the channel provides a golf club head center of gravity movement along an x-axis (CGx) of at least 3 mm, at least 4 mm or at least 5 mm. In certain instances, the weight member has a mass of at least 40 grams, or at least 60 grams. In particular instances, the weight member comprises at least 25 percent, or in some cases at least 30 percent, of a total mass of the golf club head. The weight member may comprise a forward side and a rearward side, and have a center of mass that is nearer the forward side than the rearward side. In particular examples, a height of the weight member at the forward side is greater than a height of the weight member at the rearward side. The weight member may in some instances be tapered down from the forward side to the rearward side. Additionally or alternatively, the weight member may comprise two or more stepped portions. In particular cases, a first stepped portion at the forward side has a first height that is greater than a second height of a second stepped portion at the rearward side. In some cases, wherein the rearward side of the weight member comprises a chamfered edge. In particular instances, the golf club head further comprises a polymeric pad positioned between the chamfered edge and the body. The rearward end of the weight member may comprise a recessed ledge portion that corresponds to a protruding ledge portion on the golf club head body, such as in the weight channel. In some cases, a polymeric pad may be positioned between the recessed ledge portion and the protruding ledge portion.

In particular instances, the weight member is configured to move in an arcuate path defined by a center axis of curvature located rearward of the face, rearward of the weight channel, and/or rearward of a center of gravity of the golf club head. In some cases, the weight member is configured to move in an arc of less than 90 degrees, or less than 180 degrees around the center axis of curvature. In particular cases, the weight member may be configured to move around the center axis of curvature in an arc of between 5 degrees and 90 degrees, between 10 degrees and 30 degrees, or between 15 degrees and 45 degrees. Additionally or alternatively, the weight member may be configured to move around a center axis of curvature, wherein the center axis of curvature is not collocated with a position of the fastener.

In some instances, the golf club head may have a balance point up (BP Up) value of less than 23 mm, less than 22 mm, or less than 20 mm.

In some embodiments, part of the weight channel, or weight track, is covered by an overhanging portion of the body or the sole insert, and part of the weight can slide under the overhanging portion and be hidden. For example, the track can extend in a heel-toe direction across the sole and the heelward end portion of the track can be covered by an overhang portion of a composite sole insert, which overhang portion can also act as a sit point for the club head to contact the ground when the club head is in the normal address position. The overhang portion can protect the weight and track, while also improving aerodynamics of the sole. In some embodiments, the weight can by asymmetric, with a forward portion of the weight being thicker and the rearward portion of the weight being thinner.

The foregoing and other objects, features, and advantages of the disclosed technology will become more apparent from the following detailed description, which proceeds with reference to the accompanying figures.

DETAILED DESCRIPTION

Figure 1A:
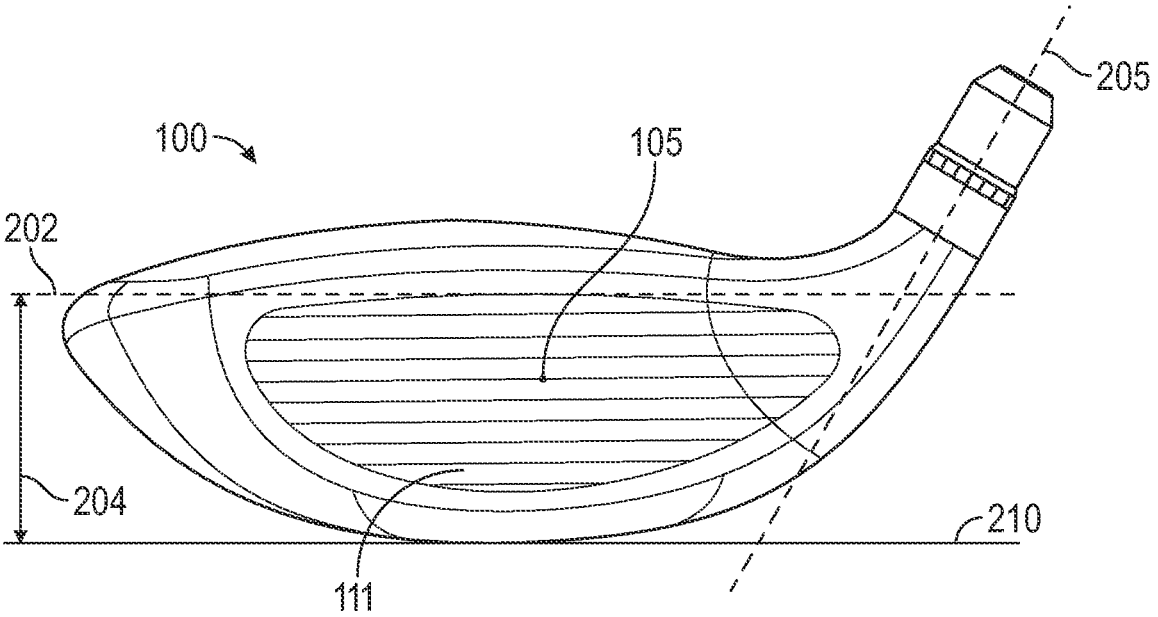
FIG. 1A is a front elevational view of an exemplary golf club head disclosed herein.

The following describes embodiments of golf club heads for metalwood type golf clubs, including drivers, fairway woods, rescue clubs, hybrid clubs, and the like. Several of the golf club heads incorporate features that provide the golf club heads and/or golf clubs with increased moments of inertia and low centers of gravity, centers of gravity located in preferable locations, improved golf club head and face geometries, increased sole and lower face flexibility, higher coefficients or restitution ("COR") and characteristic times ("CT"), and/or decreased backspin rates relative to fairway wood and other golf club heads that have come before.

This disclosure describes embodiments of golf club heads in the exemplary context of fairway wood-type golf clubs, but the principles, methods and designs described may be applicable in whole or in part to other wood-type golf clubs, such as drivers, utility clubs (also known as hybrid clubs), rescue clubs, and the like.

The disclosed inventive features include all novel and non-obvious features disclosed herein, both alone and in novel and non-obvious combinations with other elements. As used herein, the phrase "and/or" means "and," "or" and both "and" and "or." As used herein, the singular forms "a," "an" and "the" refer to one or more than one, unless the context clearly dictates otherwise. As used herein, the terms "including" and "having" (and their grammatical variants) mean "comprising."

This disclosure also refers to the accompanying drawings, which form a part hereof. The drawings illustrate specific embodiments, but other embodiments may be formed and structural changes may be made without departing from the intended scope of this disclosure and the technology discussed herein. Directions and references (e.g., up, down, top, bottom, left, right, rearward, forward, heelward, toeward, etc.) may be used to facilitate discussion of the drawings but are not intended to be limiting. For example, certain terms may be used such as "up," "down," "upper," "lower," "horizontal," "vertical," "left," "right" and the like. These terms are used where applicable, to provide some clarity of description when dealing with relative relationships, particularly with respect to the illustrated embodiments. Such terms are not, however, intended to imply absolute relationships, positions and/or orientations, unless otherwise indicated. For example, with respect to an object, an "upper" surface can become a "lower" surface simply by turning the object over. Nevertheless, it is still the same object. Accordingly, the following detailed description shall not be construed in a limiting sense and the scope of property rights sought shall be defined by the appended claims and their equivalents.

Golf club head "forgiveness" generally describes the ability of a golf club head to deliver a desirable golf ball trajectory despite a miss-hit (e.g., a ball struck at a location on the face plate other than an ideal impact location, e.g., an impact location where coefficient of restitution is maximized). Large mass moments of inertia contribute to the overall forgiveness of a golf club head. In addition, a low center-of-gravity improves forgiveness for golf club heads used to strike a ball from the turf by giving a higher launch angle and a lower spin trajectory (which improves the distance of a fairway wood golf shot). Providing a rearward center-of-gravity reduces the likelihood of a slice or fade for many golfers. Accordingly, forgiveness of fairway wood golf club heads, can be improved using the techniques described above to achieve high moments of inertia and low center-of-gravity compared to conventional fairway wood golf club heads.

For example, a golf club head with a crown thickness less than about 0.65 mm throughout at least about 70% of the crown can provide significant discretionary mass. A 0.60 mm thick crown formed from steel can provide as much as about 8 grams of discretionary mass compared to a 0.80 mm thick crown. Alternatively, a 0.80 mm thick crown formed from a composite material having a density of about 1.5 g/cc can provide as much as about 26 grams of discretionary mass compared to a 0.80 mm thick crown formed from steel. The large discretionary mass can be distributed to improve the mass moments of inertia and desirably locate the golf club head center-of-gravity. Generally, discretionary mass should be located sole-ward rather than crown-ward to maintain a low center-of-gravity, forward rather than rearward to maintain a forwardly positioned center of gravity, and rearward rather than forward to maintain a rearwardly positioned center-of-gravity. In addition, discretionary mass should be located far from the center-of-gravity and near the perimeter of the golf club head to maintain high mass moments of inertia.

Another parameter that contributes to the forgiveness and successful playability and desirable performance of a golf club is the coefficient of restitution (COR) of the golf club head. Upon impact with a golf ball, the golf club head's face plate deflects and rebounds, thereby imparting energy to the struck golf ball. The golf club head's coefficient of restitution is the ratio of the velocity of separation to the velocity of approach. A thin face plate generally will deflect more than a thick face plate. Thus, a properly constructed club with a thin, flexible face plate can impart a higher initial velocity to a golf ball, which is generally desirable, than a club with a thick, rigid face plate. In order to maximize the moment of inertia (MOI) about the center of gravity (CG) and achieve a high COR, it typically is desirable to incorporate thin walls and a thin face plate into the design of the golf club head. Thin walls afford the designers additional leeway in distributing golf club head mass to achieve desired mass distribution, and a thinner face plate may provide for a relatively higher COR.

Thus, thin walls are important to a club's performance. However, overly thin walls can adversely affect the golf club head's durability. Problems also arise from stresses distributed across the golf club head upon impact with the golf ball, particularly at junctions of golf club head components, such as the junction of the face plate with other golf club head components (e.g., the sole, skirt, and crown). One prior solution has been to provide a reinforced periphery about the face plate, such as by welding, in order to withstand the repeated impacts. Another approach to combat stresses at impact is to use one or more ribs extending substantially from the crown to the sole vertically, and in some instances extending from the toe to the heel horizontally, across an inner surface of the face plate. These approaches tend to adversely affect club performance characteristics, e.g., diminishing the size of the sweet spot, and/or inhibiting design flexibility in both mass distribution and the face structure of the golf club head. Thus, these golf club heads fail to provide optimal MOI, CG, and/or COR parameters, and as a result, fail to provide much forgiveness for off-center hits for all but the most expert golfers.

Thus, the golf club heads of this disclosure are designed to allow for introduction of a face which can be adjusted in thickness as needed or desired to interact with the other disclosed aspects, such as a channel or slot positioned behind the face, as well as increased areas of mass and/or removable weights. The golf club heads of this disclosure may utilize, for example, the variable thickness face features described in U.S. Pat. Nos. 8,353,786, 6,997,820, 6,800,038, and 6,824,475, which are incorporated herein by reference in their entirety. Additionally, the mass of the face, as well as other of the above-described properties can be adjusted by using different face materials, structures, and features, such as those described in U.S. Pat. No. RE42,544; U.S. Pat. Nos. 8,096,897; 7,985,146; 7,874,936; 7,874,937; 8,628,434; and 7,267,620; and U.S. Patent Pub. Nos. 2008/0149267 and 2009/0163289, which are herein incorporated by reference in their entirety. Additionally, the structure of the front channel, club head face, and surrounding features of any of the embodiments herein can be varied to further impact COR and related aspects of the golf club head performance, as further described in U.S. Pat. No. 9,662,545; and U.S. Patent Pub. No. 2016/0023062, which are incorporated by reference herein in their entirety.

Golf club heads and many of their physical characteristics disclosed herein will be described using "normal address position" as the golf club head reference position, unless otherwise indicated. The normal address position of the club head is defined as the angular position of the head relative to a horizontal ground plane when the shaft axis lies in a vertical plane that is perpendicular to the centerface target line vector and when the shaft axis defines a lie angle relative to the ground plane such that the scorelines on the face of the club are horizontal (if the club does not have scorelines, then the normal address position lie angle shall be defined as 60-degrees). The centerface target line vector is defined as a horizontal vector that points forward (along the Y-axis) from the centerface point of the face. The centerface point (axis origin point) can be defined as the geometric center of the striking surface and/or can be defined as an ideal impact location on the striking surface.

Figure 1B:
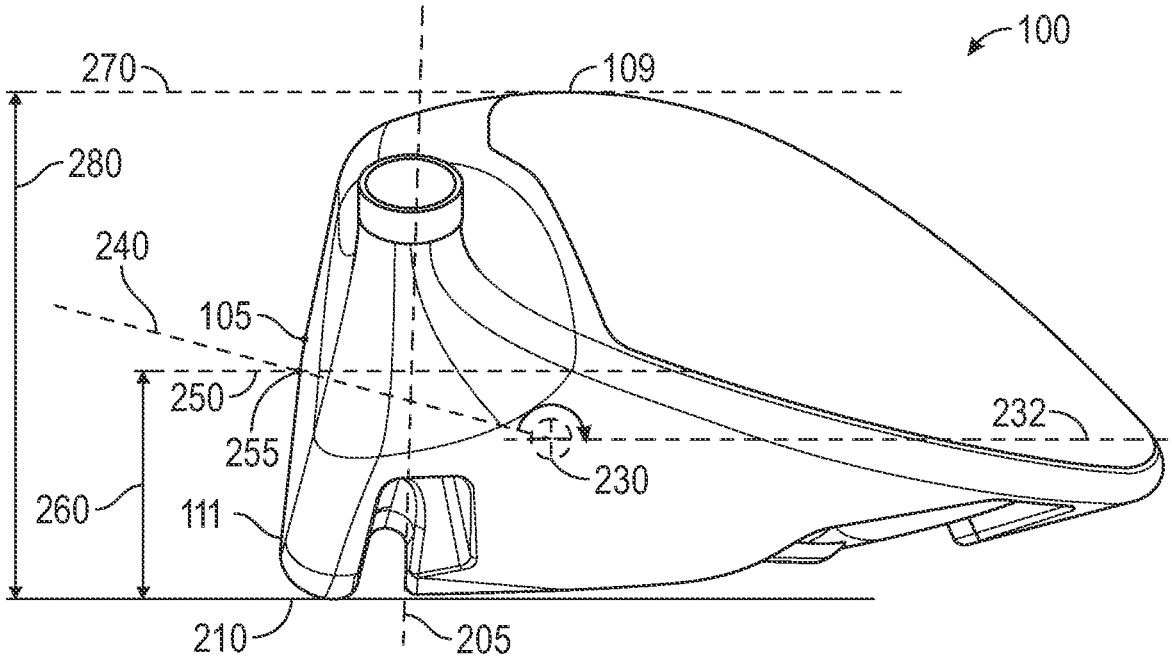
FIG. 1B is heel-side view of the golf club head of FIG. 1A.

FIGS. 1A-1B illustrate one embodiment of a fairway wood type golf club head 100 at normal address position, though it is understood that similar measurements may be made for other wood-type golf clubs, such as drivers, utility clubs (also known as hybrid clubs), rescue clubs, and the like. At normal address position, the golf club head 100 rests on a ground plane 210, a plane parallel to the ground, which is intersected by a centerline axis 205 of a club shaft of the golf club head 100.

In addition to the thickness of the face plate and the walls of the golf club head, the location of the center of gravity also has a significant effect on the COR and other properties of a golf club head. For example, as illustrated in FIG. 1B, a given golf club head having a given CG will have a projected center of gravity or "balance point" or "CG projection" on the face plate 111 that is determined by an imaginary line 240 passing through the CG 230 and oriented normal to the face plate 111. The location 255 where the imaginary line 240 intersects the face plate 111 is the projected CG point 255, which is typically expressed as a distance above or below the geometric center 105 of the face plate 111.

When the projected CG point 255 is well above the center 105 of the face, impact efficiency, which is measured by COR, is not maximized. It has been discovered that a fairway wood with a relatively lower CG projection or a CG projection located at or near an ideal impact location on the striking surface of the club face, as described more fully below, improves the impact efficiency of the golf club head as well as initial ball speed. One important ball launch parameter, namely ball spin, is also improved.

The distance from the ground plane 210 to the Projected CG point 255 may also be an advantageous measurement of golf head playability, and may be represented by a CG plane 250 that is parallel to the ground plane 210. The distance 260 from the ground plane 210 to this CG plane 250 representing CG projection on the face plate 111 may be referred to as the balance point up (BP Up), as also illustrated in FIG. 1B. In the advantageous examples disclosed herein, BP Up may be less than 23 mm, regardless of the position of a weight member along its path of travel, (e.g., path 137 in FIGS. 5A and 9A). In particular instances, BP Up may be lower than 22 mm for any position of the weight member along its path of travel. In still further examples, BP Up made be lower than 20 mm for any position of the weight member along its path of travel.

Additionally, "Zup," as further described herein, may also provide an advantageous measurement of golf club head playability. Zup generally refers to the height of the CG above the ground plane as measured along the z-axis. For example, as illustrated in FIG. 1B, an imaginary line 232 representing Zup extends out from the CG 230 parallel to the ground plane 210.

Fairway wood shots typically involve impacts that occur below the center of the face, and ball speed and launch parameters are often less than ideal. This results because most fairway wood shots are from the ground and not from a tee, and most golfers have a tendency to hit their fairway wood ground shots low on the face of the golf club head. Maximum ball speed is typically achieved when the ball is struck at a location on the striking face where the COR is greatest.

For traditionally designed fairway woods, the location where the COR is greatest is the same as the location of the CG projection on the striking surface. This location, however, is generally higher on the striking surface than the below center location of typical ball impacts during play. In contrast to these conventional golf clubs, it has been discovered that greater shot distance is achieved by configuring the golf club head to have a CG projection that is located near to the center of the striking surface of the golf club head.

It is known that the coefficient of restitution of a golf club may be increased by increasing the height $H_{ss}$ of the face plate—illustrated in FIG. 1A as the distance 204 between the ground plane 210 and a plane 202 intersecting the top of the face plate—and/or by decreasing the thickness of the face plate of a golf club head. However, in the case of a fairway wood, hybrid, or rescue golf club, increasing the face height may be considered undesirable because doing so will potentially cause an undesirable change to the mass properties of the golf club (e.g., center of gravity location) and to the golf club's appearance.

The United States Golf Association (USGA) regulations constrain golf club head shapes, sizes, and moments of inertia. Due to these constraints, golf club manufacturers and designers struggle to produce golf club heads having maximum size and moment of inertia characteristics while maintaining all other golf club head characteristics. For example, one such constraint is a volume limitation of 460 $cm^3$. In general, volume is measured using the water displacement method. However, the USGA will fill any significant cavities in the sole or series of cavities which have a collective volume of greater than 15 $cm^3$.

To produce a more forgiving golf club head, designers struggle to maximize certain parameters such as face area, moment of inertia about the z-axis and x-axis, and address area. A larger face area makes the golf club head more forgiving. Likewise, higher moment of inertia about the z-axis and x-axis makes the golf club head more forgiving. Similarly, a larger front to back dimension will generally increase moment of inertia about the z-axis and x-axis because mass is moved further from the center of gravity and the moment of inertia of a mass about a given axis is proportional to the square of the distance of the mass away from the axis. Additionally, a larger front to back dimension will generally lead to a larger address area which inspires confidence in the golfer when s/he addresses the golf ball.

However, when designers seek to maximize the above parameters it becomes difficult to stay within the volume limits and golf club head mass targets. Additionally, the sole curvature begins to flatten as these parameters are maximized. A flat sole curvature provides poor acoustics. To counteract this problem, designers may add a significant amount of ribs to the internal cavity to stiffen the overall structure and/or thicken the sole material to stiffen the overall structure. See for example FIGS. 55C and 55D and the corresponding text of U.S. Pub. No. 2016/0001146 A1, published Jan. 7, 2016. This, however, wastes discretionary mass that could be put elsewhere to improve other properties like moment of inertia about the z-axis and x-axis, or to permit adjustment of other mass properties such as BP Up or center of gravity movement.

A golf club head Characteristic Time (CT) can be described as a numerical characterization of the flexibility of a golf club head striking face. The CT may also vary at points distant from the center of the striking face, but may not vary greater than approximately 20% of the CT as measured at the center of the striking face. The CT values for the golf club heads described in the present application were calculated based on the method outlined in the USGA "Procedure for Measuring the Flexibility of a Golf Clubhead," Revision 2.0, Mar. 25, 2005, which is incorporated by reference herein in its entirety. Specifically, the method described in the sections entitled "3. Summary of Method," "5. Testing Apparatus Set-up and Preparation," "6. Club Preparation and Mounting," and "7. Club Testing" are exemplary sections that are relevant. Specifically, the characteristic time is the time for the velocity to rise from 5% of a maximum velocity to 95% of the maximum velocity under the test set forth by the USGA as described above.

Figure 2A:
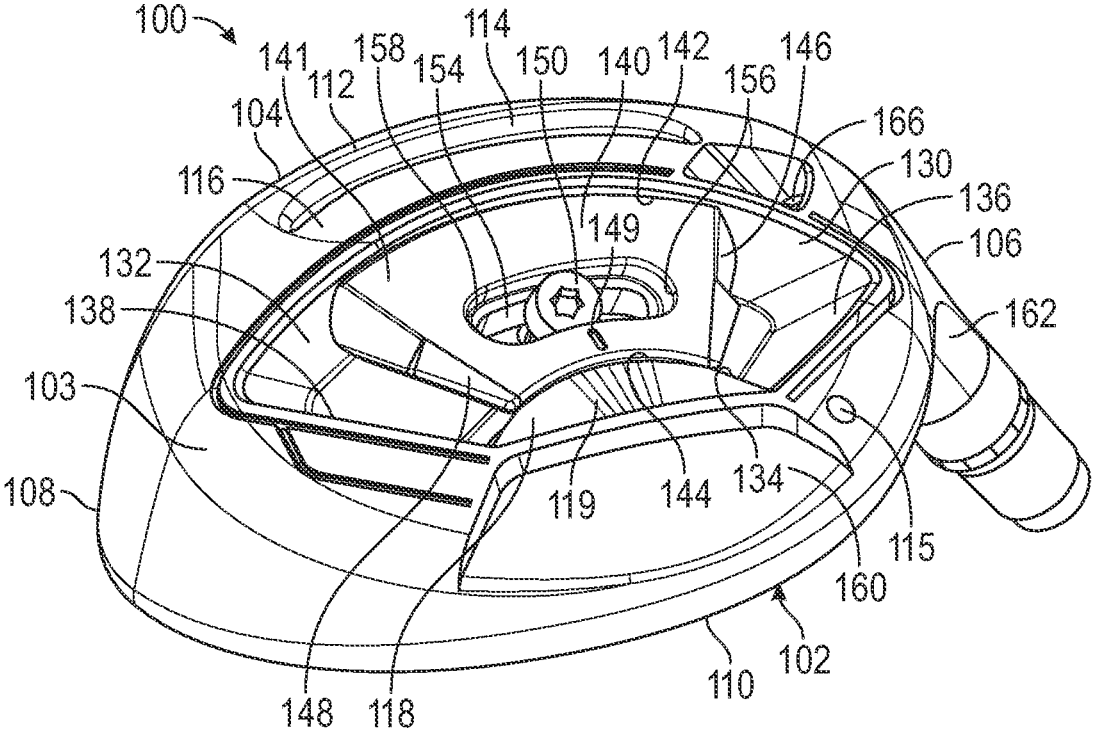
FIG. 2A is a bottom rear perspective view of the golf club head of FIG. 1A.

FIGS. 1A-13 illustrate an exemplary golf club head 100 that embodies certain inventive technologies disclosed herein. This exemplary embodiment of a golf club head provides increased COR by increasing or enhancing the perimeter flexibility of a face plate 111 of the golf club without necessarily increasing the height or decreasing the thickness of the face plate 111. Additionally, it improves BP Up by positioning a significant amount of discretionary mass low and forward of the club head's center of gravity. For example, FIG. 2A is a bottom perspective view of a golf club head 100 having a high COR. The golf club head 100 comprises a body 102 having a hosel 162 (best illustrated in FIGS. 1, 12, and 13), in which a golf club shaft may be inserted and secured to the golf club head 100. A weight member 140 may be at least partially secured within a weight channel 130 and secured with a fastener 150 as further described below. The golf club head 100 defines a front end or face 104, an opposed rear end 110, heel side 106, toe side 108, lower side or sole 103, and upper side or crown 109 (all embodiments disclosed herein share similar directional references).

The front end 104 includes a face plate 111 (FIG. 1A) for striking a golf ball, which may be an integral part of the body 102 (e.g., the body 102 and face plate 111 may be cast as a single part), or may comprise a separate insert. For embodiments where the face plate is not integral to the body 102, the front end 104 can include a face opening (not shown) to receive a face plate 111 that is attached to the body by welding, braising, soldering, screws or other fastening means.

Figure 11:
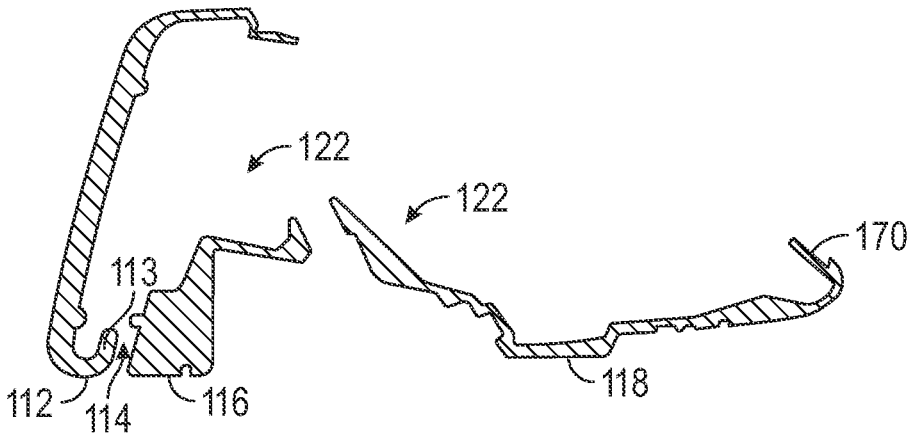
FIG. 11 is a cross-section of the golf club head of FIG. 10, taken along line 11-11 in FIG. 10.

Near the face plate 111, a front channel 114 is formed in the sole 103. As illustrated in FIG. 11, the front channel 114 extends between a lip 113 formed below or behind the front ground contact surface 112 and the intermediate ground contact surface 116 into an interior cavity 122 of the golf club head 100. In some embodiments (not shown), the front channel 114 may comprise a slot that is raised up from the sole 103, but does not extend fully into the interior cavity 122. In some embodiments, the slot or channel may be provided with a slot or channel insert (not shown) to prevent dirt, grass, or other elements from entering the interior cavity 122 of the body 102 or from getting lodged in the slot or channel. The front channel 114 extends in a toe-heel direction across the sole, with a heelward end near the hosel 162 and an opposite toeward end. The front channel can improve coefficient of restitution across the striking face and can provide increased forgiveness on off-center ball strikes. For example, the presence of the front channel can expand zones of the highest COR across the face of the club, particularly at the bottom of the club face near the channel, so that a larger fraction of the face area has a COR above a desired value, especially at the lower regions of the face. More information regarding the construction and performance benefits of the front channel 114 and similar front channels can be found in U.S. Pat. Nos. 8,870,678; 9,707,457; and 9,700,763, and U.S. Patent Pub. No. 2016/0023063 A1, all of which are incorporated by reference herein in their entireties, and various of the other publications that are incorporated by reference herein.

Figure 4:
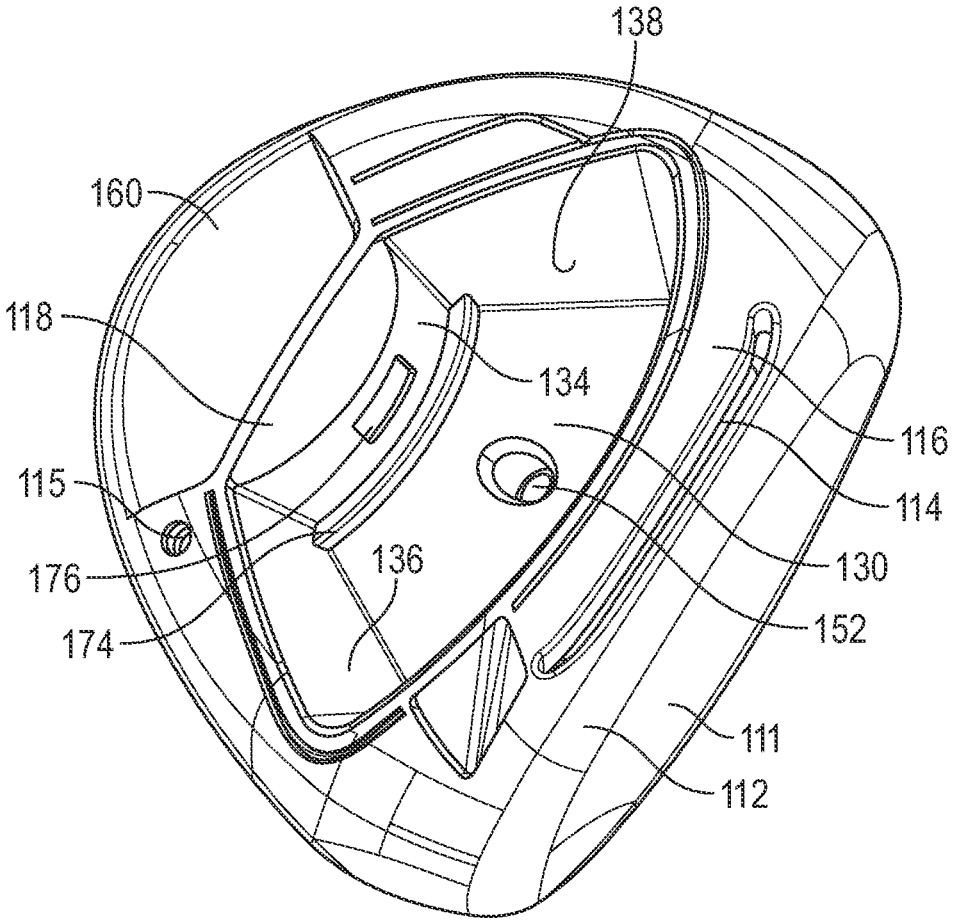
FIG. 4 is a bottom perspective view of the golf club head of FIG. 1A, with a weight member removed.

As best illustrated in FIG. 4, a weight channel 130 is separated from and positioned rearward of the front channel 114 in a forward portion of the golf club head. The weight channel 130 is further described below. The body 102 can include a front ground contact surface 112 on the body forward of the front channel 114 adjacent the bottom of the face plate 111. The body can also have an intermediate ground contact surface, or sit pad, 116 rearward of the front channel 114. The intermediate ground contact surface 116 can have an elevation and curvature congruent with that of the front ground contact surface 112. Some embodiments may not include a front channel or slot in which case the intermediate ground contact surface may extend to the bottom of the face plate 111, thereby providing addition potential contact surface area. The body 102 can further comprise a downwardly extending rear sole surface 118 that extends around at least a portion of the perimeter of the rear end 110 of the body. The rear sole surface may comprise one or more visual markings 119 that may correspond to a visual weight position indicator 149 on a weight member 140 that may be positioned within weight channel 130. In some embodiments, the rear sole surface 118 can act as a ground contact or sit pad as well, having a curvature and elevation congruent with that of the front ground contact surface 112 and the intermediate ground contact surface 116.

The body 102 can further include a raised sole portion 160 that is recessed up from the rear sole surface 118. The raised sole portion 160 can span over any portion of the sole 103, and in the illustrated embodiment the raised sole portion 160 spans over most of the rearward portion of the sole. The sole 103 can include a sloped transition portion where the intermediate ground contact surface 116 transitions up to the raised sole portion 160. The sole can also include other similar sloped portions (not shown), such as around the boundary of the raised sole portion 160. In some embodiments (not shown), one or more cantilevered ribs or struts can be included on the sole that span from the sloped transition portion to the raised sole portion 160, to provide increased stiffness and rigidity to the sole.

The raised sole portion 160 can optionally include grooves, channels, ridges, or other surface features that increase its rigidity. Similarly, the intermediate ground contact surface 116 can include stiffening surface features, such as ridges, though grooves or other stiffening features can be substituted for the ridges.

A sole such as the sole 103 of the golf club head 100 may be referred to as a two-tier construction, bi-level construction, raised sole construction, or dropped sole construction, in which one portion of the sole is raised or recessed relative to the other portion of the sole. The terms raised, lowered, recessed, dropped, etc. are relative terms depending on perspective. For example, the intermediate ground contact surface 116 could be considered "raised" relative to the raised sole portion 160 and the weight channel 130 when the head is upside down with the sole facing upwardly as in FIG. 2A. On the other hand, the intermediate ground contact surface 116 portion can also be considered a "dropped sole" part of the sole, since it is located closer to the ground relative to the raised sole portion 160 and the weight channel 130 when the golf club head is in a normal address position with the sole facing the ground.

Additional disclosure regarding the use of recessed or dropped soles is provided in U.S. Provisional Patent Application No. 62/515,401, filed on Jun. 5, 2017, the entire contents of which are incorporated herein by reference.

The raised sole constructions described herein and in the incorporated references are counterintuitive because the raised portion of the sole tends to raise the Iyy position, which is sometimes considered disadvantageous. However, the raised sole portion 160 (and other raised sole portions disclosed herein) allows for a smaller radius of curvature for that portion of the sole (compared to a conventional sole without the raised sole portion) resulting in increased rigidity and better acoustic properties due to the increased stiffness from the geometry. This stiffness increase means fewer ribs or even no ribs are needed in that portion of the sole to achieve a desired first mode frequency, such as 3000 Hz or above, 3200 Hz or above, or even 3400 Hz or above. Fewer ribs provide a mass/weight savings, which allows for more discretionary mass that can be strategically placed elsewhere in the golf club head or incorporated into user adjustable movable weights.

Furthermore, sloped transition portions around the raised sole portion 160, as well as optional grooves and ridges associated therewith can provide additional structural support and additional rigidity for the golf club head, and can also modify and even fine tune the acoustic properties of the golf club head. The sound and modal frequencies emitted by the golf club head when it strikes a golf ball are very important to the sensory experience of a golfer and provide functional feedback as to where the ball impact occurs on the face (and whether the ball is well struck).

In some embodiments, the raised sole portion 160 can be made of a relatively thinner and/or less dense material compared to other portions of the sole and body that take more stress, such as the ground contact surfaces 112, 116, 118, the face region, and the hosel region. By reducing the mass of the raised sole portion 160, the higher CG effect of raising that portion of the sole is mitigated while maintaining a stronger, heavier material on other portions of the sole and body to promote a lower CG and provide added strength in the area of the sole and body where it is most needed (e.g., in a sole region proximate to the hosel and around the face and shaft connection components where stress is higher).

Figure 10:
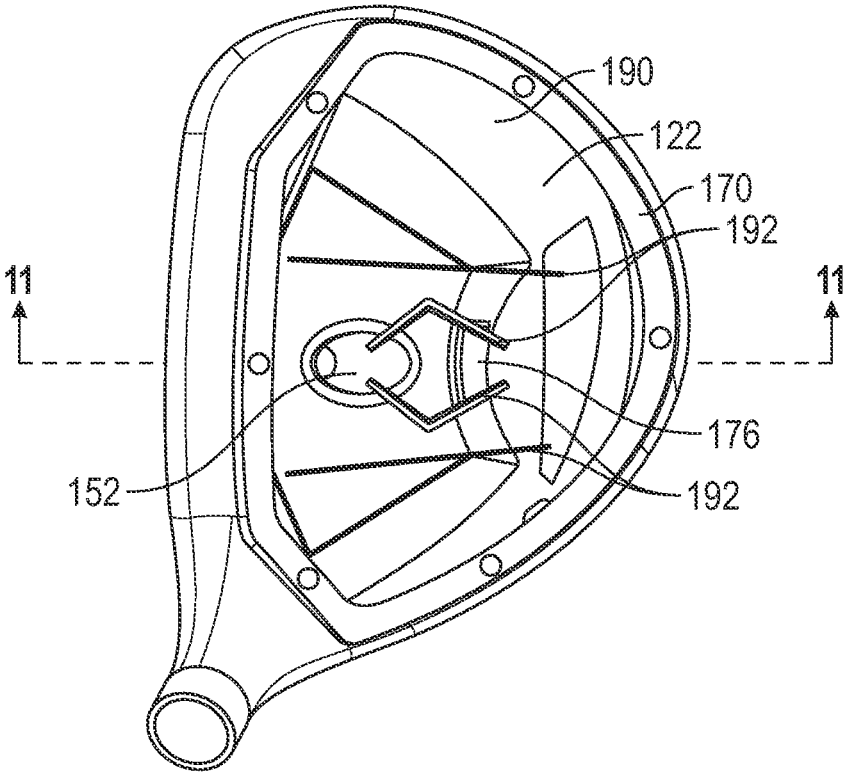
FIG. 10 is a top view of the golf club head of FIG. 1A, with the crown insert removed.

The body 102 can also include one or more internal ribs, such as ribs 192, as best shown in FIG. 10, that are integrally formed with or attached to the inner surfaces of the body. Such ribs can vary in size, shape, location, number and stiffness, and can be used strategically to reinforce or stiffen designated areas of the body's interior and/or fine tune acoustic properties of the golf club head.

Generally, the center of gravity (CG) of a golf club head is the average location of the weight of the golf club head or the point at which the entire weight of the golf club-head may be considered as concentrated so that if supported at this point the head would remain in equilibrium in any position. A golf club head origin coordinate system can be defined such that the location of various features of the golf club head, including the CG, can be determined with respect to a golf club head origin positioned at the geometric center of the striking surface and when the club-head is at the normal address position (i.e., the club-head position wherein a vector normal to the club face substantially lies in a first vertical plane perpendicular to the ground plane, the centerline axis of the club shaft substantially lies in a second substantially vertical plane, and the first vertical plane and the second substantially vertical plane substantially perpendicularly intersect).

The head origin coordinate system defined with respect to the head origin includes three axes: a head origin z-axis (or simply "z-axis") extending through the head origin in a generally vertical direction relative to the ground; a head origin x-axis (or simply "x-axis") extending through the head origin in a toe-to-heel direction generally parallel to the striking surface (e.g., generally tangential to the striking surface at the center) and generally perpendicular to the z-axis; and a head origin y-axis (or simply "y-axis") extending through the head origin in a front-to-back direction and generally perpendicular to the x-axis and to the z-axis. The x-axis and the y-axis both extend in generally horizontal directions relative to the ground when the golf club head is at the normal address position. The x-axis extends in a positive direction from the origin towards the heel of the golf club head. The y axis extends in a positive direction from the head origin towards the rear portion of the golf club head. The z-axis extends in a positive direction from the origin towards the crown. Thus for example, and using millimeters as the unit of measure, a CG that is located 3.2 mm from the head origin toward the toe of the golf club head along the x-axis, 36.7 mm from the head origin toward the rear of the clubhead along the y-axis, and 4.1 mm from the head origin toward the sole of the golf club head along the z-axis can be defined as having a CGx of −3.2 mm, a CGy of +36.7 mm, and a CGz of −4.1 mm.

Further as used herein, Delta 1 is a measure of how far rearward in the golf club head body the CG is located. More specifically, Delta 1 is the distance between the CG and the hosel axis along the y axis (in the direction straight toward the back of the body of the golf club face from the geometric center of the striking face). It has been observed that smaller values of Delta 1 result in lower projected CGs on the golf club head face. Thus, for embodiments of the disclosed golf club heads in which the projected CG on the ball striking club face is lower than the geometric center, reducing Delta 1 can lower the projected CG and increase the distance between the geometric center and the projected CG. Note also that a lower projected CG can promote a higher launch and a reduction in backspin due to the z-axis gear effect. Thus, for particular embodiments of the disclosed golf club heads, in some cases the Delta 1 values are relatively low, thereby reducing the amount of backspin on the golf ball helping the golf ball obtain the desired high launch, low spin trajectory.

Similarly, Delta 2 is the distance between the CG and the hosel axis along the x axis (in the direction straight toward the back of the body of the golf club face from the geometric center of the striking face).

Adjusting the location of the discretionary mass in a golf club head as described herein can provide the desired Delta 1 value. For instance, Delta 1 can be manipulated by varying the mass in front of the CG (closer to the face) with respect to the mass behind the CG. That is, by increasing the mass behind the CG with respect to the mass in front of the CG, Delta 1 can be increased. In a similar manner, by increasing the mass in front of the CG with the respect to the mass behind the CG, Delta 1 can be decreased.

In addition to the position of the CG of a club-head with respect to the head origin another important property of a golf club-head is the projected CG point, e.g., projected CG point 255 discussed above. This projected CG point (also referred to as "CG Proj") can also be referred to as the "zero-torque" point because it indicates the point on the ball striking club face that is centered with the CG. Thus, if a golf ball makes contact with the club face at the projected CG point, the golf club head will not twist about any axis of rotation since no torque is produced by the impact of the golf ball. A negative number for this property indicates that the projected CG point is below the geometric center of the face. So, in the exemplary golf club head illustrated in FIG. 1B, because the projected CG point 255 is located below the geometric center 105 of the golf club head 100 on the club face 111, this property would be expected to have a negative value. As discussed above, this point can also be measured using a value (BP Up) that measures the distance of the CG point 255 from the ground plane 210.

In terms of the MOI of the club-head (i.e., a resistance to twisting) it is typically measured about each of the three main axes of a club-head with the CG as the origin of the coordinate system. These three axes include a CG z-axis extending through the CG in a generally vertical direction relative to the ground when the golf club head is at normal address position; a CG x-axis extending through the CG origin in a toe-to-heel direction generally parallel to the striking surface (e.g., generally tangential to the striking surface at the club face center), and generally perpendicular to the CG z-axis; and a CG y-axis extending through the CG origin in a front-to-back direction and generally perpendicular to the CG x-axis and to the CG z-axis. The CG x-axis and the CG y-axis both extend in generally horizontal directions relative to the ground when the golf club head is at normal address position. The CG x-axis extends in a positive direction from the CG origin to the heel of the golf club head. The CG y-axis extends in a positive direction from the CG origin towards the rear portion of the golf club head. The CG z-axis extends in a positive direction from the CG origin towards the crown. Thus, the axes of the CG origin coordinate system are parallel to corresponding axes of the head origin coordinate system. In particular, the CG z-axis is parallel to the z-axis, the CG x-axis is parallel to the x-axis, and CG y-axis is parallel to the y-axis.

Specifically, a golf club head has a moment of inertia about the vertical CG z-axis ("Izz"), a moment of inertia about the heel/toe CG x-axis ("lxx"), and a moment of inertia about the front/back CG y-axis ("Iyy"). Typically, however, the MOI about the CG z-axis (Izz) and the CG x-axis (Ixx) is most relevant to golf club head forgiveness.

A moment of inertia about the golf club head CG x-axis (Ixx) is calculated by the following Equation 1:

$$Ixx=\int(y^2+z^2)dm \quad (1)$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis and the golf club head CG z-axis. The CG xy-plane is a plane defined by the golf club head CGx-axis and the golf club head CG y-axis.

Similarly, a moment of inertia about the golf club head CG z-axis (Izz) is calculated by the following Equation 2:

$$Izz=\int(x^2+y^2)dm \quad (2)$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG y-axis and the golf club head CG z-axis.

A further description of the coordinate systems for determining CG positions and MOI can be found in U.S. Pat. No. 9,358,430, the entire contents of which are incorporated by reference herein.

An alternative, above ground, club head coordinate system places the head origin at the intersection of the z-axis and the ground plane, providing positive z-axis coordinates for every club head feature. As used herein, "Zup" means the CG z-axis location determined according to this above ground coordinate system. Zup generally refers to the height of the CG above the ground plane 210 as measured along the z-axis, which is illustrated, e.g., by Zup line 232 extending from the CG 230 illustrated in FIG. 1B.

As described herein, desired golf club head mass moments of inertia, golf club head center-of-gravity locations, and other mass properties of a golf club head can be attained by distributing golf club head mass to particular locations. Discretionary mass generally refers to the mass of material that can be removed from various structures providing mass that can be distributed elsewhere for tuning one or more mass moments of inertia and/or locating the golf club head center-of-gravity.

Golf club head walls provide one source of discretionary mass. In other words, a reduction in wall thickness reduces the wall mass and provides mass that can be distributed elsewhere. Thin walls, particularly a thin crown 109, provide significant discretionary mass compared to conventional golf club heads. For example, a golf club head made from an alloy of steel can achieve about 4 grams of discretionary mass for each 0.1 mm reduction in average crown thickness. Similarly, a golf club head made from an alloy of titanium can achieve about 2.5 grams of discretionary mass for each 0.1 mm reduction in average crown thickness. Discretionary mass achieved using a thin crown, e.g., less than about 0.65 mm, can be used to tune one or more mass moments of inertia and/or center-of-gravity location.

To achieve a thin wall on the golf club head body 102, such as a thin crown 109, a golf club head body 102 can be formed from an alloy of steel or an alloy of titanium. For further details concerning titanium casting, please refer to U.S. Pat. No. 7,513,296, incorporated herein by reference.

Additionally, the thickness of the hosel 162 may be varied to provide for additional discretionary mass, as described in U.S. Pat. No. 9,731,176, the entire contents of which are hereby incorporated by reference.

Various approaches can be used for positioning discretionary mass within a golf club head. For example, golf club heads may have one or more integral mass pads (not shown in the illustrated embodiments) cast into the head at predetermined locations that can be used to lower, to move forward, to move rearward, or otherwise to adjust the location of the golf club head's center-of-gravity, as further described herein. Also, epoxy can be added to the interior of the golf club head, such as through an epoxy port 115 (illustrated in FIGS. 1 and 8) in the golf club head to obtain a desired weight distribution. Alternatively, weights formed of high-density materials can be attached to the sole or other parts of a golf club head, as further described, for example, in co-pending U.S. patent application Ser. No. 15/859,071, the entire contents of which are hereby incorporated by reference. With such methods of distributing the discretionary mass, installation is critical because the golf club head endures significant loads during impact with a golf ball that can dislodge the weight. Accordingly, such weights are usually permanently attached to the golf club head and are limited to a fixed total mass, which of course, permanently fixes the golf club head's center-of-gravity and moments of inertia.

Alternatively, weights can be attached in a manner which allows adjustment of certain mass properties of the golf club head. For example, FIG. 2A illustrates positioning a weight member 140 within a weight channel 130, as further described below.

Figure 2B:
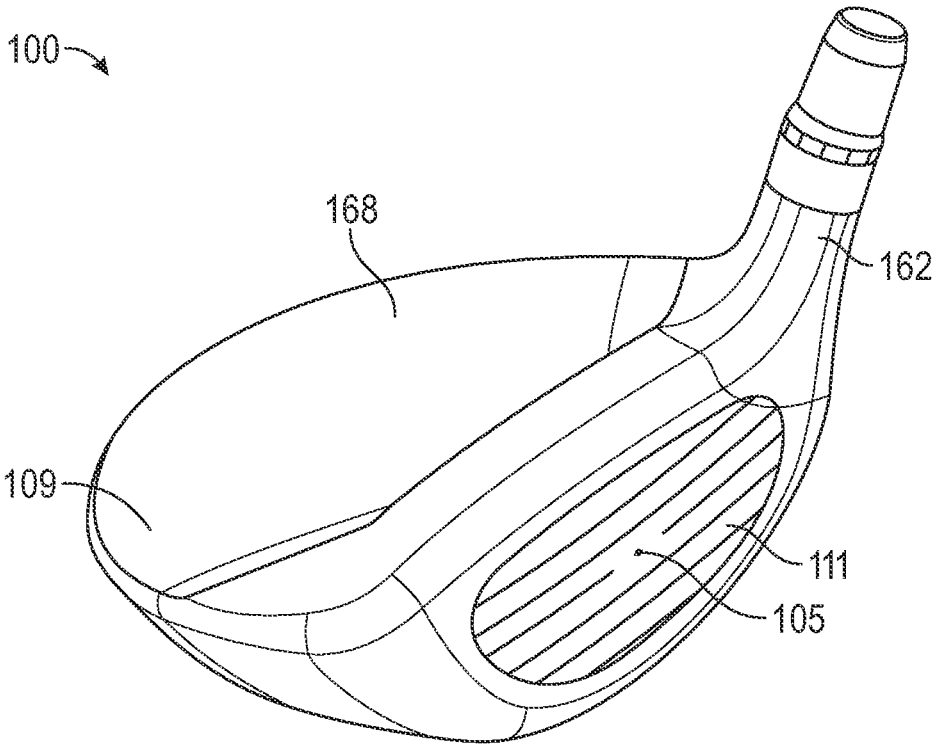
FIG. 2B is a front perspective view of the golf club head of FIG. 1A.

As shown in FIG. 2B, the golf club head 100 can optionally include a separate crown insert 168 that is secured to the body 102, such as by applying a layer of epoxy adhesive 167 or other securement means, such as bolts, rivets, snap fit, other adhesives, or other joining methods or any combination thereof, to cover a large opening 190 (illustrated in FIG. 10) at the top and rear of the body, forming part of the crown 109 of the golf club head. The crown insert 168 covers a substantial portion of the crown's surface area as, for example, at least 30%, at least 40%, at least 50%, at least 60%, at least 70% or at least 80% of the crown's surface area. The crown's outer boundary generally terminates where the crown surface undergoes a significant change in radius of curvature, e.g., near where the crown transitions to the golf club head's sole 103, hosel 162, and front end 104.

As best illustrated in FIG. 10, the crown can be formed to have a recessed peripheral ledge or seat 170 to receive the crown insert 168, such that the crown insert is either flush with the adjacent surfaces of the body to provide a smooth seamless outer surface or, alternatively, slightly recessed below the body surfaces. The front of the crown insert 168 can join with a front portion of the crown 109 on the body to form a continuous, arched crown extend forward to the face. A forwardmost portion of the recessed ledge can extend forward of a rearward-most portion of the hosel such that a first distance to the rearward-most portion of the hosel is greater than a second distance to the forwardmost portion of the recessed ledge as measured relative to the y-axis. The crown insert 168 can comprise any suitable material (e.g., lightweight composite and/or polymeric materials including fiber reinforced polymeric materials all of which typically have a density ranging between about 1 g/cc and 2 g/cc, preferably between 1.3 g/cc and 1.7 g/cc) and can be attached to the body in any suitable manner, as described in more detail elsewhere herein.

A wood-type golf club head, such as golf club head 100 and the other wood-type club heads disclosed herein have a volume, typically measured in cubic-centimeters ($cm^3$) equal to the volumetric displacement of the club head, assuming any apertures are sealed by a substantially planar surface. (See United States Golf Association "Procedure for Measuring the Club Head Size of Wood Clubs," Revision 1.0, Nov. 21, 2003). In other words, for a golf club head with one or more weight ports within the head, it is assumed that the weight ports are either not present or are "covered" by regular, imaginary surfaces, such that the club head volume is not affected by the presence or absence of ports.

In some embodiments, as in the case of a fairway wood (as illustrated), the golf club head may have a volume between about 100 $cm^3$ and about 300 $cm^3$, such as between about 150 $cm^3$ and about 250 $cm^3$, or between about 130 $cm^3$ and about 190 $cm^3$, or between about 125 $cm^3$ and about 240 $cm^3$, and a total mass between about 125 g and about 260 g, or between about 200 g and about 250 g. In the case of a utility or hybrid club (analogous to the illustrated embodiments), the golf club head may have a volume between about 60 $cm^3$ and about 150 $cm^3$, or between about 85 $cm^3$ and about 120 $cm^3$, and a total mass between about 125 g and about 280 g, or between about 200 g and about 250 g. In the case of a driver (analogous to the illustrated embodiments), any of the disclosed golf club heads can have a volume between about 300 $cm^3$ and about 600 $cm^3$, between about 350 $cm^3$ and about 600 $cm^3$, and/or between about 350 $cm^3$ and about 500 $cm^3$, and can have a total mass between about 145 g and about 260 g, such as between about 195 g and about 205 g.

In some of the embodiments described herein, a comparatively forgiving golf club head for a fairway wood can combine an overall golf club head height ($H_{ch}$)—illustrated in FIG. 1B as the distance 280 from a ground plane 210 to a parallel height plane 270 at a crown 109 of the golf club head 100—of less than about 46 mm and an above ground balance point (BP Up) between 10 and 25 mm, such as a BP Up of less than about 23 mm. Some examples of the golf club head provide a BP Up less than about 22 mm, less than about 21 mm, or less than about 20 mm. In some of these golf club heads, Zup may be between 10 and 20 mm, such as less than 17 mm, less than 16 mm, less than 15 mm, or less than 14 mm. Some examples of the golf club head provide a first crown height at a face-to-crown transition region where the face connects to the crown near a front end of the body, a second crown height at a crown-to-skirt transition region where the crown connects to a skirt of the golf club head near a rear end of the body, and a third crown height located rearward of the first crown height and forward of the second crown height and the third crown height is greater than both the first and second crown heights.

The crown insert 168, disclosed in various embodiments herein, can help overcome manufacturing challenges associated with conventional golf club heads having normal continuous crowns made of titanium or other metals, and can replace a relatively heavy component of the crown with a lighter material, freeing up discretionary mass which can be strategically allocated elsewhere within the golf club head. In certain embodiments, the crown may comprise a composite material, such as those described herein and in the incorporated disclosures, such as a composite material having a density of less than 2 grams per cubic centimeter. In still further embodiments, the material has a density of no more than 1.5 grams per cubic centimeter, or a density between 1 gram per cubic centimeter and 2 grams per cubic centimeter. Providing a lighter crown further provides the golf club head with additional discretionary mass, which can be used elsewhere within the golf club head to serve the purposes of the designer. For example, with the discretionary mass, additional ribs 192 can be strategically added to the hollow interior of the golf club head and thereby improve the acoustic properties of the head. Discretionary mass in the form of ribs, mass pads or other features also can be strategically located in the interior, or even on the exterior of the golf club head to shift the effective CG fore or aft, toeward or heelward or both (apart from any further CG adjustments made possible by adjustable weight features) or to improve desirable MOI characteristics, as further described herein.

Methods of making any of the golf club heads disclosed herein, or associated golf clubs, may include one or more of the following steps:

- forming a frame having a sole opening, forming a composite laminate sole insert, injection molding a thermoplastic composite head component over the sole insert to create a sole insert unit, and joining the sole insert unit to the frame, as described in more detail in the incorporated U.S. Provisional Patent Application No. 62/440,886;
- providing a composite head component which is a weight track capable of supporting one or more slidable weights;
- forming the sole insert and/or crown insert from a thermoplastic composite material having a matrix compatible for bonding with the weight track;
- forming the sole insert and/or crown insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof, wherein the sole insert is formed from a composite material having a density of less than 2 grams per cubic centimeter. In still further embodiments, the material has a density of less than 1.5 grams per cubic centimeter, or a density between 1 gram per cubic centimeter and 2 grams per cubic centimeter and the sole insert has a thickness of from about 0.195 mm to about 0.9 mm, preferably from about 0.25 mm to about 0.75 mm, more preferably from about 0.3 mm to about 0.65 mm, even more preferably from about 0.36 mm to about 0.56 mm;

forming both the sole insert and/or crown insert and weight track from thermoplastic composite materials having a compatible matrix;

forming the sole insert and/or crown insert from a thermosetting material, coating the sole insert with a heat activated adhesive, and forming the weight track from a thermoplastic material capable of being injection molded over the sole insert after the coating step;

forming the frame from a material selected from the group consisting of titanium, one or more titanium alloys, aluminum, one or more aluminum alloys, steel, one or more steel alloys, and any combination thereof;

forming the frame with a crown opening, forming a crown insert from a composite laminate material, and joining the crown insert to the frame such that the crown insert overlies the crown opening;

selecting a composite head component from the group consisting of one or more ribs to reinforce the head, one or more ribs to tune acoustic properties of the head, one or more weight ports to receive a fixed weight in a sole portion of the club head, one or more weight tracks to receive a slidable weight, and combinations thereof;

forming the sole insert and crown insert from a continuous carbon fiber composite material;

forming the sole insert and crown insert by thermosetting using materials suitable for thermosetting, and coating the sole insert with a heat activated adhesive;

forming the frame from titanium, titanium alloy or a combination thereof and has a crown opening, and the sole insert and weight track are each formed from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof;

forming the frame with a crown opening, forming a crown insert from a thermoplastic composite material, and joining the crown insert to the frame such that it overlies the crown opening; and providing a crown to sole stiffening member, as described in more detail in U.S. Pat. No. 9,693,291, the entire contents of which is hereby incorporated by reference in its entirety.

The bodies of the golf club heads disclosed herein, and optionally other components of the club heads as well, serve as frames and may be made from a variety of different types of suitable materials. In some embodiments, for example, the body and/or other head components can be made of a metal material such as steel and steel alloys, a titanium or titanium alloy (including but not limited to 6-4 titanium, 3-2.5, 6-4, SP700, 15-3-3-3, 10-2-3, or other alpha/near alpha, alpha-beta, and beta/near beta titanium alloys), or aluminum and aluminum alloys (including but not limited to 3000 series alloys, 5000 series alloys, 6000 series alloys, such as 6061-T6, and 7000 series alloys, such as 7075). The body may be formed by conventional casting, metal stamping or other known processes. The body also may be made of other metals as well as non-metals. The body can provide a framework or skeleton for the club head to strengthen the club head in areas of high stress caused by the golf ball's impact with the face, such as the transition region where the club head transitions from the face to the crown area, sole area and skirt area located between the sole and crown areas.

In some embodiments, the sole insert and/or crown insert of the club head may be made from a variety of composite materials and/or polymeric materials, such as from a thermoplastic material, preferably from a thermoplastic composite laminate material, and most preferably from a thermoplastic carbon composite laminate material. For example, the composite material may comprise an injection moldable material, thermoformable material, thermoset composite material or other composite material suitable for golf club head applications. One exemplary material is a thermoplastic continuous carbon fiber composite laminate material having long, aligned carbon fibers in a PPS (polyphenylene sulfide) matrix or base. One commercial example of this type of material, which is manufactured in sheet form, is TEPEX® DYNALITE 207 manufactured by Lanxess.

TEPEX® DYNALITE 207 is a high strength, lightweight material having multiple layers of continuous carbon fiber reinforcement in a PPS thermoplastic matrix or polymer to embed the fibers. The material may have a 54% fiber volume but other volumes (such as a volume of 42% to 57%) will suffice. The material weighs about 200 g/m$^2$.

Another similar exemplary material which may be used for the crown insert and/or sole insert is TEPEX® DYNALITE 208. This material also has a carbon fiber volume range of 42% to 57%, including a 45% volume in one example, and a weight of 200 g/m$^2$. DYNALITE 208 differs from DYNALITE 207 in that it has a TPU (thermoplastic polyurethane) matrix or base rather than a polyphenylene sulfide (PPS) matrix.

By way of example, the TEPEX® DYNALITE 207 sheet(s) (or other selected material such as DYNALITE 208) are oriented in different directions, placed in a two-piece (male/female) matched die, heated past the melt temperature, and formed to shape when the die is closed. This process may be referred to as thermoforming and is especially well-suited for forming sole and crown inserts.

Once the crown insert and/or sole insert are formed (separately) by the thermoforming process just described, each is cooled and removed from the matched die. The sole and crown inserts are shown as having a uniform thickness, which lends itself well to the thermoforming process and ease of manufacture. However, the sole and crown inserts may have a variable thickness to strengthen select local areas of the insert by, for example, adding additional plies in select areas to enhance durability, acoustic or other properties in those areas.

A crown insert and/or sole insert can have a complex three-dimensional curvature corresponding generally to the crown and sole shapes of a fairway wood-type club head and specifically to the design specifications and dimensions of the particular head designed by the manufacturer. It will be appreciated that other types of club heads, such as drivers, utility clubs (also known as hybrid clubs), rescue clubs, and the like may be manufactured using one or more of the principles, methods and materials described herein.

In an alternative embodiment, the sole insert and/or crown insert can be made by a process other than thermoforming, such as injection molding or thermosetting. In a thermoset process, the sole insert and/or crown insert may be made from prepreg plies of woven or unidirectional composite fiber fabric (such as carbon fiber) that is preimpregnated with resin and hardener formulations that activate when heated. The prepreg plies are placed in a mold suitable for a thermosetting process, such as a compression mold, e.g., a metal matched compression mold, or a bladder mold, and stacked/oriented with the carbon or other fibers oriented in different directions. The plies are heated to activate the chemical reaction and form the sole (or crown) insert. Each insert is cooled and removed from its respective mold. Additional disclosure regarding methods of forming sole and/or crown inserts can be found in U.S. Pat. No. 9,579,549, the entire contents of which are incorporated by reference.

The carbon fiber reinforcement material for the thermoset sole/crown insert may be a carbon fiber known as "34-700" fiber, available from Grafil, Inc., of Sacramento, California, which has a tensile modulus of 234 Gpa (34 Msi) and tensile strength of 4500 Mpa (650 Ksi). Another suitable fiber, also available from Grafil, Inc., is a carbon fiber known as "TR50S" fiber which has a tensile modulus of 240 Gpa (35 Msi) and tensile strength of 4900 Mpa (710 Ksi). Exemplary epoxy resins for the prepreg plies used to form the thermoset crown and sole inserts are Newport 301 and 350 and are available from Newport Adhesives & Composites, Inc., of Irvine, California.

In one example, the prepreg sheets have a quasi-isotropic fiber reinforcement of 34-700 fiber having an areal weight of about 70 g/m$^2$ and impregnated with an epoxy resin (e.g., Newport 301), resulting in a resin content (R/C) of about 40%. For convenience of reference, the primary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

Once the sole insert and crown insert are formed, they can be joined to the body in a manner that creates a strong integrated construction adapted to withstand normal stress, loading and wear and tear expected of commercial golf clubs. For example, the sole insert and crown insert each may be bonded to the frame using epoxy adhesive, such as an adhesive applied between an interior surface of each respective insert and a corresponding exterior surface of the body, with the crown insert seated in and overlying the crown opening and the sole insert seated in and overlying the sole opening. Alternatively, a sole insert or crown insert may be attached inside an internal cavity of the body and then subsequently attached by securing an exterior surface of the insert to an interior surface of the body. Alternative attachment methods for bonding an insert to either an internal or an external surface of the body include bolts, rivets, snap fit, adhesives, other known joining methods or any combination thereof.

Exemplary polymers for the embodiments described herein may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which are hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyetherimides, and the polyamide-imides. Of these, the most preferred are the polysufones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-$SO_2$-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

Three commercially significant polysulfones are:

polysulfone (PSU);

Polyethersulfone (PES also referred to as PESU); and

Polyphenylene sulfoner (PPSU).

Particularly important and preferred aromatic polysulfones are those comprised of repeating units of the structure —$C_6H_4SO_2$—$C_6H_4$—O— where $C_6H_4$ represents an m- or p-phenylene structure. The polymer chain can also comprise repeating units such as —$C_6H_4$—, $C_6H_4$—O—, —$C_6H_4$-(lower-alkylene)-$C_6H_4$—O—, —$C_6H_4$—O—$C_6H_4$—O—, —$C_6H_4$—S—$C_6H_4$—O— and other thermally stable substantially-aromatic difunctional groups known in the art of engineering thermoplastics. Also included are the so called modified polysulfones where the individual aromatic rings are further substituted in one or substituents including

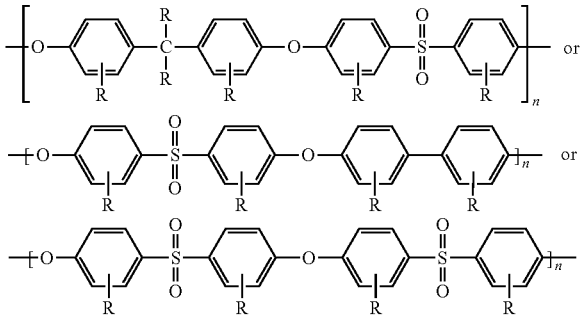

wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a $C_1$-$C_{20}$ alkyl group, a $C_2$-$C_{20}$ alkenyl group, a $C_3$-$C_{20}$ cycloalkyl group, a $C_3$-$C_{20}$ cycloalkenyl group, and a $C_6$-$C_{20}$ aromatic hydrocarbon group. These hydrocarbon groups may be partly substituted by a halogen atom or atoms, or may be partly substituted by a polar group or groups other than the halogen atom or atoms. As specific examples of the $C_1$-$C_{20}$ alkyl group, there can be mentioned methyl, ethyl, propyl, isopropyl, amyl, hexyl, octyl, decyl and dodecyl groups. As specific examples of the $C_2$-$C_{20}$ alkenyl group, there can be mentioned propenyl, isopropepyl, butenyl, isobutenyl, pentenyl and hexenyl groups. As specific examples of the $C_3$-$C_{20}$ cycloalkyl group, there can be mentionedcyclopentyl and cyclohexyl groups. As specific examples of the $C_3$-$C_{20}$ cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers, include, the polysulfone made by condensation polymerization of bisphenol A and 4,4'-dichlorodiphenyl sulfone in the presence of base, and having the main repeating structure

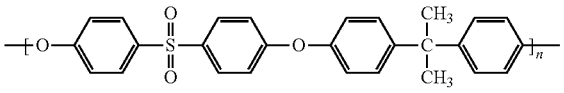

having the abbreviation PSF and sold under the tradenames Udel®, Ultrason® S, Eviva®, RTP PSU, the polysulfone made by condensation polymerization of 4,4'-dihydroxydiphenyl and 4,4'-dichlorodiphenyl sulfone in the presence of base, and having the main repeating structure

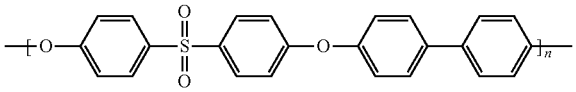

having the abbreviation PPSF and sold under the tradenames RADEL® resin; and a condensation polymer made from 4,4'-dichlorodiphenyl sulfone in the presence of base and having the principle repeating structure

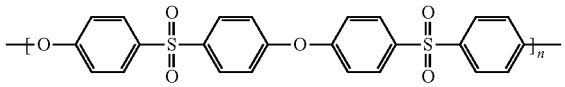

having the abbreviation PPSF and sometimes called a "polyether sulfone" and sold under the tradenames Ultrason® E, LNP™, Veradel®PESU, Sumikaexce, and VICTREX® resin, and any and all combinations thereof.

In some embodiments, a composite material, such as a carbon composite, made of a composite including multiple plies or layers of a fibrous material (e.g., graphite, or carbon fiber including turbostratic or graphitic carbon fiber or a hybrid structure with both graphitic and turbostratic parts present. Examples of some of these composite materials for use in the metalwood golf clubs and their fabrication procedures are described in U.S. Reissue Pat. No. RE41,577; U.S. Pat. Nos. 7,267,620; 7,140,974; 8,096,897; 7,628,712; 7,985,146; 7,874,936; 7,874,937; 8,628,434; and 7,874,938; and U.S. Patent Pub. Nos. 2008/0149267 and 2009/0163289, which are all incorporated herein by reference. The composite material may be manufactured according to the methods described at least in U.S. Patent Pub. No. 2008/0149267, the entire contents of which are herein incorporated by reference.

Alternatively, short or long fiber-reinforced formulations of the previously referenced polymers. Exemplary formulations include a Nylon 6/6 polyamide formulation which is 30% Carbon Fiber Filled and available commercially from RTP Company under the trade name RTP 285. The material has a Tensile Strength of 35000 psi (241 MPa) as measured by ASTM D 638; a Tensile Elongation of 2.0-3.0% as measured by ASTM D 638; a Tensile Modulus of $3.30\times10^6$ psi (22754 MPa) as measured by ASTM D 638; a Flexural Strength of 50000 psi (345 MPa) as measured by ASTM D 790; and a Flexural Modulus of $2.60\times10^6$ psi (17927 MPa) as measured by ASTM D 790.

Also included is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Also included is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

An example is a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Another example is a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Also an option is a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

The foregoing materials are well-suited for composite, polymer and insert components of the embodiments disclosed herein, as distinguished from components which preferably are made of metal or metal alloys.

Additional details regarding providing composite soles and/or crowns and crown layups are provided in U.S. Patent Pub. No. 2016/0001146, the entire contents of which are hereby incorporated by reference.

As described in detail in U.S. Pat. No. 6,623,378, filed Jun. 11, 2001, entitled "METHOD FOR MANUFACTURING AND GOLF CLUB HEAD" and incorporated by reference herein in its entirety, the crown or outer shell of the golf club head 100 may be made of a composite material, such as, for example, a carbon fiber reinforced epoxy, carbon fiber reinforced polymer, or a polymer. Additionally, U.S. Patent Pub. No. 2004/0116207 and U.S. Pat. No. 6,969,326, also incorporated by reference herein in their entirety, describe golf club heads with lightweight crowns. Furthermore, U.S. patent application Ser. No. 12/974,437 (now U.S. Pat. No. 8,608,591), also incorporated by reference herein in its entirety, describes golf club heads with lightweight crowns and soles.

In some embodiments, composite materials used to construct the crown and/or sole insert should exhibit high strength and rigidity over a broad temperature range as well as good wear and abrasion behavior and be resistant to stress cracking. Such properties include (1) a Tensile Strength at room temperature of from about 7 ksi to about 330 ksi, preferably of from about 8 ksi to about 305 ksi, more preferably of from about 200 ksi to about 300 ksi, even more preferably of from about 250 ksi to about 300 ksi (as measured by ASTM D 638 and/or ASTM D 3039); (2) a Tensile Modulus at room temperature of from about 0.4 Msi to about 23 Msi, preferably of from about 0.46 Msi to about 21 Msi, more preferably of from about 0.46 Msi to about 19 Msi (as measured by ASTM D 638 and/or ASTM D 3039); (3) a Flexural Strength at room temperature of from about 13 ksi to about 300 ksi, from about 14 ksi to about 290 ksi, more preferably of from about 50 ksi to about 285 ksi, even more preferably of from about 100 ksi to about 280 ksi (as measured by ASTM D 790); and (4) a Flexural Modulus at room temperature of from about 0.4 Msi to about 21 Msi, from about 0.5 Msi to about 20 Msi, more preferably of from about 10 Msi to about 19 Msi (as measured by ASTM D 790).

In certain embodiments, composite materials that are useful for making club-head components comprise a fiber portion and a resin portion. In general, the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However, for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superposedly in a "lay-up" manner. After forming the prepreg lay-up, the resin is cured to a rigid condition. If interested a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. FAW is the weight of the fiber portion of a given quantity of prepreg, in units of $g/m^2$. Crown and/or sole panels may be formed of plies of composite material having a fiber areal weight of between 20 $g/m^2$ and 200 $g/m^2$ and a density between about 1 g/cc and 2 g/cc. However, FAW values below 100 $g/m^2$, and more desirably 75 $g/m^2$ or less, can be particularly effective. A particularly suitable fibrous material for use in making prepreg plies is carbon fiber, as noted. More than one fibrous material can be used. In other embodiments, however, prepreg plies having FAW values below 70 $g/m^2$ and above 100 $g/m^2$ may be used. Generally, cost is the primary prohibitive factor in prepreg plies having FAW values below 70 $g/m^2$.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy. An example carbon fiber is "34-700" carbon fiber (available from Grafil, Sacramento, Calif.), having a tensile modulus of 234 Gpa (34 Msi) and a tensile strength of 4500 Mpa (650 Ksi). Another Grafil fiber that can be used is "TR50S" carbon fiber, which has a tensile modulus of 240 Gpa (35 Msi) and a tensile strength of 4900 Mpa (710 ksi). Suitable epoxy resins are types "301" and "350" (available from Newport Adhesives and Composites, Irvine, Calif.). An exemplary resin content (R/C) is between 33% and 40%, preferably between 35% and 40%, more preferably between 36% and 38%.

Some of the embodiments of the golf club head 100 discussed throughout this application may include a separate crown, sole, and/or face that may be a composite, such as, for example, a carbon fiber reinforced epoxy, carbon fiber reinforced polymer, or a polymer crown, sole, and/or face.

Alternatively, the crown, sole, and/or face may be made from a less dense material, such as, for example, Titanium or Aluminum. A portion of the crown may be cast from either steel (~7.8-8.05 g/cm$^3$) or titanium (~4.43 g/cm$^3$) while a majority of the crown may be made from a less dense material, such as for example, a material having a density of about 1.5 g/cm$^3$ or some other material having a density less than about 4.43 g/cm$^3$. In other words, the crown could be some other metal or a composite. Additionally or alternatively, the face may be welded in place rather than cast as part of the sole.

By making the crown, sole, and/or face out of a less dense material, it may allow for weight to be redistributed from the crown, sole, and/or face to other areas of the club head, such as, for example, low and forward and/or low and back. Both low and forward and low and back may be possible for club heads incorporating a front to back sliding weight track.

U.S. Pat. No. 8,163,119 discloses composite articles and methods for making composite articles, which disclosure is incorporated by reference herein in the entirety. U.S. Pat. Nos. 9,452,325 and 7,279,963 disclose various composite crown constructions that may be used for golf club heads, which disclosures are also incorporated by reference herein in their entireties. The techniques and layups described in U.S. Pat. Nos. 8,163,119; 9,452,325; and 7,279,963, incorporated herein by reference in their entirety, may be employed for constructing a composite crown panel, composite sole panel, composite toe panel located on the sole, and/or composite heel panel located on the sole.

U.S. Pat. No. 8,163,119 discloses the usual number of layers for a striking plate is substantial, e.g., fifty or more. However, improvements have been made in the art such that the layers may be decreased to between 30 and 50 layers. Additionally, for a panel located on the sole and/or crown the layers can be substantially decreased down to three, four, five, six, seven, or more layers.

Table 1 below provides examples of possible layups. These layups show possible crown and/or sole construction using unidirectional plies unless noted as woven plies. The construction shown is for a quasi-isotropic layup. A single layer ply has a thickness ranging from about 0.065 mm to about 0.080 mm for a standard FAW of 70 g/m$^2$ with about 36% to about 40% resin content, however the crown and/or sole panels may be formed of plies of composite material having a fiber areal weight of between 20 g/m$^2$ and 200 g/m$^2$. The thickness of each individual ply may be altered by adjusting either the FAW or the resin content, and therefore the thickness of the entire layup may be altered by adjusting these parameters.

TABLE 1

| ply 1 | ply 2 | ply 3 | ply 4 | ply 5 | ply 6 | ply 7 | ply 8 | AW g/m$^2$ |
|---|---|---|---|---|---|---|---|---|
| 0 | −60 | +60 | | | | | | 290-360 |
| 0 | −45 | +45 | 90 | | | | | 390-480 |
| 0 | +60 | 90 | −60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |

TABLE 1-continued

| ply 1 | ply 2 | ply 3 | ply 4 | ply 5 | ply 6 | ply 7 | ply 8 | AW g/m$^2$ |
|---|---|---|---|---|---|---|---|---|
| 0 | 90 | +45 | −45 | 0/90 woven | | | | 490-720 |
| 0 | 90 | +45 | −45 | +45 | 0/90 woven | | | 490-720 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | 45 | 0/90 woven | | | 590-720 |
| 90 | 0 | 45 | −45 | 45 | 90/0 woven | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |
| +45 | −45 | 90 | 0 | 0 | 90 | −45/45 woven | | 680-840 |
| 0 | 90 | 45 | −45 | −45 | 45 | 90 UD | | 680-840 |
| 0 | 90 | 45 | −45 | 0 | −45 | 45 | 0/90 woven | 780-960 |
| 90 | 0 | 45 | −45 | 0 | −45 | 45 | 90/0 woven | 780-960 |

The Area Weight (AW) is calculated by multiplying the density times the thickness. For the plies shown above made from composite material the density is about 1.5 g/cm3 and for titanium the density is about 4.5 g/cm3. Depending on the material used and the number of plies the composite crown and/or sole thickness ranges from about 0.195 mm to about 0.9 mm, preferably from about 0.25 mm to about 0.75 mm, more preferably from about 0.3 mm to about 0.65 mm, even more preferably from about 0.36 mm to about 0.56 mm. It should be understood that although these ranges are given for both the crown and sole together it does not necessarily mean the crown and sole will have the same thickness or be made from the same materials. In certain embodiments, the sole may be made from either a titanium alloy or a steel alloy. Similarly, the main body of the golf club head 100 may be made from either a titanium alloy or a steel alloy. The titanium will typically range from 0.4 mm to about 0.9 mm, preferably from 0.4 mm to about 0.8 mm, more preferably from 0.4 mm to about 0.7 mm, even more preferably from 0.45 mm to about 0.6 mm. In some instances, the crown and/or sole may have non-uniform thickness, such as, for example varying the thickness between about 0.45 mm and about 0.55 mm.

A lot of discretionary mass may be freed up by using composite material in the crown and/or sole especially when combined with thin walled titanium construction (0.4 mm to 0.9 mm) in other parts of the golf club head 10. The thin walled titanium construction increases the manufacturing difficulty and ultimately fewer parts are cast at a time. In the past, 100+ golf club heads could be cast at a single time, however due to the thinner wall construction fewer golf club heads are cast per cluster to achieve the desired combination of high yield and low material usage.

An important strategy for obtaining more discretionary mass is to reduce the wall thickness of the golf club head 10. For a typical titanium-alloy "metal-wood" club-head having a volume of 460 cm3 (i.e., a driver) and a crown area of 100 cm2, the thickness of the crown is typically about 0.8 mm, and the mass of the crown is about 36 g. Thus, reducing the wall thickness by 0.2 mm (e.g., from 1 mm to 0.8 mm) can yield a discretionary mass "savings" of 9.0 g.

The following examples will help to illustrate the possible discretionary mass "savings" by making a composite crown rather than a titanium-alloy crown. For example, reducing the material thickness to about 0.73 mm yields an additional discretionary mass "savings" of about 25.0 g over a 0.8 mm titanium-alloy crown. For example, reducing the material thickness to about 0.73 mm yields an additional discretionary mass "savings" of about 25 g over a 0.8 mm titanium-alloy crown or 34 g over a 1.0 mm titanium-alloy crown. Additionally, a 0.6 mm composite crown yields an additional discretionary mass "savings" of about 27 g over a 0.8 mm titanium-alloy crown. Moreover, a 0.4 mm composite crown yields an additional discretionary mass "savings" of about 30 g over a 0.8 mm titanium-alloy crown. The crown can be made even thinner yet to achieve even greater weight savings, for example, about 0.32 mm thick, about 0.26 mm thick, about 0.195 mm thick. However, the crown thickness must be balanced with the overall durability of the crown during normal use and misuse. For example, an unprotected crown i.e. one without a head cover could potentially be damaged from colliding with other woods or irons in a golf bag.

For example, any of the embodiments disclosed herein may have a crown or sole insert formed of plies of composite material having a fiber areal weight of between 20 g/m$^2$ and 200 g/m$^2$, preferably between 50 g/m$^2$ and 100 g/m$^2$, the weight of the composite crown being at least 20% less than the weight of a similar sized piece formed of the metal of the body. The composite crown may be formed of at least four plies of uni-tape standard modulus graphite, the plies of uni-tape oriented at any combination of 0° (forward to rearward of the club head), +45°, −45° and 90° (heelward to toeward of the golf club head). Additionally or alternatively, the crown may include an outermost layer of a woven graphite cloth. Carbon crown panels or inserts or carbon sole panels as disclosed herein and in the incorporated applications may be utilized with any of the embodiments herein, and may have a thickness between 0.40 mm to 1.0 mm, preferably 0.40 mm to 0.80 mm, more preferably 0.40 mm to 0.65 mm, and a density between 1 gram per cubic centimeter and 2 grams per cubic centimeter, though other thicknesses and densities are also possible.

One potential embodiment of a carbon sole panel that may be utilized with any of the embodiments herein weighs between 1.0 grams and 5.0 grams, such as between 1.25 grams and 2.75 grams, such as between 3.0 grams and 4.5 grams. In other embodiments, the carbon sole panel may weigh less than 3.0 grams, such as less than 2.5 grams, such as less than 2.0 grams, such as less than 1.75 grams. The carbon sole panel may have a surface area of at least 1250 mm$^2$, 1500 mm$^2$, 1750 mm$^2$, or 2000 mm$^2$.

One potential embodiment of a carbon crown panel that may be utilized with any of the embodiments herein weighs between 3.0 grams and 8.0 grams, such as between 3.5 grams and 7.0 grams, such as between 3.5 grams and 7.0 grams. In other embodiments, the carbon crown panel may weigh less than 7.0 grams, such as less than 6.5 grams, such as less than 6.0 grams, such as less than 5.5 grams, such as less than 5.0 grams, such as less than 4.5 grams. The carbon crown panel may have a surface area of at least 3000 mm$^2$, 3500 mm$^2$, 3750 mm$^2$, 4000 mm$^2$.

FIG. 2A illustrates one embodiment of a COR feature in combination with a sliding weight track. Similar features are shown in the other embodiments. While the illustrated embodiments may only have a COR feature and a sliding weight track, other embodiments may have a COR feature, a sliding weight track, and an adjustable loft/lie feature or some other combination of features.

As already discussed, and making reference to the embodiment illustrated in FIG. 2A, the COR feature may have a certain length L (which may be measured as the distance between toeward end and heelward end of the front channel 114), width W (e.g., the measurement from a forward edge to a rearward edge of the front channel 114), and offset distance OS from the front end, or face 104 (e.g., the distance between the face 104 and the forward edge of front channel 114, also shown in FIG. 4 as the width of the front ground contact surface 112 between the face plate 111 and the front channel 114). During development, it was discovered that the COR feature length L and the offset distance OS from the face play an important role in managing the stress which impacts durability, the sound or first mode frequency of the club head, and the COR value of the club head. All of these parameters play an important role in the overall club head performance and user perception.

During development, it was discovered that a ratio of COR feature length to the offset distance may be preferably greater than 4, and even more preferably greater than 5, and most preferably greater than 5.5. However, the ratio of COR feature length to offset distance also has an upper limit and is preferably less than 15, and even more preferably less than 14, and most preferably less than 13.5. For example, for a COR feature length of 30 mm the offset distance from the face would preferably be less than 7.5 mm, and even more preferably 6 mm or less from the face. Additional disclosure about the relationship between COR feature length and offset, and related effects are provided in in co-pending U.S. patent application Ser. No. 15/859,071, the entire contents of which are hereby incorporated by reference.

The offset distance is highly dependent on the slot length. As slot length increases so do the stresses in the club head, as a result the offset distance must be increased to manage stress. Additionally, as slot length increases the first mode frequency is negatively impacted.

Figure 17:
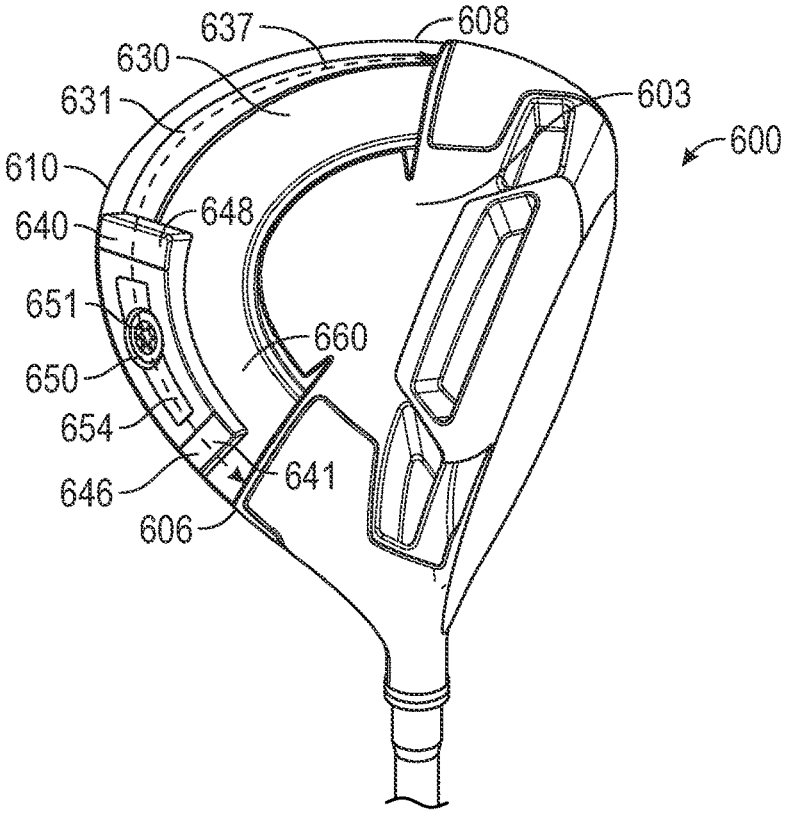
FIG. 17 is a bottom perspective view of another exemplary golf club head disclosed herein.
Figure 18:
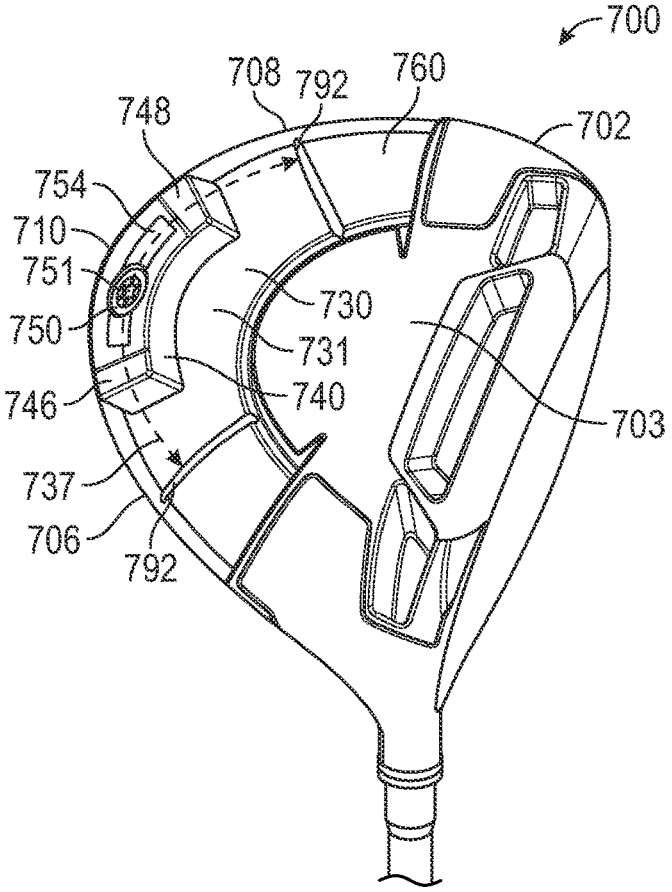
FIG. 18 is a bottom perspective view of another exemplary golf club head disclosed herein.

Exemplary embodiments of the structure of the weight channel 130 are further described herein. As best illustrated in in FIGS. 2A and 3-5B, weight channel 130 may be formed as a curved arc extending in a generally heel-toe direction, which may be bounded by a curved forward edge 132 opposing a curved rearward edge 134. Forward edge 132 may comprise an outer arc of the weight channel 130 that extends at least or (as illustrated) greater than half the width of the golf club head, which the USGA defines in "United States Golf Association and R&A Rules Limited PROCEDURE FOR MEASURING THE CLUB HEAD SIZE OF WOOD CLUBS," USGA-TPX3003, Revision 1.0.0, Nov. 21, 2003, as being measured from the heel of the golf club head to the toe of the golf club head. This length (heel-to-toe) is measured with the head positioned at a 60 degree lie angle. If the outermost point of the heel is not clearly defined, it is deemed to be 0.875 inches above the horizontal plane on which the club is lying. In some embodiments, the forward edge 132 may comprise an outer arc of the weight channel 130 that extends at least or (as illustrated) greater than half the depth of the golf club head, as measured from the face 104 of the golf club head to a trailing edge at the rear end 110 of the golf club head. The weight channel may curve rearwardly away from the face 104 to a heelward end 136 and a toeward end 138, respectively. These ends 136, 138 may be positioned rearward of the forward edge 132 of the weight channel. In certain other embodiments (not shown), the weight channel may extend in a primarily linear direction, such as in a heel-toe direction or in a forward-rearward direction. In still other embodiments, the weight channel may extend in a curved arc along either a toe side or a heel side of the golf club head. While in the examples shown in FIGS. 2-16, the weight channel is shown as being positioned in the forward portion of the golf club head, in other embodiments (as shown in FIGS. 17-18), the weight channel may be positioned in a rearward portion of the golf club head, as further described below.

Figure 3:
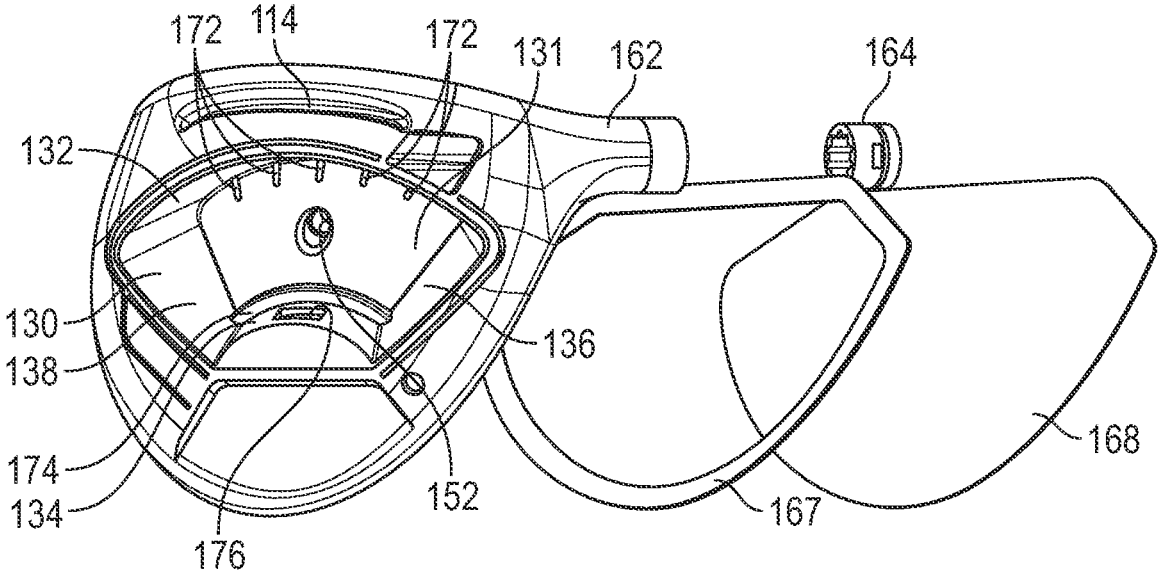
FIG. 3 is an exploded perspective view of the golf club head of FIG. 1A, with a weight member removed.

The rearward edge 134 of the weight channel may drop down to a lower channel surface 131 that is raised up from the sole of the golf club. Lower channel surface 131 may be substantially parallel to, or as illustrated, slightly angled away from the sole 103 of the golf club head, so that the weight channel 130 may be deeper at the forward edge 132 than it is at the rearward edge 134. As illustrated in FIG. 10, one or more cantilevered ribs or struts 192 may be provided within the interior cavity 122 of the golf club head on the underside of the weight channel 130 to support and provide rigidity to the weight channel 130. As illustrated in FIG. 3, projections (such as parallel ribbed projections 172 may be provided on the lower channel surface 131 of the weight channel 130, such as at the forward edge 132, to interact with corresponding ribbed weight projections 182 on a mating surface of the weight member 140 to better hold the weight member 140 in a desired position when a fastener 150 is tightened to secure the weight member 140. A rear weight channel ledge 174 may protrude up and out from the lower channel surface 131 and run parallel to the rearward edge 134 of the weight channel 130, to engage a corresponding recessed ledge portion 184 on a surface of the weight member 140, as further described below. Additionally, an indentation 176 may be formed within the rearward edge 134 of the weight channel 130 and configured for at least partially containing a material for damping the weight member 140. One example of such a material would be a layer of compressible foam, such as PORON® foam, though other materials, such as or a SORBOTHANE®, or PORON®, polyurethane foam material, thermoplastic elastomer or other appropriate damping materials may be used.

In certain embodiments, this compressible material may comprise an elastically compressible material that can be compressed down to, e.g., less than 90% of its original uncompressed thickness, down to less than 50% of its original uncompressed thickness, down to less than 20% of its original uncompressed thickness, or, in particular embodiments, down to less than 10% of its original uncompressed thickness, while typically being able to rebound substantially to its uncompressed thickness upon removal of a compression force. In some embodiments, the material may be compressed down to less than 50% of its original uncompressed thickness when a compression force is applied and rebound to more than 90% of its original uncompressed thickness upon removal of the compression force.

The following table provides examples A-I showing an example initial uncompressed material depth, a final compressed material depth, the delta between the uncompressed and compressed material depths, and the percent the material was compressed. In this example, an uncompressed depth of 1.5 mm is used, however this is purely an example and several other depths could be used for the compressible material within indentation 176, ranging from about 0.25 mm to about 5 mm, preferably from about 0.5 mm to about 3.5 mm, more preferably from about 0.8 mm to about 2.0 mm depending on the application.

TABLE 2

| Example | Uncompressed Height (mm) | Compressed Height (mm) | Delta (mm) | Percent Change |
|---|---|---|---|---|
| A | 1.5 | 0.15 | 1.35 | −90% |
| B | 1.5 | 0.3 | 1.2 | −80% |
| C | 1.5 | 0.45 | 1.05 | −70% |
| D | 1.5 | 0.6 | 0.9 | −60% |
| E | 1.5 | 0.75 | 0.75 | −50% |
| F | 1.5 | 0.9 | 0.6 | −40% |
| G | 1.5 | 1.05 | 0.45 | −30% |
| H | 1.5 | 1.2 | 0.3 | −20% |
| I | 1.5 | 1.35 | 0.15 | −10% |

The percent the material is compressed is calculated by subtracting the initial uncompressed thickness from the final compressed thickness, dividing the result by the initial uncompressed shim thickness, and finally multiplying by 100 percent. See Equation 3 below for further clarification. The equation yields a negative percent change because the shim is being compressed i.e. the final thickness is less than the uncompressed shim thickness.

$$\text{Percent Change}=100\%*(T_{final}-T_{initial})/T_{initial} \quad (3)$$

Additionally or alternatively, the percent change could also be expressed as an absolute percent change along with the word compression or tension to indicate the sign. In tensions the sign is positive and in compression the sign is negative. For example, a material that is compressed at least 10% is the same as a shim that has a percent change of at least −10%.

Additional disclosure regarding the use of compressible material is provided in U.S. Pat. No. 9,868,036, issued on Jan. 16, 2018, the entire contents of which are incorporated herein by reference.

Within lower channel surface 131 is positioned a fastener port 152. The fastener port 152 may be configured to receive a fastener 150. As such, fastener port 152 may be threaded so that fastener 150 can be loosened or tightened either to allow movement of, or to secure in position, weight member 140, as further described herein. The fastener may comprise a head 151 with which a tool (not shown) may be used to tighten or loosen the fastener, and a fastener body 153 that may, e.g., be threaded to interact with corresponding threads on the fastener port 152 to facilitate tightening or loosening the fastener 150. The fastener port 152 can have any of a number of various configurations to receive and/or retain any of a number of fasteners, which may comprise simple threaded fasteners, such as described below, or which may comprise removable weights or weight assemblies, such as described in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein. As illustrated in FIG. 9B, fastener port 152 may be angled diagonally so that the fastener 150 is angled away from the front end 104 of the golf club head, and the fastener port is forward of a head 151 of the fastener, which may provide a more secure attachment by "sandwiching" the portion of the weight member 140 likely to have the greatest mass between the forward edge 132 of the weight channel 130 and the fastener 150.

Figure 5A:
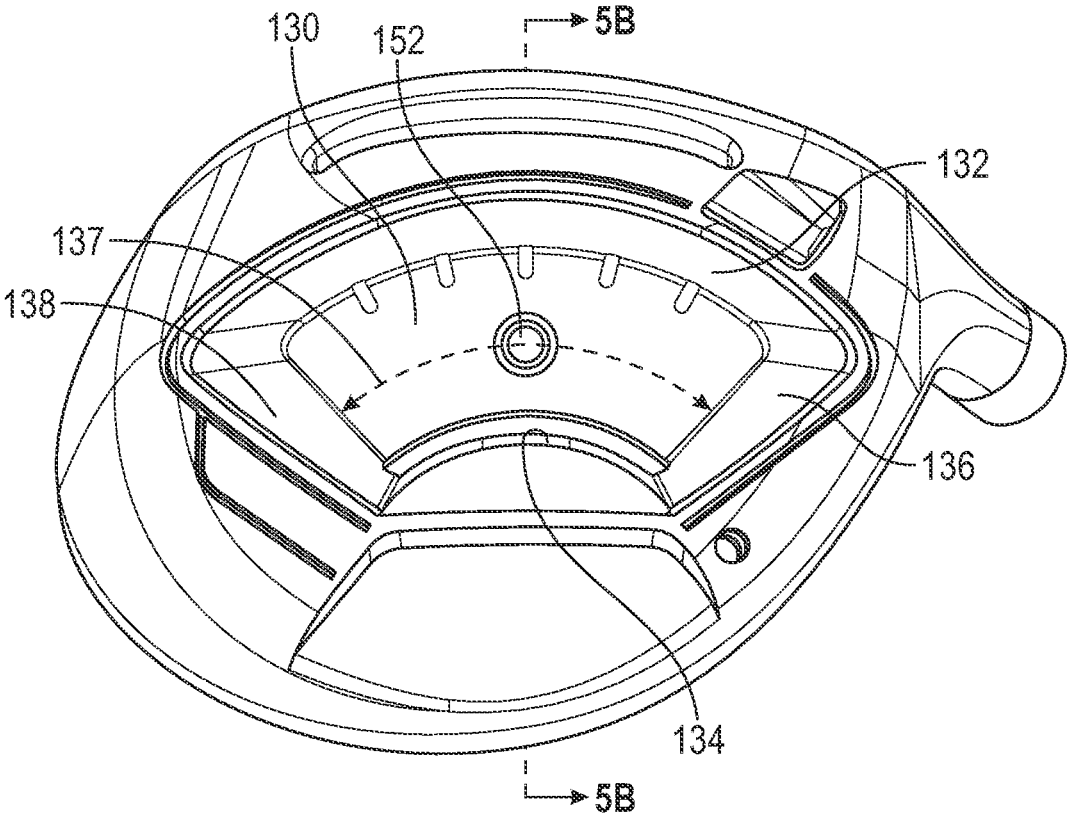
FIG. 5A is a bottom view of the golf club head of FIG. 1, with a weight member removed.
Figure 5B:
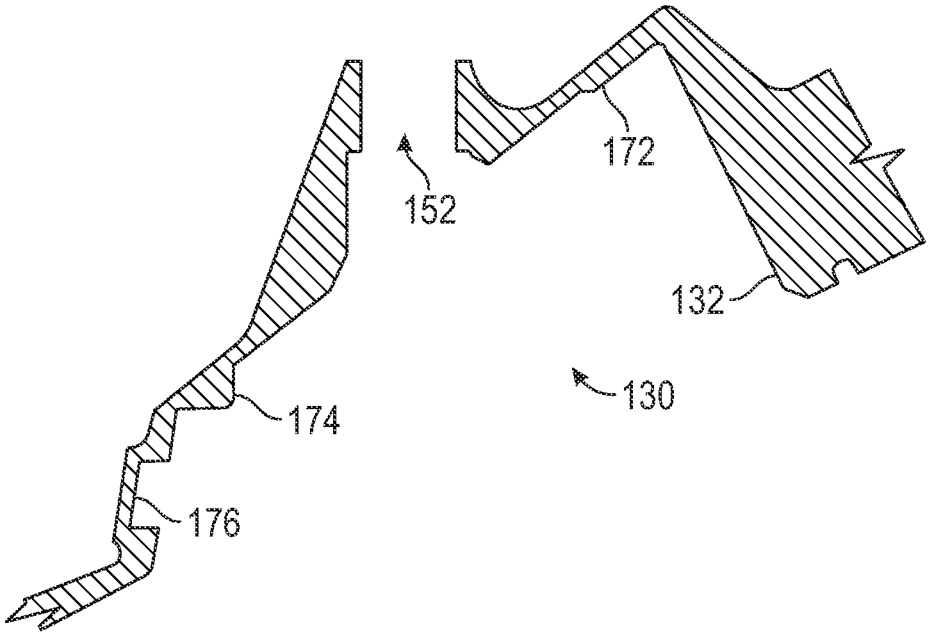
FIG. 5B is a cross-sectional view of a weight channel in the golf club head of FIG. 5A, taken along line 5B-5B in FIG. 5A.
Figure 6:
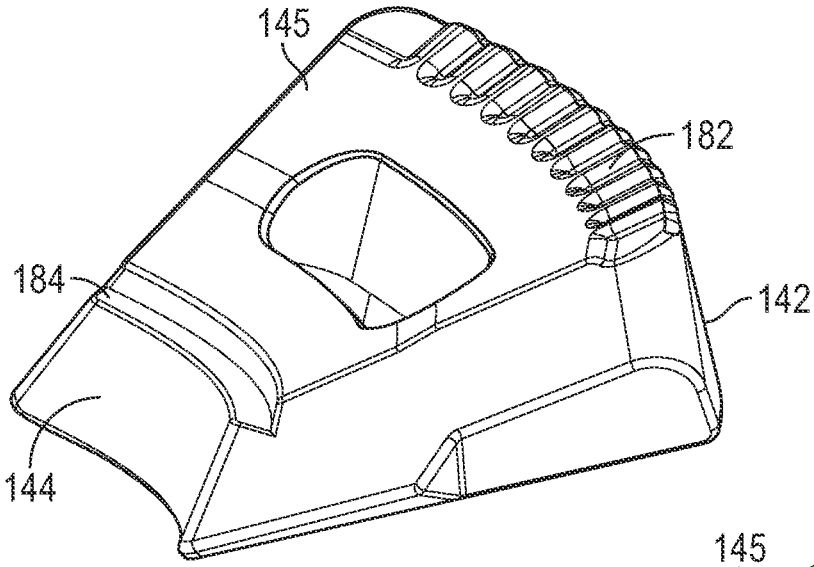
FIG. 6 is a perspective view of a weight member that may be used with the golf club heads of this disclosure.
Figure 7:
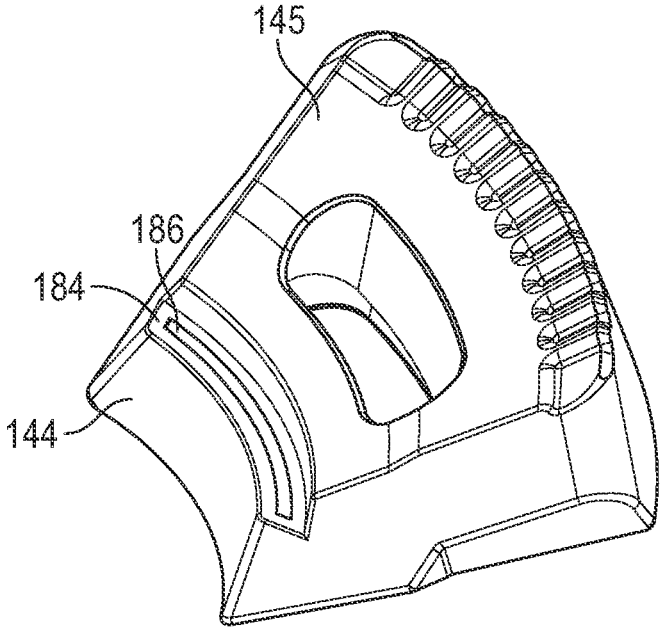
FIG. 7 is a perspective view of another weight member that may be used with the golf club heads of this disclosure.
Figure 9A:
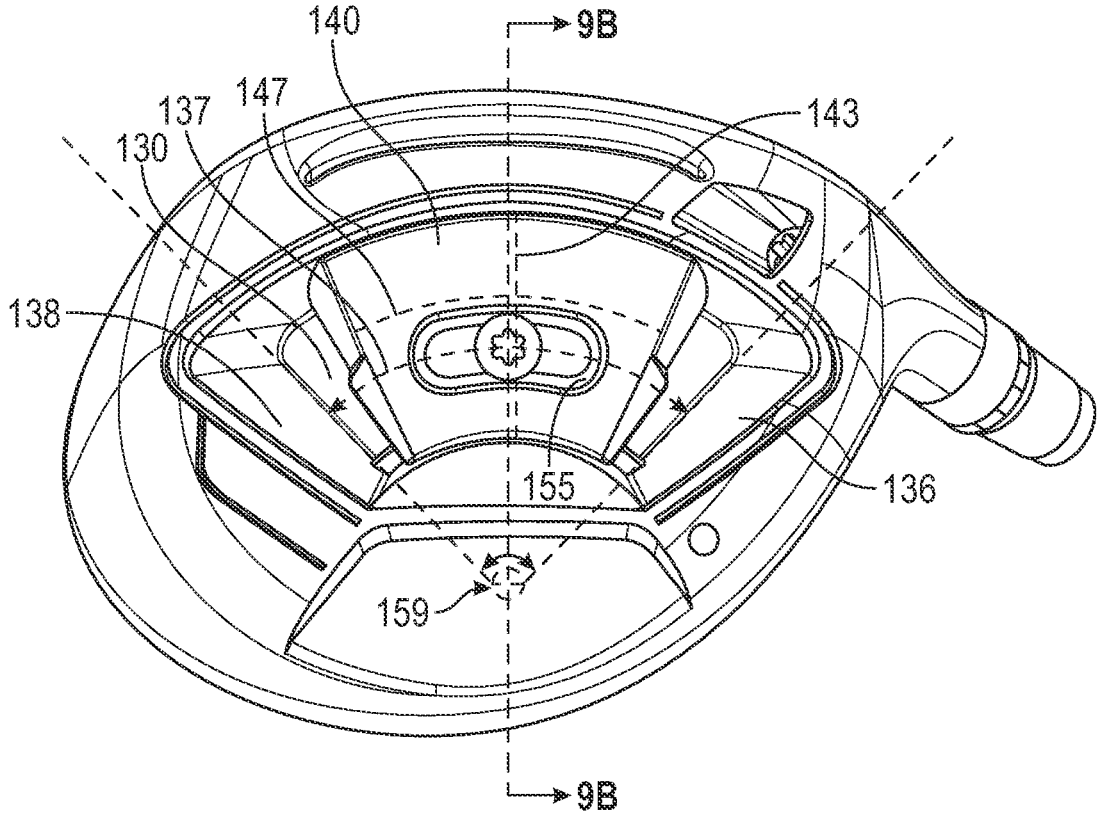
FIG. 9A is a bottom view of the golf club head of FIG. 1A.
Figure 9B:
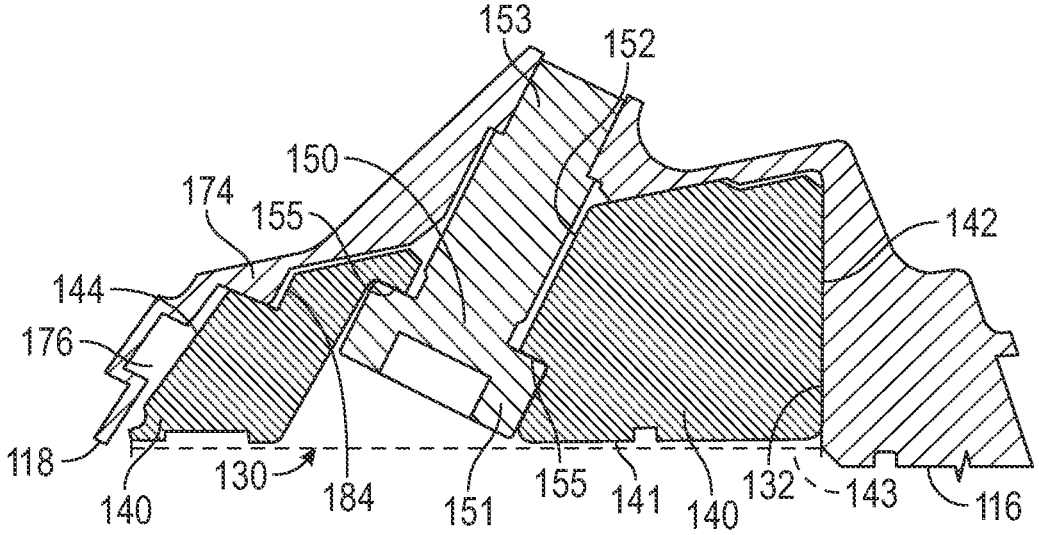
FIG. 9B is a cross-sectional view of a weight member, weight channel, and fastener in the golf club head of FIG. 9A, taken along line 9B-9B in FIG. 9A.

As illustrated in FIGS. 5A and 9A, weight channel 130 is configured to define a path 137 for and to at least partially contain an adjustable weight member 140 (best illustrated in FIG. 9A) that is both configured to translate along the path 137 defined by the weight channel 130 and sized to be slidably retained, or at least partially retained, within the footprint of the weight channel 130 by a fastener 150. The path 137 may comprise a path dimension representing a distance of travel for the weight member 140, wherein the distance comprises the distance between a first end of the path proximate to a first end of the channel (e.g., heelward end 136) and a second path end positioned proximate to a second end of the channel (e.g., toeward end 138). Fastener 150 may be removable, and may comprise a screw, bolt, or other suitable device for fastening as described herein and in the incorporated applications. Fastener 150 may extend through an elongated weight slot 154 passing through the body of the weight member 140. Weight slot 154 may extend through weight member 140 from a lower surface 141 of the weight member that is substantially parallel to the sole 103—and may serve as an additional ground contact point when the golf club head is soled—through an upper surface 145 of the weight member that is positioned against the lower channel surface 131 of the weight channel and into a fastener port 152 in the weight channel 130. The weight member 140 is positioned within the weight channel 130 and entirely external to the interior cavity 122, and (as illustrated in FIGS. 9A and 9B) has a depth 143 that extends normal to the path 137 between a forward side 142 that may be curved parallel to the forward edge 132 of the weight channel 130 and a rearward side 144 that may be curved parallel to the rearward edge 134 of the weight channel. Additionally, as shown in FIGS. 6 and 7, the weight member may have a greater height at the forward side 142 than at a rearward side 144, and may taper down from the forward side 142 to the rearward side 144. In particular cases, the weight member 140 may be configured so that the center of mass is positioned closer to the forward side 142 than to the rearward side 144. Additionally, the weight member may comprise two or more stepped portions, such as a first "higher" step portion nearer the forward side of the weight member having a first height, and a second "lower" step portion adjacent the rearward side having a second height that is smaller than the first height. Additional "steps" may also be used to move from the height at the forward portion to the height at the rearward portion. In the illustrated embodiment, the second stepped portion may comprise a chamfered edge positioned in the upper surface 145 at the rearward side 144 of the weight member, which is configured to form a recessed ledge portion 184 to engage a corresponding rear weight channel ledge 174 on the weight channel 130. As illustrated in FIG. 7, an indentation 186 may be provided within the shelf within which a damping material, such as a polymeric pad (or other suitable material, such as the damping material described above with regard to indentation 176) may be provided to position between the weight member 140 and the body of the golf club head 100, such as between the recessed ledge portion 184 and the rear weight channel ledge 174.

Figure 8:
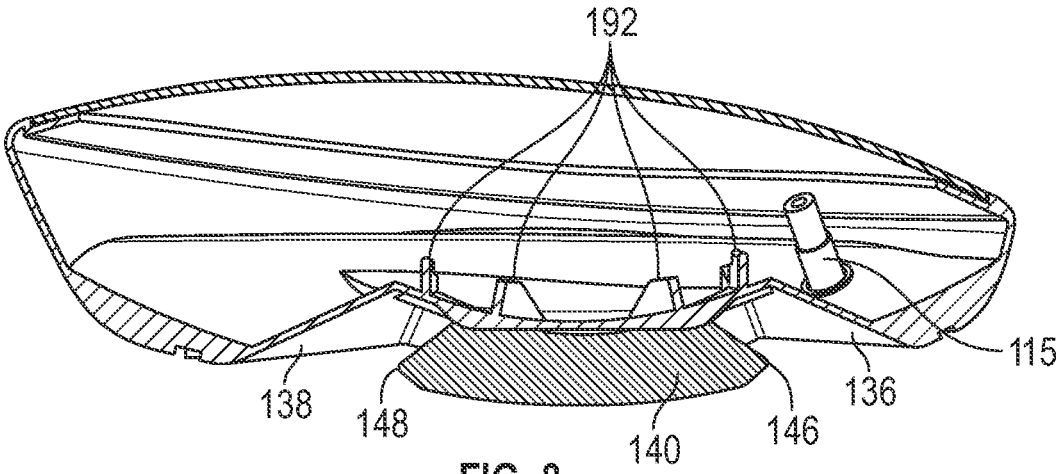
FIG. 8 is a front cross-sectional view of the golf club head of FIG. 1A.

The weight member 140, which may comprise a steel weight member or other suitable material, has a length 147 (as illustrated in FIG. 9A) that extends parallel to the path 137 along which the weight member translates, measured from a heelward end 146 to a toeward end 148 of the weight member 140. While in the illustrated example, length 147 is an arc, length 147 may be measured as either an arc or a straight line, as appropriate to the particular shape of the weight member 140 and the path 137. The length of the weight member 140 in the illustrated example is at least 50 percent of the length of the path 137, and in some instances may be at least 70 percent of the length of the path 137. As shown in FIG. 8, the ends of the weight member may be cantilevered, so that the heelward end 146 and toeward end 148 of an upper portion of the weight member adjacent the lower channel surface 131 of the weight channel are parallel to the heelward end 136 and toeward end 146, respectively, of the weight channel, while the heelward end 146 and toeward end 148 of a lower portion of the weight member that extends from the upper portion of the weight member up towards the sole 103 may be angled away from the heelward end 136 and toeward end 138, respectively, of the weight channel 130. The weight slot 154 may comprise an elongated slot that runs a substantial portion of the length of the weight member parallel to the rearward edge 144 of the weight member 140 from a heelward end 156 to a toeward end 158. The weight slot may further comprise an interior fastener ledge 155 to support the head 151 of a fastener 150. When tightened, the fastener 150 retains the weight member 140 in place. When fastener 150 is loosened, the fastener may be configured to remain stationary relative to the fastener port 152, while the position of the weight member 140 may be adjusted.

In the illustrated example shown in FIG. 9A, weight member 140 may be translated laterally along the path 137 in a heelward or toeward direction to adjust, for example, golf club center of gravity movement along an x-axis (CGx), such as to control left or right tendency of a golf swing. Adjusting the weight member from a first position that is closer to a heelward end 136 of the weight channel 130 to a second position that is closer to a toeward end 138 of the weight channel may provide a CGx movement of at least 3 mm. In particular instances, CGx movement may exceed 4 mm, or in even more specific instances, CGx movement may exceed 5 mm. It is to be understood that in the illustrated embodiment, the weight is moving along the path 137 in an arc about a center axis of curvature 159 (illustrated in FIG. 9A), which is situated rearward of the golf club head's face 104. In particular cases, the center axis of curvature may be positioned rearward of the weight channel 130 itself, and in some instances, the center axis of curvature 159 may be rearward of a center of gravity of the golf club head. In the illustrated embodiment, the weight member is configured to move around the center axis of curvature 159 in an arc of less than 180 degrees, but may in particular embodiments move in an arc of less than 90 degrees, such as in an arc of between 5 degrees and 90 degrees, or between 10 degrees and 30 degrees, or between 15 degrees and 45 degrees, or may not move in an arc at all, but simply translate linearly. It is to be understood that in the illustrated embodiment the center axis of curvature 159 is not collocated with the position of the fastener. Ribbed weight projections 182 may be provided on the lower surface 145 of the weight member 140, such as adjacent to the forward edge 142, to interact with corresponding parallel ribbed projections 172 on a mating surface of the weight channel 130 to better hold weight member 140 in any of a number of selectable positions which may be selected by translating weight member 140 heelward or toeward (in the illustrated example) along the path of the weight channel 130 until a desired position is achieved. In some instances, five or more such positions may be provided. In other embodiments, ten or more such positions are provided. Weight member may also be configured with a visual weight position indicator 149 which may be aligned with visual markings 119 on the sole 103 of the golf club head to indicate the relative position of the weight member 140 along the path of the weight channel 130. Once the desired position is achieved, fastener 150 may be tightened to secure the weight member 140 in place. The weight member may have a mass that is between 10 to 80 grams, or in some particular instances, a mass that is above 30 grams, above 40 grams, above 50 grams, or above 60 grams. In certain embodiments, the weight member 140 may comprise at least 25 percent of a total mass of the golf club head 100. In particular cases, the weight member 140 may comprise at least 30 percent of the total mass of the golf club head 100.

As shown in FIG. 3, the golf club head 100 can optionally include a separate crown insert 168 that is secured to the body 102, such as by applying a layer of epoxy adhesive 167 or other securement means, such as bolts, rivets, snap fit, other adhesives, or other joining methods or any combination thereof, to cover a large opening 190 at the top and rear of the body, forming part of the crown 109 of the golf club head. The crown insert 168 covers a substantial portion of the crown's surface area as, for example, at least 30%, at least 40%, at least 50%, at least 60%, at least 70% or at least 80% of the crown's surface area. The crown's outer boundary generally terminates where the crown surface undergoes a significant change in radius of curvature, e.g., near where the crown transitions to the golf club head's sole 103, hosel 162, and front end 104. As described above, and as partially shown in FIG. 10, the crown opening 190 can be formed to have a recessed peripheral ledge or seat 170 to receive the crown insert 168, such that the crown insert is either flush with the adjacent surfaces of the body to provide a smooth seamless outer surface or, alternatively, slightly recessed below the body surfaces. The front of the crown insert 168 can join with a front portion of the crown 109 on the body 102 to form a continuous, arched crown extend forward to the face. The crown insert 168 can comprise any suitable material, and can be attached to the body in any suitable manner, as described in more detail herein.

Figure 13:
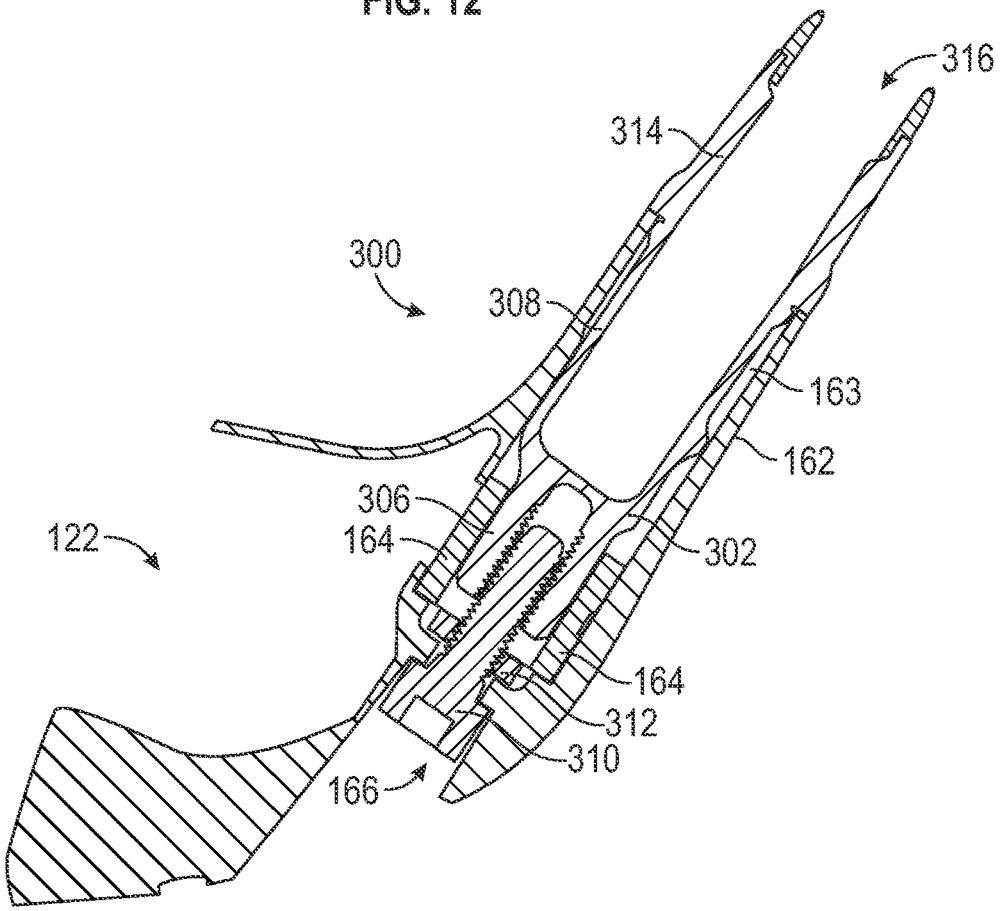
FIG. 13 is a cross-sectional view of an adjustable hosel-shaft assembly of the golf club head of FIG. 1A.

As illustrated in FIG. 13, the golf club head's hosel 162 further provides a shaft connection assembly 300 that allows the shaft to be easily disconnected from the golf club head, and that may provide the ability for the user to selectively adjust a and/or lie-angle of the golf club. The hosel 162 defines a hosel bore 163, which in turn is adapted to receive a hosel insert 164. The hosel bore 163 is also adapted to receive a shaft sleeve 302 mounted on the lower end portion of a shaft, as described in U.S. Pat. No. 8,303,431. A recessed port 166, is provided on the sole 103, and extends from the sole 103 into the interior cavity 122 of the body 102 toward the hosel 162, and in particular the hosel bore 163. The hosel bore 163 extends from the hosel 162 through the golf club head and opens within the recessed port 166 at the sole 103 of the golf club head 100.

The golf club head is removably attached to the shaft by shaft sleeve 302 (which is mounted to the lower end portion of a golf club shaft (not shown)) by inserting the shaft sleeve 302 into the hosel bore 163 and a hosel insert 164 (which is mounted inside the hosel bore 163), and inserting a screw 310 (or other suitable fixation device) upwardly through a recessed port 166 in the sole 103 and, in the illustrated embodiment, tightening the screw 310 into a threaded opening of the shaft sleeve 302, thereby securing the golf club head to the shaft sleeve 302. A screw capturing device, such as in the form of an O-ring or washer 312, can be placed on the shaft of the screw 310 to retain the screw in place within the golf club head when the screw is loosened to permit removal of the shaft from the golf club head.

Figure 12:
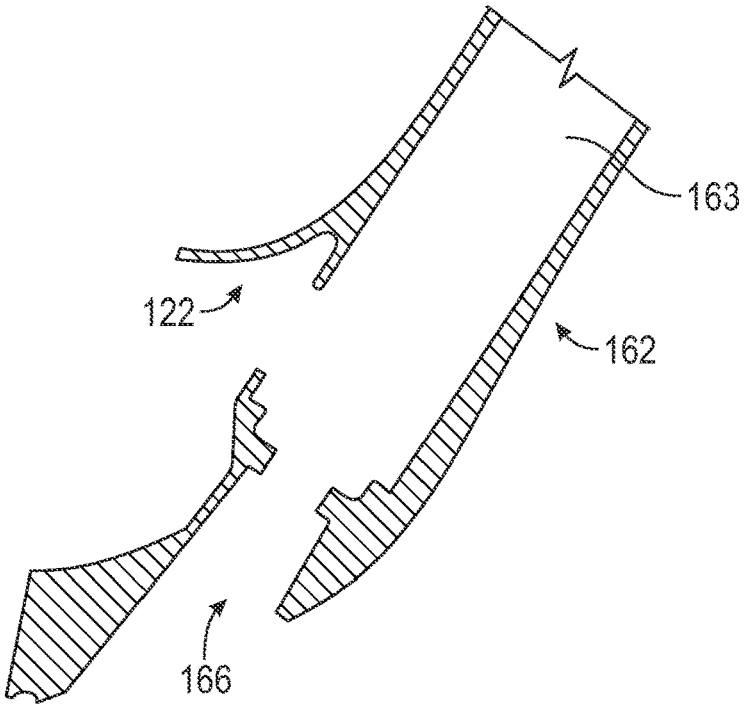
FIG. 12 is a cross-sectional view of a hosel of the golf club head of FIG. 1A.

The recessed port 166 extends from the bottom portion of the golf club head into the interior of the outer shell toward the top portion of the golf club head 200 at the location of hosel 162, as seen in FIGS. 12 and 13. In the embodiment shown in FIG. 2A, the mouth of the recessed port 166 in the sole 103 is generally trapezoidal-shaped, although the shape and size of the recessed port 166 may be different in alternative embodiments.

The shaft sleeve 302 has a lower portion 306 including splines that mate with mating splines of the hosel insert 164, an intermediate portion 308 and an upper head portion 314. The intermediate portion 308 and the upper head portion 314 define an internal bore 316 for receiving the tip end portion of the shaft 300. In the illustrated embodiment, the intermediate portion 308 of the shaft sleeve has a cylindrical external surface that is concentric with the inner cylindrical surface of the hosel bore 163. As described in more detail in U.S. Patent Application Pub. No. 2010/0197424, which is hereby incorporated by reference, inserting the shaft sleeve 302 at different angular positions relative to the hosel insert 164 is effective to adjust the shaft loft and/or the lie angle. For example, the loft angle may be increased or decreased by various degrees, depending on the angular position, such as +/−1.5 degrees, +/−2.0 degrees, or +/−2.5 degrees. Other loft angle adjustments are also possible. In some instances, the hosel insert may be externally attached to the hosel or integrally formed with an external portion of the hosel such that the shaft sleeve and/or an outer sleeve on the shaft sleeve may engage/interlock with the an external portion of the hosel. The external portion of the hosel that engages the shaft sleeve and/or an outer sleeve on the shaft sleeve may have castellated surfaces that correspond and are configured to mate with castellated surfaces on the shaft sleeve and/or an outer sleeve attached to the shaft sleeve. The outer sleeve attached to the shaft sleeve would be rotatable around an axis of the shaft sleeve and provide more incremental adjustment. In some instances, the outer sleeve would have castellated surfaces on an upper portion that correspond and are configured to mate with castellated surfaces on the shaft sleeve and the outer sleeve would have castellated surfaces on a lower portion that correspond and are configured to mate with castellated surfaces on the hosel. See, for example, U.S. Pat. No. 7,997,997, the entire contents of which is incorporated in its entirety by reference herein.

In the embodiment shown, because the intermediate portion 308 is concentric with the hosel bore 163, the outer surface of the intermediate portion 308 can contact the adjacent surface of the hosel bore 163, as depicted in FIG. 13. This allows easier alignment of the mating features of the assembly during installation of the shaft and further improves the manufacturing process and efficiency.

In certain embodiments, the golf club head may be attached to the shaft via a removable head-shaft connection assembly as described in more detail in U.S. Pat. No. 8,303,431, the entire contents of which are incorporated by reference herein in their entirety. Further in certain embodiments, the golf club head may also incorporate features that provide the golf club heads and/or golf clubs with the ability not only to replaceably connect the shaft to the head but also to adjust the loft and/or the lie angle of the club by employing a removable head-shaft connection assembly. Such an adjustable lie/loft connection assembly is described in more detail in U.S. Pat. Nos. 8,025,587; 8,235,831; 8,337,319; 8,758,153; 8,398,503; 8,876,622; 8,496,541; and 9,033,821, the entire contents of which are incorporated in their entirety by reference herein.

Additional Embodiments and Features

Figure 14:
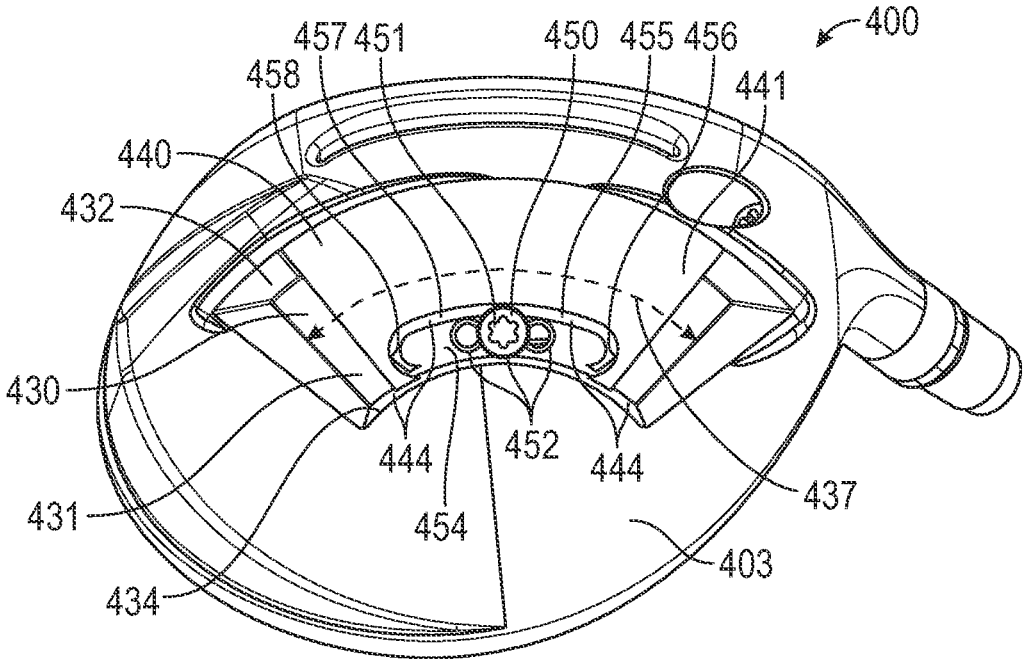
FIG. 14 is a bottom view of another exemplary golf club head disclosed herein.
Figure 15:
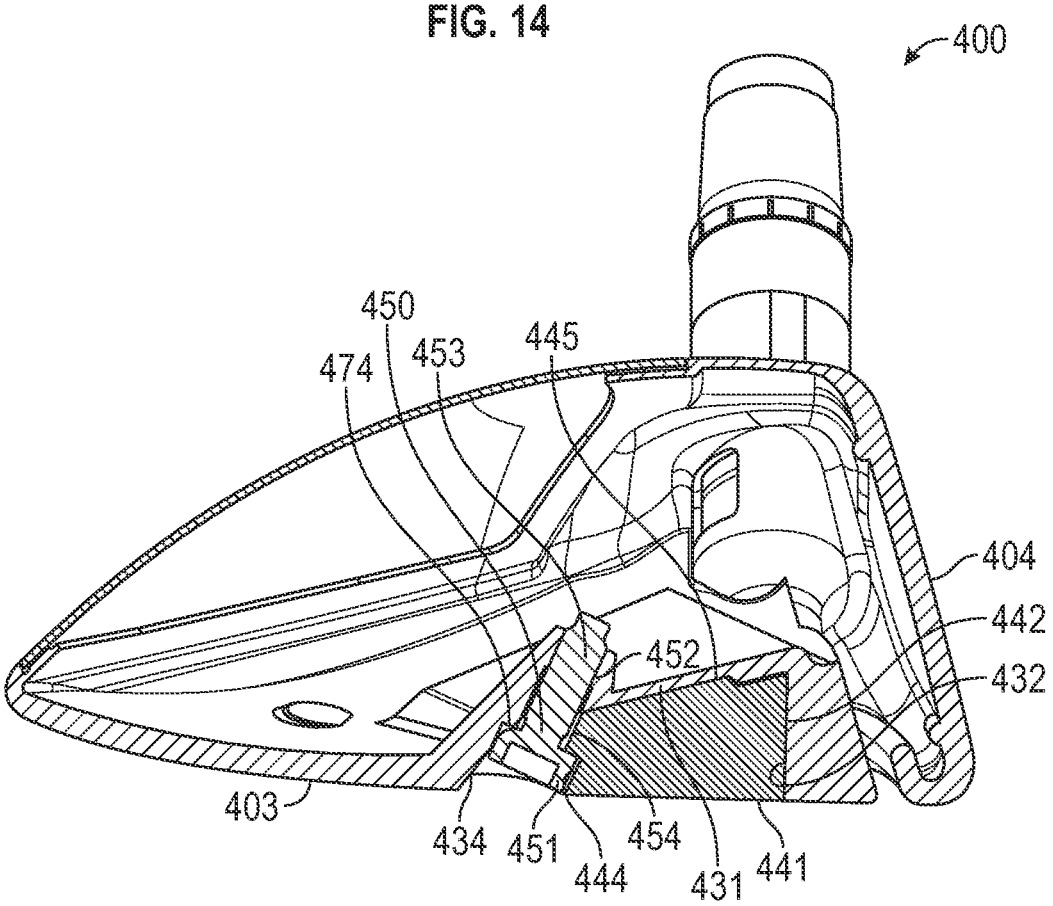
FIG. 15 is a toe-side cross-sectional view of the golf club head of FIG. 14.

FIGS. 14-15 illustrate another exemplary golf club head 400 that embodies certain inventive technologies disclosed herein. The golf club head 400 is similar to golf club head, 100. In golf club head 400, weight channel 430 may contain features similar to weight channel 130, and may be formed as a curved arc extending in a generally heel-toe direction. Weight channel 430 may comprise a lower channel surface 431 that may be substantially parallel to, or as illustrated, slightly angled away from a sole 403 of the golf club head, so that the weight channel 430 may be deeper at a forward edge 432 than it is at the rearward edge 434. Within lower channel surface 431 are positioned several fastener ports 452. Each of the fastener port may be configured to receive a fastener 450. As such, fastener ports 452 may be threaded so that one or more fasteners 450 secured therein can be loosened or tightened either to allow movement of, or to secure in position a weight member 440, as further described herein. The fastener may comprise a head 451 with which a tool (not shown) may be used to tighten or loosen the fastener 450, and a fastener body 453 that may, e.g., be threaded to interact with corresponding threads on the fastener port 452 to facilitate tightening or loosening the fastener 450. The fastener port 452 can have any of a number of various configurations to receive and/or retain any of a number of fasteners, which may comprise simple threaded fasteners, as described above, or any of the fastener types described in the incorporated patents and/or applications. As illustrated in FIG. 15, fastener port 452 may be angled diagonally so that the head 451 of fastener 450 is angled away from the front end 404 of the golf club head, and the fastener port 452 is forward of the head 451 of the fastener.

Similar to weight channel 130, weight channel 430 is configured to define a path 437 for and to at least partially contain adjustable weight member 440 that is both configured to translate along the path 437 and sized to be slidably retained, or at least partially retained, within the footprint of the weight channel 430 by fastener 450. Fastener 450 may be removable, and may comprise a screw, bolt, or other suitable device for fastening as described herein and in the incorporated applications. Fastener may be moved between or among the fastener ports 452 to further adjust mass properties of the golf club head 400. Fastener 450 may extend through an elongated weight slot 454 passing through the body of the weight member 440. Weight slot 454 may extend through weight member 440 from a lower surface 441 of the weight member that is substantially parallel to the sole 403—and may serve as an additional ground contact point when the golf club head is soled—through an upper surface 445 of the weight member that is positioned against the lower channel surface 431 of the weight channel and into a fastener port 452 in the weight channel 430. The weight member 440 is positioned within the weight channel 430 and may have a greater height at a forward side 442 than at a rearward side 444, and may taper down from the forward side 442 to the rearward side 444. In particular cases, the weight member 440 may be configured so that the center of mass is positioned closer to the forward side 442 than to the rearward side 444. In the illustrated example, this is aided by the fact that the weight slot 454 and fastener 450 are positioned at the rearward side 444 of the weight member, such that the rearward side 444 of the weight member at least partially surrounds weight slot 454. The weight slot may further comprise an interior fastener ledge 455 to support the head 451 of fastener 450. In the illustrated example, this fastener ledge is coextensive with much of the rearward side 444 of the weight member 440, and the rearward side of the weight member curves around to bound the fastener 450 at a forward edge 457, at a heelward end 456, and at a toeward end 458 of the weight slot 454. In the illustrated example, the rearward edge 434 of weight channel 430 bounds the fastener 450 to the rear, and may comprise a ledge 474 (as shown in FIG. 15) that protrudes up and out behind the fastener port 452 and runs parallel to the rearward edge 434 of the weight channel 430 to further support the head 451 of the fastener 450 when tightened. When tightened, the fastener 450 retains the weight member 440 in place. Once fastener 450 is loosened, the fastener is configured to remain stationary relative to the fastener port 452, while the position of the weight member 440 may be adjusted relative to the fastener port. In the illustrated example shown in FIG. 14, weight member 440 may be translated laterally along the path 437 in a heelward or toeward direction to adjust, for example, golf club center of gravity movement along an x-axis (CGx), such as to control left or right tendency of a golf swing.

Figure 16:
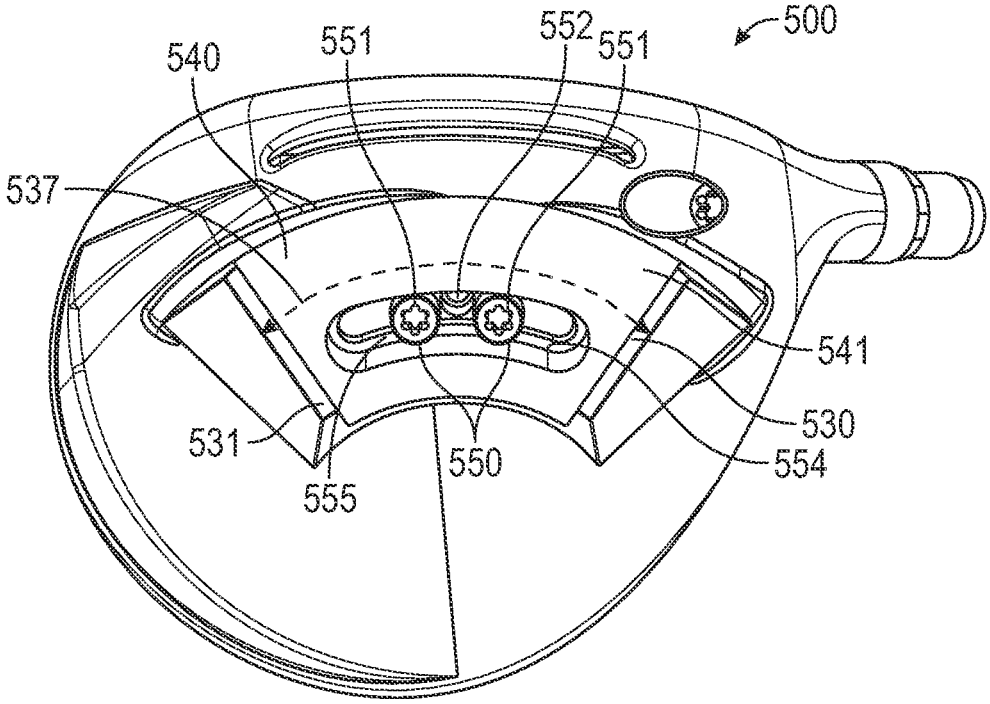
FIG. 16 is a bottom view of another exemplary golf club head disclosed herein.

FIG. 16 illustrates another exemplary golf club head 500 that embodies certain inventive technologies disclosed herein. The golf club head 500 is similar to golf club head 100. In golf club head 500, weight channel 530 may contain features similar to weight channel 130, and may be formed as a curved arc extending in a generally heel-toe direction. Within a lower channel surface 531 are positioned several fastener ports 552. Each of the fastener port may be configured to receive a fastener 550, or, as in the illustrated embodiment, multiple such fasteners. As such, fastener ports 552 may be threaded so that fasteners 550 can be loosened or tightened either to allow movement of, or to secure in position a weight member 540, as further described herein. The fasteners may each comprise a head 551 with which a tool (not shown) may be used to tighten or loosen the fastener, and a fastener body (not shown) that may, e.g., be threaded to interact with corresponding threads on the fastener port 552 to facilitate tightening or loosening the fasteners 550. The fastener port 552 can have any of a number of various configurations to receive and/or retain any of a number of fasteners, which may comprise simple threaded fasteners, as described above, or any of the fastener types described in the incorporated patents and/or applications. Similar to weight channel 130, weight channel 530 is configured to define a path 537 for and to at least partially contain adjustable weight member 540 that is both configured to translate along the path 537 and sized to be slidably retained, or at least partially retained, within the footprint of the weight channel 530 by fastener 550. Fasteners 550 may be removable, and may comprise screws, bolts, or other suitable devices for fastening as described herein and in the incorporated applications. Fasteners may be moved between or among the fastener ports 552 to further adjust mass properties of the golf club head 500. Fasteners 550 may extend through an elongated weight slot 554 passing through the body of the weight member 540. Weight slot 554 may extend through weight member 540 from a lower surface 541 of the weight member that is substantially parallel to the sole 503—and may serve as an additional ground contact point when the golf club head is soled—through an upper surface of the weight member (not shown) that is positioned against the lower channel surface 531 of the weight channel and into a fastener port 552 in the weight channel 530. The weight slot may further comprise an interior fastener ledge 555 to support the head 551 of fastener 550. When tightened, fasteners 550 retain the weight member 540 in place. When fasteners 550 are loosened, the fasteners may be configured to remain stationary relative to their respective fastener ports 552, while the position of the weight member 540 may be adjusted. In the illustrated example, weight member 540 may be translated laterally along the path 537 in a heelward or toeward direction to adjust, for example, golf club center of gravity movement along an x-axis (CGx), such as to control left or right tendency of a golf swing.

FIG. 17 illustrates another exemplary golf club head 600 that embodies certain inventive technologies disclosed herein. The golf club head 600 is similar to golf club head, 100, though one difference is that in golf club head 600, weight channel 630 is positioned within a raised sole portion 660 at the rear end 610 of the golf club head 600, and curves forward at the ends towards the front end 604 of the golf club head. Weight channel 630 and weight member 640 may contain features similar to weight channel 130 and weight member 140. In the illustrated example, however, weight channel extends around the rear end 610 of the golf club head 600, from a position around a periphery of the golf club head situated on the toe side 608 to a position on the heel side 606. Weight channel 630 may comprise a lower channel surface 631 that may be substantially parallel to or slightly angled away from a sole 603 of the golf club head, and may be coextensive, raised up from, or lowered from a raised sole portion 660 at the rear end 610 of the golf club head. Additionally, the weight channel 630 may extend around an entire length of the raised sole portion 660, as illustrated, or may in some embodiments comprise only a portion of a length of the raised sole portion 660. Within lower channel surface 631 is positioned at least one fastener port (not shown)—which may be similar to the fastener ports described herein and in the incorporated patents and/or applications—that may be configured to receive a fastener 650. The fastener may comprise a head 651 with which a tool (not shown) may be used to tighten or loosen the fastener, and a fastener body (not shown) that may, e.g., be threaded to interact with corresponding threads on the fastener port to facilitate tightening or loosening the fastener 650.

Similar to weight channel 130, weight channel 630 is configured to define a path 637 for and to at least partially contain adjustable weight member 640 that is both configured to translate along the path 637 and sized to be slidably retained, or at least partially retained, within the footprint of the weight channel 630 by fastener 650. The path 637 may run the length of the weight channel 630, or may, in some embodiments, comprise only a portion of the weight channel 630. Fastener 650 may be removable, and may comprise a screw, bolt, or other suitable device for fastening as described herein and in the incorporated applications. Fastener 650 may extend through an elongated weight slot 654 passing through the body of the weight member 640. Weight slot 654 may extend through weight member 640 from a lower surface 641 of the weight member that is substantially parallel to the sole 603—and may serve as an additional ground contact point when the golf club head is soled—through an upper surface of the weight member (not shown) that is positioned against the lower channel surface 631 of the weight channel and into the fastener port in the weight channel 630. The weight slot may further comprise an interior fastener ledge (not shown) to support the head 651 of fastener 650. The weight member may have additional discretionary mass positioned proximate to its ends, such as within a first discretionary mass portion positioned at a heelward end 646 and a second discretionary mass portion positioned at a toeward end 648. The weight slot may further comprise an interior fastener ledge (not shown) to support the head 651 of fastener 650. Alternatively, the lower surface 641 of the portion of weight member 640 containing the weight slot may be slightly recessed between heelward end 646 and toeward end 648 so that the head 651 of the fastener 650 is lower than, or no higher than, or substantially similar in height to the remainder of the lower surface 641 of the weight member, as described further herein. When tightened, the fastener 650 retains the weight member 640 in place. When fastener 650 is loosened, the fastener may be configured to remain stationary relative to the fastener port 652, while the position of the weight member 640 may be adjusted. In the illustrated example, weight member 640 may be translated laterally along the path 637 in a heelward or toeward direction to adjust, for example, golf club center of gravity movement along an x-axis (CGx), such as to control left or right tendency of a golf swing.

Weight member 640 may have a mass that is between 10 to 50 grams, or in some particular instances, a mass that is above 10 grams, or a mass that is below 40 grams, or a mass in the range of 12 to 38 grams.

FIG. 18 illustrates another exemplary golf club head 700 that embodies certain inventive technologies disclosed herein. The golf club head 700 is similar to golf club head, 100, though one difference is that in golf club head 700, weight channel 730 is positioned within a raised sole portion 760 at the rear end 710 of the golf club head 700, and curves forward at the ends towards the front end 704 of the golf club head. Weight channel 730 and weight member 740 may contain features similar to weight channel 130 and weight member 140. In the illustrated example, however, weight channel extends around the rear end 710 of the golf club head 700, from a position around a periphery of the golf club head situated on the toe side 708 to a position on the heel side 706. Weight channel 730 may comprise a lower channel surface 731 that may be substantially parallel to or slightly angled away from a sole 703 of the golf club head, and may be coextensive, raised up from, or lowered from a raised sole portion 760 at the rear end 710 of the golf club head. Additionally, in the illustrated embodiment, the weight channel 730 comprises only a portion of a length of the raised sole portion 760. Raised sole portion 760 further comprises external ribs 792 that may be integrally formed with the body 702 of the golf club head 700.

Within lower channel surface 731 is positioned at least one fastener port (not shown)—which may be similar to the fastener ports described herein and in the incorporated patents and/or applications—that may be configured to receive a fastener 750. The fastener may comprise a head 751 with which a tool (not shown) may be used to tighten or loosen the fastener, and a fastener body (not shown) that may, e.g., be threaded to interact with corresponding threads on the fastener port to facilitate tightening or loosening the fastener 750.

Similar to weight channel 130, weight channel 730 is configured to define a path 737 for and to at least partially contain adjustable weight member 740 that is both configured to translate along the path 737 and sized to be slidably retained, or at least partially retained, within the footprint of the weight channel 730 by fastener 750. In the illustrated embodiment, the path 737 may run the length of the weight channel 730, or may, in some embodiments, comprise only a portion of the weight channel 730. Fastener 750 may be removable, and may comprise a screw, bolt, or other suitable device for fastening as described herein and in the incorporated patents and applications. Fastener 750 may extend through an elongated weight slot 754 passing through the body of the weight member 740. Weight slot 754 may extend through weight member 740 from a lower surface 741 of the weight member that is substantially parallel to the sole 703—and may serve as an additional ground contact point when the golf club head is soled—through an upper surface of the weight member (not shown) that is positioned against the lower channel surface 731 of the weight channel and into the fastener port in the weight channel 730. The weight member may have additional discretionary mass positioned proximate to its ends, such as within a first discretionary mass portion positioned at a heelward end 746 and a second discretionary mass portion positioned at a toeward end 748. The weight slot may further comprise an interior fastener ledge (not shown) to support the head 751 of fastener 750. Alternatively, the portion of the lower surface 641 of the portion of weight member 740 containing the weight slot may be slightly recessed between heelward end 746 and toeward end 748 so that the head 751 of fastener 750 is lower than, or no higher than, or substantially similar in height to the remainder of the lower surface 741 of the weight member, as described further herein. When tightened, the fastener 750 retains the weight member 740 in place. When fastener 750 is loosened, the fastener may be configured to remain stationary relative to the fastener port 752, while the position of the weight member 740 may be adjusted. In the illustrated example, weight member 740 may be translated laterally along the path 737 in a heelward or toeward direction to adjust, for example, golf club center of gravity movement along an x-axis (CGx), such as to control left or right tendency of a golf swing.

Weight member 740 may have a mass that is between 10 to 50 grams, or in some particular instances, a mass that is above 10 grams, or a mass that is below 40 grams, or a mass in the range of 12 to 38 grams. FIGS. 19-22 illustrate exemplary weight members that may be used with the golf clubs head disclosed herein.

Figure 19:
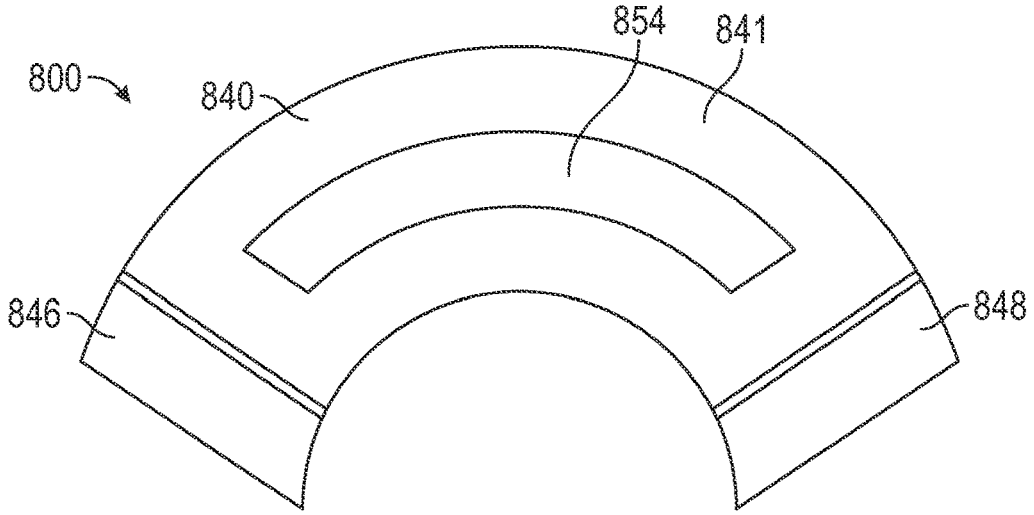
FIG. 19 is a top view of another weight member that may be used with the golf club heads of this disclosure.
Figure 20:
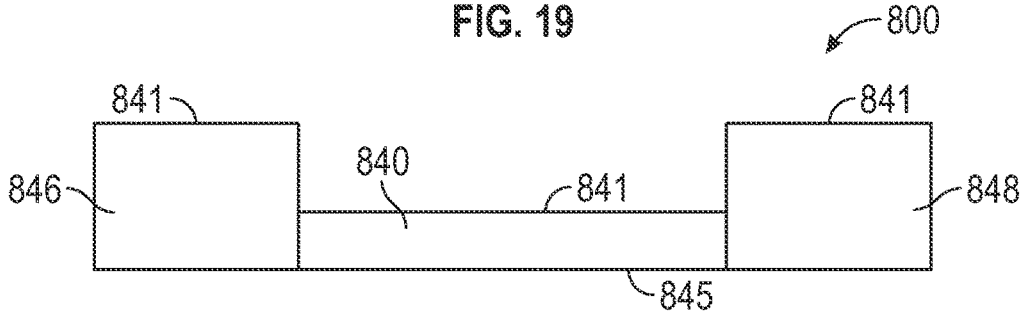
FIG. 20 is an elevational view of the weight member of FIG. 19.

FIGS. 19 and 20 illustrate a weight member 800 having a curved shape, similar to weight member 740, above. Weight member 800 has a middle portion 840 that contains a curved weight slot 854. Weight slot 754 may extend through weight member 800 from a lower surface 841 of the weight member that is configured to be substantially parallel to a sole of a golf club head and to serve as an additional ground contact point when the golf club head is soled—through an upper surface 845 of the weight member 800 that is configured to be positioned against the body of the golf club head, such as a weight channel or raised sole portion, as described herein. The weight member may have additional discretionary mass positioned proximate to its ends, such as within a first discretionary mass portion positioned at a first end portion 846 (such as a heelward end portion) and a second discretionary mass portion positioned at a second end portion 848 (such as a toeward end portion). The weight slot may further comprise an interior fastener ledge (not shown) to support a fastener head. Additionally or alternatively, as illustrated in FIG. 20, the lower surface 841 of the middle portion 840 may be slightly recessed up between the first end portion 846 and the second end portion 848 so that the head of a fastener inserted through the weight member 800 is lower than, or no higher than, or substantially similar in height to the lower surface 841 of the weight member at the first end portion 846 and the second end portion 848.

In some embodiments, the weight member 800 may be formed from a single piece of material, such as by casting, injection molding, machining, or other suitable methods, with first end portion 846 and the second end portion 848 formed to have a greater thickness than the middle portion 840. In other embodiments, additional material, such as additional layers of material, or additional discretionary mass elements may be added to the first end portion 846 and/or the second end portion 848 to add additional mass to the ends. In particular embodiments, this may be achieved by welding an additional thickness of mass to the weight member 800 at one or both of the ends. It is to be understood, however, that additional mass could be added by other methods, such as bolting, adhering, or braising additional mass, or by introducing removable discretionary mass elements, such as described herein.

In some embodiments, weight member 800 may be formed of a first material, such as titanium. In other embodiments, steel, tungsten or another suitable material or combination of materials may be used. In particular embodiments, higher density materials may be used in certain portions of the weight member 800 to add additional mass, such as, e.g., at first end portion 846 and/or second end portion 848. For example, steel or tungsten or other suitable higher density materials could be used at first end portion 846 and the second end portion 848 to add additional discretionary mass to the ends of the weight member 800 relative to the middle portion 840, or additional higher density elements, e.g., plates, could be added at first end portion 846 and/or second end portion 848 to add additional discretionary mass.

"Split mass" configurations such as those described herein potentially allow for several high MOI positions and allow greater weight to be moved to the outside of the club head while minimizing the overall weight added to the club head. Additionally, providing the added weight along the perimeter of the golf club may have additional benefits for maximizing MOI. And, providing a curved shape weight member, combined with a split mass configuration as described herein also may provide for additional mass to be positioned more forward than in a configuration without a split mass configuration, which provides improved CG projection. Additionally, providing the slidable rear weight as illustrated in FIGS. 17-22 provides the potential for improved CGx movement (which may permit movement to affect, e.g., left/right draw/fade bias), while minimizing CGz movement, and potentially reducing CGy movement versus other traditional weight systems. This may improve overall MOI throughout the range of movement.

Figure 21:
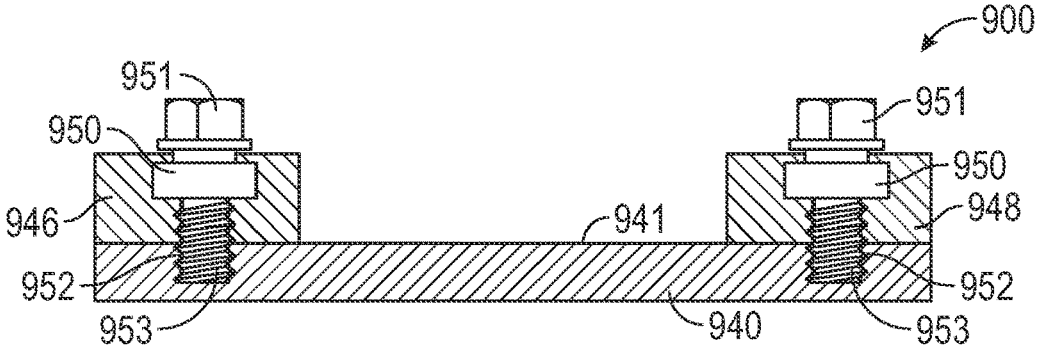
FIG. 21 is a cross-sectional view of another weight member that may be used with the golf club heads of this disclosure.

FIG. 21 illustrates another weight member assembly 900, which comprises a weight member 940 that may be similar to weight member 800, or may alternatively be a linear weight member. Positioned at opposite ends of the weight member 940 are fastener ports 952, such as those described herein and/or in the incorporated patents and applications, which may be configured to receive a fastener 950. The fasteners may be individual movable weights ranging from 1 to 20 grams. The fasteners may have the same mass, or may be different masses. A weight kit may be provided containing weights of varying mass that a user can optionally attach or detach to 900 and 1000. The fasteners may be used for swing weighting to achieve the targeted swing weight and offset manufacturing tolerance and custom length clubs. Or, the fasteners may help achieve a heavier e.g. D4 or lighter swing weight e.g. D1. One or both of the fasteners may be formed form a higher density material than the central region of the weight member 940. In some instances, one or both of the fasteners may be formed of the same material as the central region of the weight member 940. The central region may be formed from a material having a density between 9-20 g/cc (e.g. Tungsten and Tungsten alloys), 7-9 g/cc (e.g. steel and steel alloys), 4-5 g/cc (e.g. Ti and Ti alloys), 2-3 g/cc (e.g. Al and Al alloys), or 1-2 g/cc (e.g. Plastic, Carbon Fiber Reinforced Plastic, Carbon Fiber Reinforced Thermoplastic, Carbon Fiber Reinforced Thermoset), or other suitable materials.

The fastener may comprise a head 951 with which a tool (not shown) may be used to tighten or loosen the fastener, and a fastener body 953 that may, e.g., be threaded to interact with corresponding threads on the fastener port 952 to facilitate tightening or loosening the fastener 950. Further, fastener 950 is configured to retain a discretionary mass element between the lower surface 941 of the weight member 940 and the head of the fastener 950, such as first discretionary mass element 946 positioned at a first end (such as a heelward end) of the weight member 940 and second discretionary mass element 948 positioned at a second end (such as a toeward end) of the weight member 940. Discretionary mass elements 946 and 948 may further contain internal apertures, portions of which may be threaded to interact with threads on the fastener body 953 and other portions which may or may not be threaded and are configured to retain some or all of the fastener head 951.

In some embodiments, weight member 900 may be formed of a first material, such as titanium. In other embodiments, steel, tungsten or another suitable material or combination of materials may be used. In particular embodiments, higher density materials may be used in certain portions of the weight member 900 to add additional mass. For example, steel or tungsten or other suitable higher density materials could be used, e.g., in discretionary mass elements 946 and 948 or in fasteners 950 to add additional discretionary mass to the ends of the weight member 900.

Figure 22:
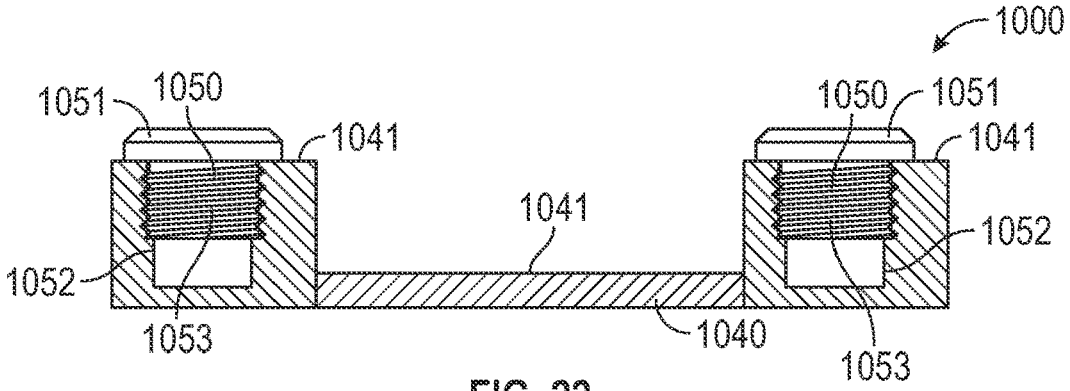
FIG. 22 is a cross-sectional view of another weight member that may be used with the golf club heads of this disclosure.

FIG. 22 illustrates another weight member assembly 1000, which comprises a weight member 1040 that may be similar to weight member 800, or may alternatively be a linear weight member. Positioned at opposite ends of the weight member 1040 are fastener ports 1052, such as those described herein and/or in the incorporated patents and applications, which may be positioned in the lower surface 1041 of the weight member 1000, and configured to receive a fastener 1050. The fastener may comprise a head 1051 with which a tool (not shown) may be used to tighten or loosen the fastener, and a fastener body 1053 that may, e.g., be threaded to interact with corresponding threads on the fastener ports 1052 to facilitate tightening or loosening the fastener 1050. Fastener 1050 may itself comprise a discretionary mass, as described in the incorporated patents and/or applications, which discretionary mass may be removed and replaced with a heavier or lighter discretionary mass to adjust mass properties of a golf club head, as desired. Portions of fastener port 1052 may be threaded to interact with threads on the fastener body 1053 and other portions may not be threaded and may be configured to retain some or all of the fastener head 1051.

In some embodiments, weight member 1000 may be formed of a first material, such as titanium. In other embodiments, steel, tungsten or another suitable material or combination of materials may be used. In particular embodiments, higher density materials may be used in certain portions of the weight member 1000 to add additional mass. For example, steel or tungsten or other suitable higher density materials could be used, e.g., in fasteners 1050 or for forming them in or adhering them to the ends of the weight member, such as in the manner further described above and in the incorporated patents and applications, to add additional discretionary mass to the ends of the weight member 1000.

Figure 23A:
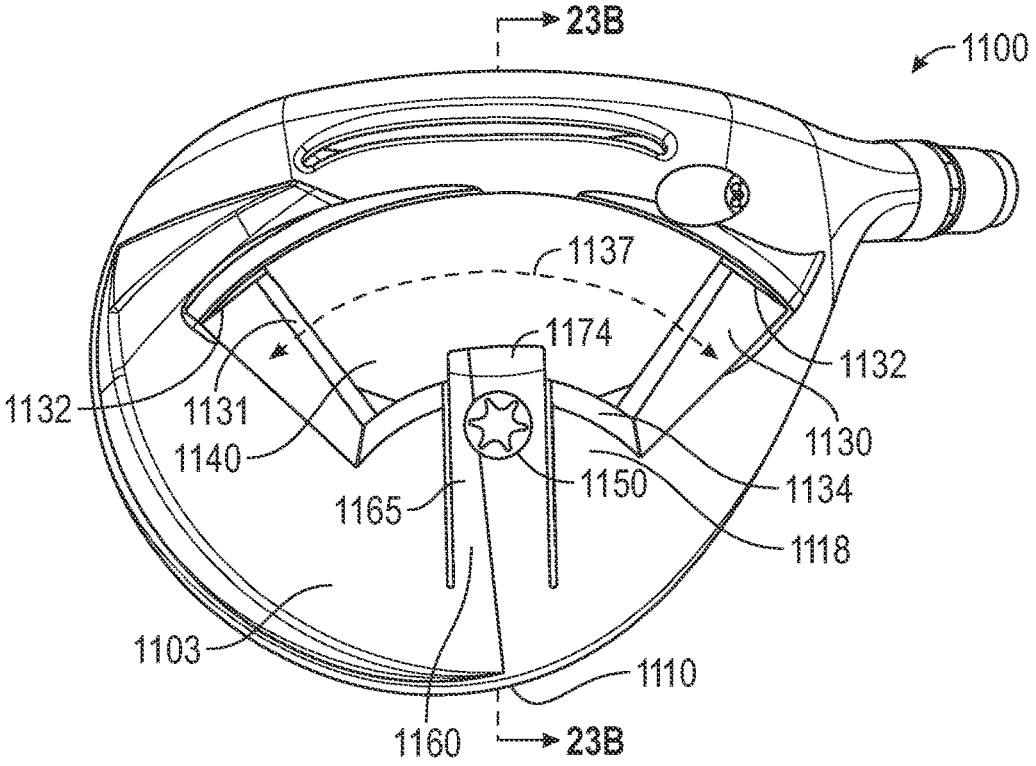
FIG. 23A is a bottom view of another exemplary golf club head disclosed herein.
Figure 23B:
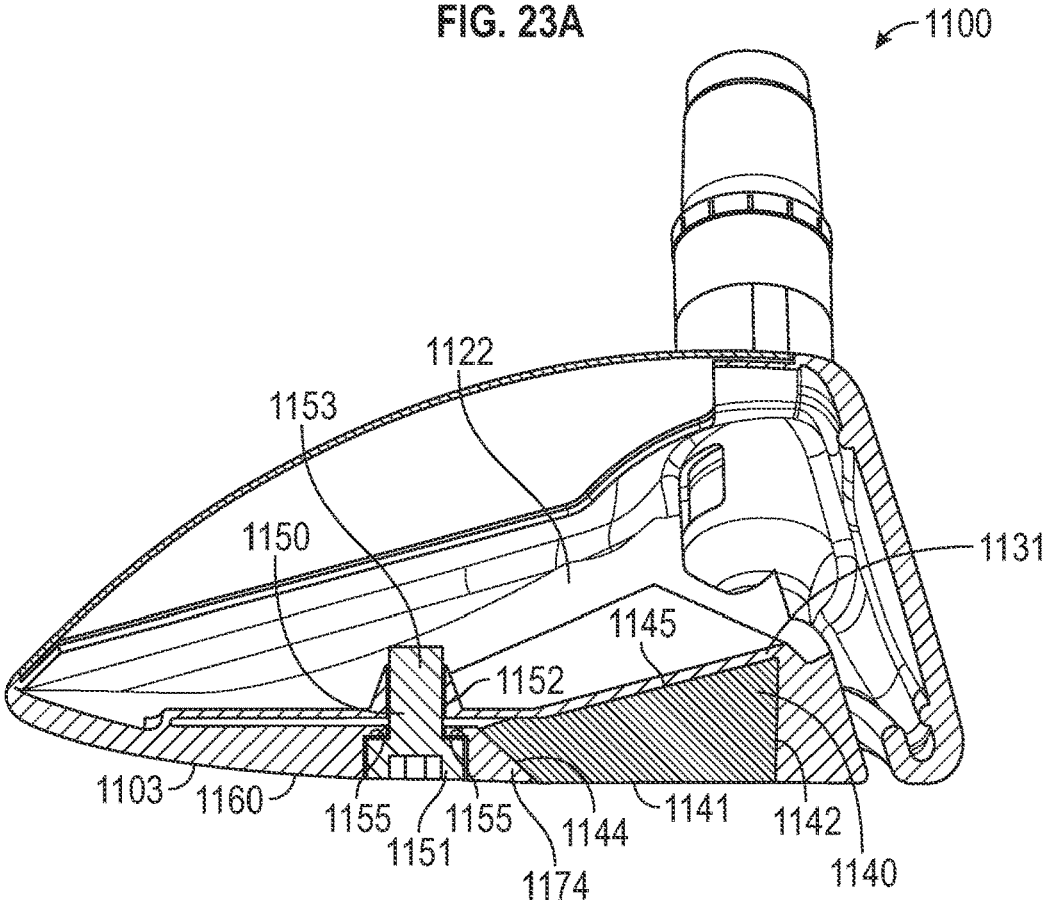
FIG. 23B is a toe-side cross-sectional view of the golf club head of FIG. 23A, taken along line 23B-23B in FIG. 23A.

FIGS. 23A and 23B illustrate another exemplary golf club head 1100 that embodies certain inventive technologies disclosed herein. The golf club head 1100 is similar to golf club head, 100. In golf club head 1100, weight channel 1130 may contain features similar to weight channel 130, and may be formed as a curved arc extending in a generally heel-toe direction. Weight channel 1130 may comprise a lower channel surface 1131 that may be substantially parallel to, or as illustrated, slightly angled away from a sole 1103 of the golf club head, so that the weight channel 1130 may be deeper at a forward edge 1132 than it is at a rearward edge 1134.

Similar to weight channel 130, weight channel 1130 is configured to define a path 1137 for and to at least partially contain adjustable weight member 1140 that is both configured to translate along the path 1137 and sized to be slidably retained, or at least partially retained, within the footprint of the weight channel 1130 by fastener assembly 1160. Unlike the previous examples, which relied on fasteners passing through at least a portion of the weight member, golf club head 1100 comprises a fastener assembly 1160 comprising a fastener tab 1165 that may extend from a rear ground contact surface 1118 proximate to the rear end 1110 of the golf club head to a weight overhang or ledge 1174 that may at least partially cover the weight member 1140, such as its rearward side 1144, as best illustrated in FIG. 23B. Within fastener tab 1165 is positioned one or more fastener ports 1152 (one such port is provided in the illustrated example). Fastener port 1152 may be configured to receive a removable fastener 1150, such as a bolt or screw, or one of the other suitable fasteners described herein or in the incorporated patents and applications. As such, fastener port 1152 may be threaded so that a removable fastener 1150 secured therein can be loosened or tightened either to allow movement of, or to secure weight member 1140 in position, as further described herein. The fastener may comprise a head 1151 with which a tool (not shown) may be used to tighten or loosen the removable fastener 1150, and a fastener body 1153 that may, e.g., be threaded to interact with corresponding threads on the fastener port 1152 to facilitate tightening or loosening the removable fastener 1150. The fastener port 1152 can have any of a number of various configurations to receive and/or retain any of a number of fasteners, which may comprise simple threaded fasteners, as described above, or any of the fastener types described in the incorporated patents and/or applications. The fastener port may further comprise an interior fastener port ledge 1155 to support the head 1151 of fastener 1150, which may be at least partially recessed within the fastener port 1152, and which in the illustrated example is substantially parallel to rear ground contact surface 1118.

As illustrated in FIG. 23B, fastener port 1152 is positioned entirely outside of the weight channel 1130 and extends from the sole 1103 into the body of the golf club head 1100. In some embodiments, the fastener port 1152 may extend into an interior cavity 1122 of the golf club head 1100. Additionally, the weight member may have a greater height at the forward side 1142 than at the rearward side 1144, and may taper down from the forward side 1142 to the rearward side 1144. In particular cases, the weight member 1140 may be configured so that the center of mass is positioned closer to the forward side 1142 than to the rearward side 1144. Additionally, an upper surface 1145 of the weight member may extend further rearward than a lower surface 1141 of the weight member, with a rearward side 1144 of the weight member 1140 sloping up in a rearward direction from the sole 1103, permitting at least a portion of the rearward side 1144 of the weight member to engage the ledge 1174 on the fastener tab 1165. Ledge 1174 may itself be angled so that a lower portion nearest the sole 1103 extends further forward than an upper portion positioned nearer the lower surface 1131 of the weight channel 1130.

When tightened, the removable fastener 1150 presses down on fastener tab 1165 so that the ledge 1174 retains the weight member 1140 in place. Once removable fastener 1150 is loosened, the fastener is configured to remain stationary relative to the fastener port 1152, while the position of the weight member 1140 may be adjusted relative to the fastener port. In the illustrated example shown in FIG. 23A, weight member 1140 may be translated laterally along the path 1137 in a generally heelward or toeward direction to adjust, for example, golf club center of gravity movement along an x-axis (CGx), such as to control left or right tendency of a golf swing. One advantage of the golf club head 1100 shown in this example is that in moving the removable fastener 1150 outside of the weight channel 1130, the weight member 1140 need not be specially engineered to contain a slot passing through the weight member 1140 to receive the removable fastener 1150. This example may also provide a more consistent distribution of mass throughout the weight than some other examples.

Further Embodiments and Features

FIGS. 24-27 illustrate another exemplary golf club head 1200 that embodies the inventive technologies disclosed herein. The golf club head 1200 is similar to other golf club heads discussed herein. The golf club head 1200 includes a body 1202 defining an interior cavity 1222 (depicted in FIG. 25), a sole 1203 defining a bottom portion of the golf club head 1200, a crown 1209 (depicted in FIG. 25) defining a top portion of the golf club head, a face 1211 (depicted in FIG. 25) defining a forward portion of the golf club head, a rearward portion of the golf club head opposite the face 1211, and a hosel 1262. The hosel 1262 can include a shaft connection assembly configured to selectively adjust a loft and/or a lie-angle of the of the golf club 1200.

The golf club head 1200 includes a weight channel 1230 that may contain features similar to weight channel 130, however weight channel 1230 may be formed as a path 1237 extending in a generally front-back direction. In some instances, the weight channel 1230 and therefore the path may be angled relative to a vertical x-z plane intersecting the center of the face see for example FIG. 56B of U.S. Pat. No. 10,537,773 describing an angled sliding weight track that may be angled relative to a vertical plane intersecting the center of the face and angled between about 0 degrees and about 180 degrees, such as between about 67 degrees and about 85 degrees, such as between about 20 degrees and about 160 degrees, such as between about 40 degrees and about 140 degrees, such as between about 60 degrees and about 120 degrees, such as between about 70 degrees and about 110 degrees. The entire contents of U.S. Pat. No. 10,537,773 are hereby incorporated by reference in their entirety. The weight channel 1230 is configured to define a path 1237 for and to at least partially contain adjustable weight member 1240 that is both configured to translate along the path 1237 and sized to be slidably retained, or at least partially retained, within the footprint of the weight channel 1230 by fastener 1250.

The weight member 1240 is configured to move independent of a fastener 1250 and the location of the fastener port 1252. The fastener 1250 may be fixed at a single location or a series of locations. By fixing the fastener 1250 at a single location, the weight member 1240 is movable/adjustable independent of the fastener location. Having the fastener secured in a single or series of locations can save weight over typical infrastructure required for a sliding weight system. For example, ledges are not required for clamping or compressing against the weight member 1240. The present embodiments of a sliding weight member 1240 also does not leave undesirable gaps between the weight member 1240 and the body 1202 because the weight member 1240 is moved to different positions. These undesirable gaps could trap air, dirt, or debris, any of which could negatively impact club head speed and ground interaction. These undesirable gaps could also create an undesirable whistling sound that a user may not want to hear during a swing, distracting the user and negatively impacting performance of the club head.

The weight member 1240 can be adjusted by repositioning the weight member 1240 within the weight channel 1230. In some embodiments, the weight member 1240 has three or more positions, such as three or more predefined or undefined positions within the weight channel 1230. In some embodiments, the weight member 1240 can be positioned at any location along the weight channel 1230, such as in a continuous path of positions along the weight channel 1230. For example, in a first, forward position (depicted in FIGS. 24-25), between about 5% and about 80% of the weight member 1240 is covered by the body 1202, preferably between 10% and 50%. In a second, rearward position (depicted in FIGS. 26-27), between 0% and 50% of the weight member 1240 is covered by the body 1202, preferably between 0% and 25%. In a third, middle position (not depicted), between about 2.5% and about 65%, preferably between 5% and 40%. The weight member 1240 can be adjusted into additional and different positions along the path 1237 of the weight channel 1230.

In some embodiments, the weight member 1240 is configured to increase a water-displaced volume of the golf club head 1200 when the weight member 1240 is adjusted from a first, forward position in the weight channel 1230 to a second, rearward position in the weight channel 1230. For example, when the weight member 1240 is in the first, forward position (depicted in FIGS. 24-25), at least a portion of the weight member 1240 is covered by the body 1202, such as by the weight member 1240 occupying a weight cavity 1295 (depicted in FIG. 25) inside the body 1202. When the weight member 1240 is in the second, rearward position (depicted in FIGS. 26-27), a smaller portion of the weight member 1240, or no portion of the weight member 1240, is covered by the body 1202, such as by the weight member 1240 unoccupying at least a portion of the weight cavity 1295 (depicted in FIG. 27) inside the body 1202. By sliding the weight member 1240 rearward and outward from the weight cavity 1295, the water-displaced volume of the golf club head 1200 can increase, such as by the volume of the uncovered portion of the weight member 1240 extending outside of the weight cavity 1295. In some instances, adjusting the weight member 1240 can increase the club head volume by at least 2 cc and no more than 15 cc, preferably between 2.5 cc and 12 cc, more preferably between 1.5 cc and 9 cc.

The club head 1200 is provided as a wood-type club head having a volume, typically measured in cubic-centimeters (cc), equal to the volumetric displacement of the club head, assuming any concavities are sealed by a substantially planar surface. (See United States Golf Association "Procedure for Measuring the Club Head Size of Wood Clubs," Revision 2.1, Apr. 9, 2019) (the "USGA Procedure"). According to the USGA Procedure, prior to measuring the club head volume, significant concavities on the sole are filled with a waterproof clay or equivalent material. Multiple concavities on the sole are considered significant if the collective volume of all concavities on the sole is greater than 15 cc. Although the golf club head 1200 is depicted as a fairway wood with a volume between 120 cc and 300 cc and a mass between 115 g and 260 g, the golf club head 1200 can also be provided as any wood-type golf club head, including a driver with a volume between 300 cc and 500 cc and a mass between 145 g and 260 g, or a utility or hybrid club with a volume between 80 cc and 140 cc and a mass between 105 g and 280 g.

For example, the golf club head 1200 can be a driver with a water-displaced volume between about 400 cc and about 470 cc, preferably 460±10 cc. For example, when the weight member 1240 is in the first, forward position (depicted in FIGS. 24-25), a collective concavity volume of the weight channel 1230 and all other concavities on the sole (e.g., recessed port 1266, heelward concavity 1296, and toeward concavity 1297) are no more than 15 cc. By keeping sole concavities below 15 cc, an address area (e.g., surface area of the golf club head 1200 visible to the golfer at address) can be increased, giving greater confidence to the golf at address.

Figure 24:
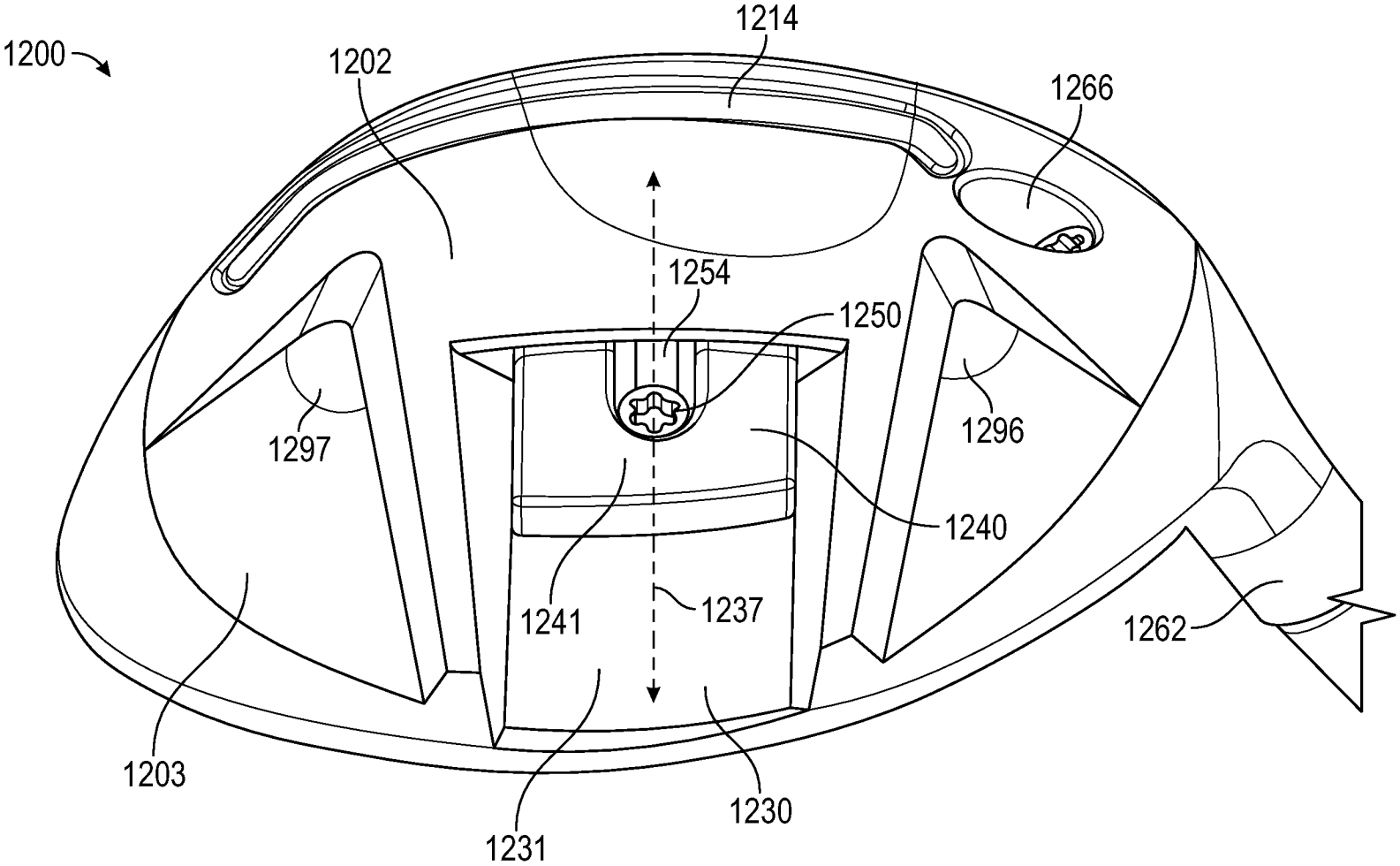
FIG. 24 is a bottom view of another exemplary golf club head disclosed herein, with a weight member positioned in a in a first, forward position.
Figure 25:
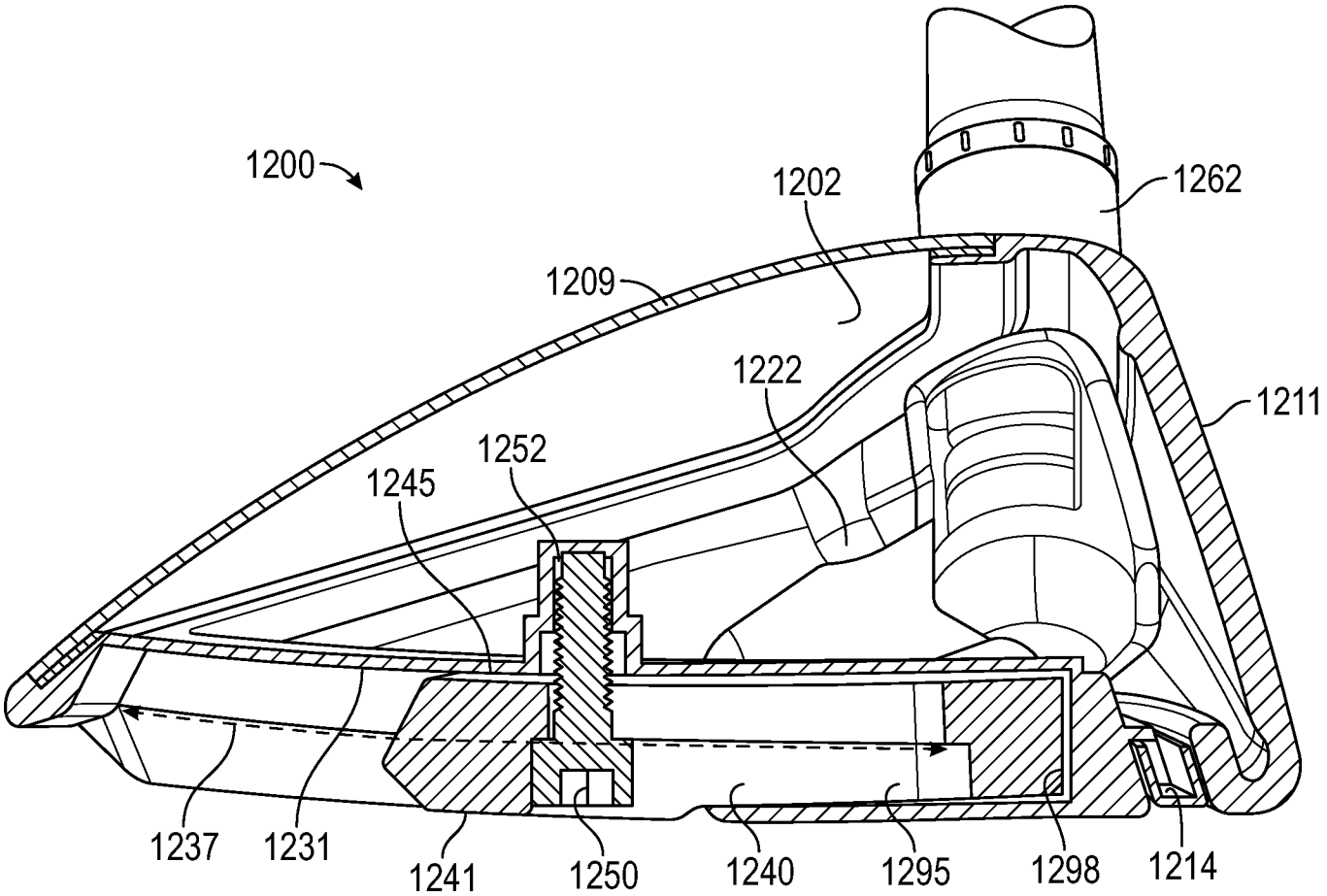
FIG. 25 is a toe-side cross-sectional view of the golf club head of FIG. 24, taken along the path 1237 in FIG. 24, with the weight member positioned in a in a first, forward position.

FIGS. 24-25 illustrate the golf club head 1200 with the weight member 1240 positioned in a in a first, forward position along the path 1237 along the weight channel 1230. The weight member 1240 may be translated along the path 1237 in a forward or rearward direction to adjust, for example, golf club center of gravity movement along a y-axis (CGy), such as to increase or decrease spin, dynamic loft, and moment of inertia (MOI), and to otherwise modify launch conditions of the club head 1200. For example, the weight member 1240 can be configured to adjust CGy by between about 1 mm and about 15 mm, preferably between 3 mm and 10 mm, more preferably between 6 mm and 9 mm, even more preferably between 4 mm and 8 mm. In some embodiments, a change in CGy from a first position is at least 3 mm, more preferably at least 4 mm. The CGy movement generally corresponds to overall weight movement of no more than 31 mm from a first position to a second position, preferably no more than 26 mm, more preferably no more than 21 mm.

The weight member 1240 and/or the weight channel 1230 can be curved from front to back direction along the path 1237, such as in a convex path along the sole 1203. The weight member 1240 and/or the weight channel 1230 can also be curved laterally, such as in a convex curve in a heel to toe direction. In some embodiments, a lower surface of the weight member 1240 is substantially shaped to match the contours of the sole 1203, such as to provide better turf interaction and contributing to the "bounce" of sole 1203. For example, a forward edge 1298 (depicted in FIG. 25) of the weight channel 1230 can be closed, such as to prevent undesirable turf interaction and to reduce any dig of the sole 1203 through impact. The weight channel 1230 can be closed to the interior cavity 1222, such as to prevent water, dirt, and other debris from entering the interior cavity 122. The weight member 1240 can be shaped to substantially match the weight cavity 1295, such as to reduce, minimize, or prevent water, dirt, and other debris from entering the weight cavity 1295.

One or more fasteners 1250 can be configured to pass through at least a portion of the weight member 1240. The one or more fasteners 1250 can be threaded into a portion of the body 1202 to secure the weight member 1240. For example, one or more fastener ports 1252 (one such port is provided in the illustrated example) are configured to receive the fastener. For example, the fastener port 1252 may be configured to receive a fastener 1250, such as a removable bolt or screw, or one of the other suitable fasteners described herein or in the incorporated patents and applications. As such, fastener port 1252 may be threaded so that a removable fastener 1250 secured therein can be loosened or tightened either to allow movement of, or to secure weight member 1240 in position, as described herein. The fastener port 1252 can be positioned entirely outside of the weight channel 1230 and can extend from the sole 1203 into the body of the golf club head 1200. In some embodiments, the fastener port 1252 may extend into an interior cavity 1222 of the golf club head 1200. In some embodiments, the fastener port 1252 may extend into at least a portion of the weight channel 1230 of the golf club head 1200. In some embodiments, at least a portion of the weight member 1240 is covered by a removable cover (not depicted) affixed to the body. In some embodiments, the removable cover is affixed over the fastener 1250. In some embodiments, the removable cover is affixed to the body using the fastener 1250.

The fastener 1250 may extend through an elongated weight slot 1254 passing through the body of the weight member 1240. The weight slot 1254 may extend through weight member 1240 from a lower surface 1241 of the weight member that is substantially parallel to the sole 1203—and may serve as an additional ground contact point when the golf club head is soled—through an upper surface 1245 (depicted in FIG. 25) of the weight member that is positioned against the lower channel surface 1231 of the weight channel and into a fastener port 1252 in the weight channel 1230. The weight slot 1254 can be shaped to receive at least a portion of the fastener 1250. In some embodiments, when tightened, the fastener 1250 can sit flush with the lower surface 1241 of the weight member. In some embodiments, when tightened, the fastener 1250 can be countersunk below the lower surface 1241 of the weight member. When tightened, the fastener 1250 retains the weight member 1240 in place. Once the fastener 1250 is loosened, the fastener 1250 is configured to remain stationary relative to the fastener port 1252, while the position of the weight member 1240 may be adjusted relative to the fastener port.

The club head 1200 can include a front channel 1214 formed in the sole 1203, as discussed herein regarding club head 100. The front channel 1214 extends in a toe-heel direction across the sole 1203, with a heelward end near the hosel 1262 and an opposite toeward end. The front channel 1214 can extend into the interior of the club head 1200 and is positioned forward of the weight member 1240, weight channel 1230, weight cavity 1295, and fastener 1250.

The weight member 1240 is formed from a higher density material than other portions of the body 1202. In some embodiments, at least a portion of the body 1202 is formed from a first material, such as a steel or titanium alloy, and the weight member 1240 is formed from a second material, such as a tungsten alloy or steel. In some embodiments, at least a portion of the crown 1209 is formed from a first material, such as a titanium alloy, steel, or a composite material, and the weight member 1240 is formed from a second material, such as a tungsten alloy or steel. In some embodiments, at least a portion of the crown 1209 is formed from a first material, such as a composite material, and the body 1202 is formed from a second material, such as a titanium alloy or steel. For example, the composite crown can be affixed or affixed to a titanium body, frame, or shell. In an example, the body is cast without the crown, and a composite crown is affixed or bonded to the cast body. In some embodiments, at least a portion of the face 1211 is formed from a first material, such as a titanium alloy, steel or a composite material, and the weight member 1240 is formed from a second material, such as a tungsten alloy or steel.

In some embodiments, the weight member 1240 is formed from a steel alloy, a tungsten alloy, or another alloy and is between about 5.5 g/cc and about 20 g/cc, preferably between about 7.5 g/cc and about 14 g/cc, the crown 1209 is between about 1 g/cc and about 5 g/cc, preferably between 1 g/cc and 2 g/cc, and the body 1202 is between about 4 g/cc and about 8 g/cc. In some embodiments, the weight member 1240 can form between about 15% and about 35% of the total mass/weight of the club head 1200, preferably about 25% of total mass/weight. In some embodiments, the weight member 1240 can form between about 5% and about 40% of the total material volume of the body 1202, preferably between about 7% and 36% of total material volume, even more preferably between about 10% and 29%.

In some embodiments, the face 1211 is face plate is welded, bonded, or otherwise affixed to the body 1202. For example, the face plate can be formed from steel or a titanium alloy, such as C300 alloy steel, 4140 steel, 17-4 PH SS, 431 SS, 450 SS, ZA 1300 Ti, 9-1-1 Ti, or another alloy. In some embodiments, the face plate is machined before or after the face plate is welded to the body 1202. For example, the face plate can be machined on a lathe or milled to provide localized stiffened regions, variable thickness regions, or inverted cone technology (ICT) regions (also referred to as a "donut") located on the face plate at a location that surrounds or that is adjacent to the ideal striking location of the striking face. In some embodiments, the face 1211 is cast with the body 1202, such as providing for a unitary cast body 1202 with the face 1211. For example, the face plate can be milled after casting to provide an asymmetric or non-symmetrical face thickness profile, such as opposed to a 360-degree concentric circle symmetry provided using a lathe. As such, different areas of the face can be provided with different face thicknesses, as well as milled bulge and roll, twist, score lines, and other features of the face plate. The golf club heads of this disclosure may utilize, for example, the asymmetric or non-symmetrical face thickness features described in U.S. Patent App. Pub. 2019/0046845, published Feb. 14, 2019, which is incorporated herein by reference in its entirety. In another example, a composite face plate can be bonded or otherwise affixed to the body 1202.

In addition to those noted above, some examples of metals and metal alloys that can be used to form the components of the club head 1200 described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys. Additional and different materials can be used to form club head components.

Figure 26:
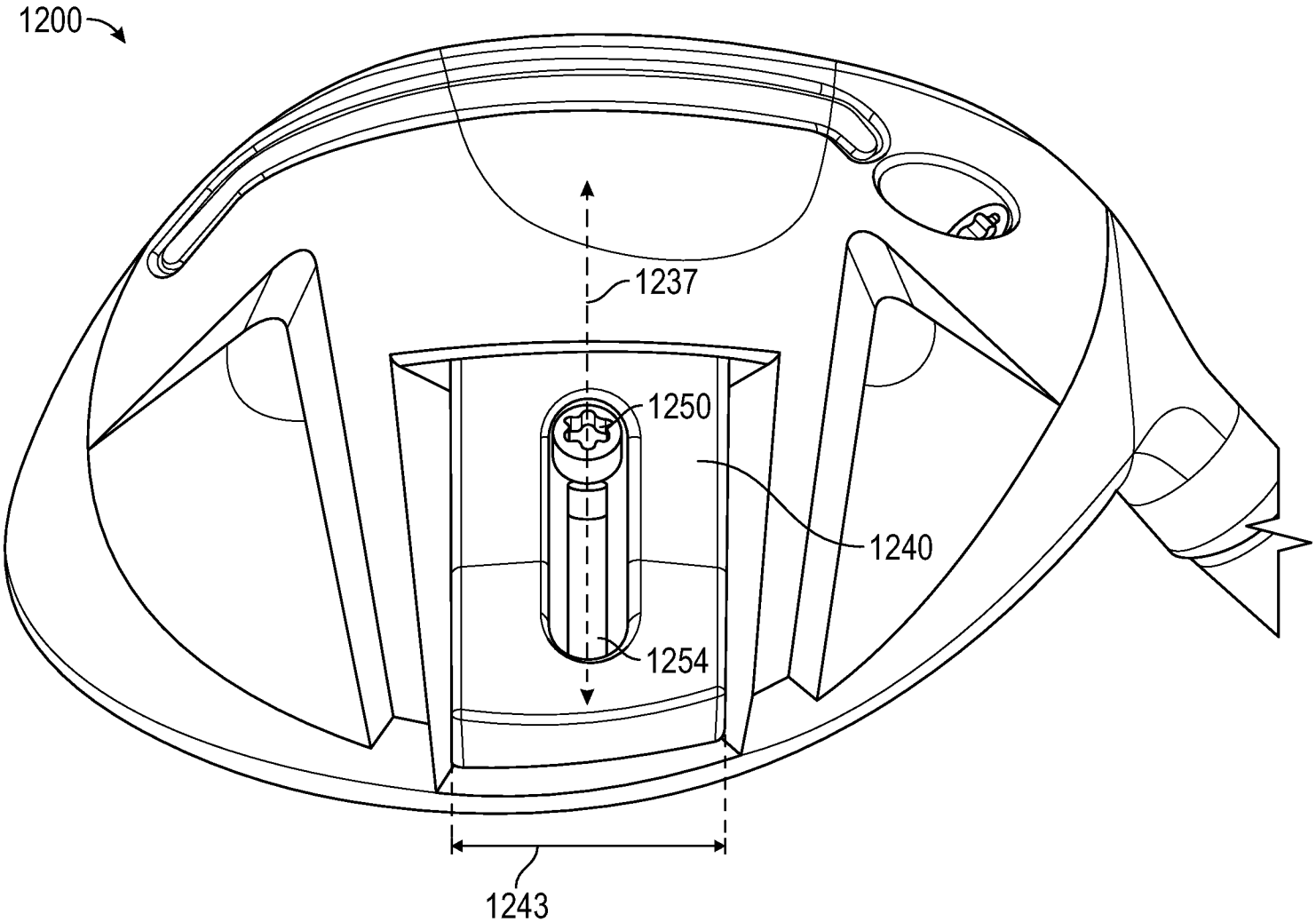
FIG. 26 is a bottom view of the golf club head of FIG. 24, with the weight member positioned in a in a second, rearward position.
Figure 27:
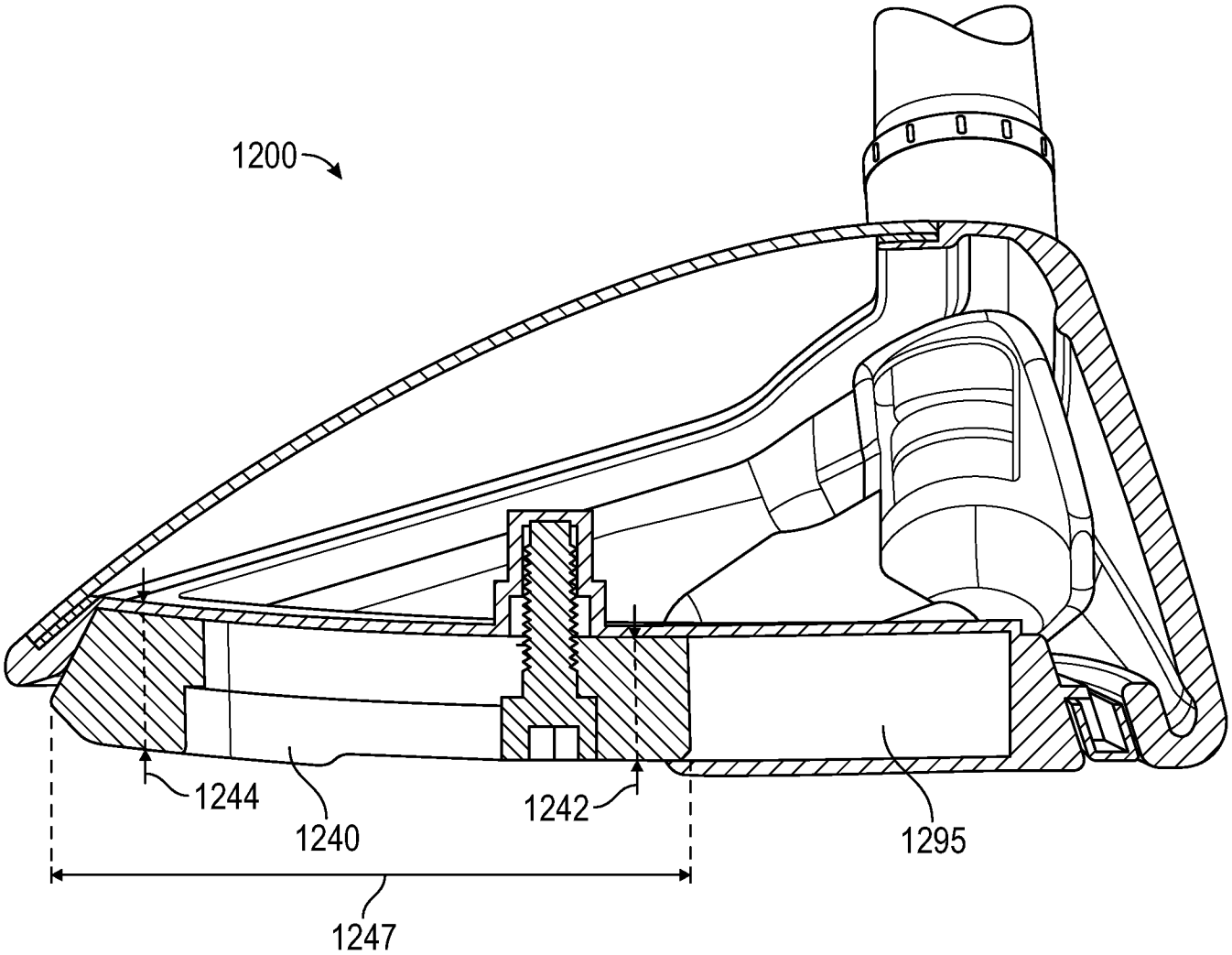
FIG. 27 is a toe-side cross-sectional view of the golf club head of FIG. 26, taken along the path 1237 in FIG. 26, with the weight member positioned in a in a second, rearward position.

FIGS. 26-27 illustrate the golf club head 1200 with the weight member 1240 positioned in a in a second, rearward position. As depicted, the weight member 1240 moves independently of the location of the fastener 1250. For example, the weight member 1240 can be adjusted in conjunction with an adjustable hosel 1262 (e.g., via a shaft connection assembly configured to selectively adjust a loft and/or a lie-angle of the of the golf club 1200).

During club fitting, for example, launch conditions of the club head 1200 can be adjusted by moving the weight member 1240 and/or by adjusting the hosel 1262. The weight member 1240 can be moved forward to decrease spin, decrease dynamic loft, and decrease MOI. With the weight member 1240 in a forward position, distance can be increased, in some cases with a tradeoff in forgiveness. The weight member 1240 can be moved backward to increase spin, increase dynamic loft and increase MOI. With the weight member 1240 in a rearward position, forgiveness can be increased, in some cases with a tradeoff in distance. The hosel 1262 can be adjusted to add loft thereby increasing spin and dynamic loft, or to decrease loft thereby decreasing spin and dynamic loft. For example, loft can be adjusted without impacting on MOI and other properties of the club head.

The weight member 1240 and the hosel 1262 can be adjusted concurrently to adjust spin, loft, dynamic loft, MOI, launch angle, and other launch conditions. For example, with the weight member 1240 in a forward position and the hosel 1262 adjusted to increase loft, distance can be increased by providing for a high launch with low spin. In another example, with the weight member 1240 in a rearward position and the hosel 1262 adjusted to decrease loft, forgiveness can be increased while by providing for a lower launch with more spin. Additional and different combinations of weight member 1240 positions and hosel 1262 adjustments can be provided.

In concurrently adjusting the weight member 1240 and the hosel 1262, the weight member movement in mm can be multiplied by the mass of the weight member and the loft change of the hosel in degrees to provide a weight member value in mm*g*degrees. The weight member 1240 can move between about 10 mm and about 40 mm, preferably between 15 mm and 30 mm. The weight member 1240 can move a total distance that is between about 10% and about 40% of a club head length, more preferably between about 17% and about 35% of a club head length, even more preferably between about 26% and about 32% of a club head length, where the club head length is measured from a leading edge to a trailing edge substantially in a front-back direction or substantially along the y-axis. The weight member 1240 can have a mass between about 35 g and about 90 g, preferably between 50 g and 80 g. The hosel 1262 can be adjusted between about 0.5 degrees and 4 degrees. Thus, the weight member value can be between about 700 mm*g*degrees and about 10,800 mm*g*degrees, preferably between about 2,430 mm*g*degrees and about 7,500 mm*g*degrees.

As discussed herein, changing golf club head mass properties and launch conditions can impact distance and forgiveness of the golf club head 1200. Moving the weight member 1240 forward and backward can adjust the MOI about the CG z-axis (Izz), the CG x-axis (Ixx), the CG z-axis (Zup), and the CG projection on the face 1211 referred to as the balance point up (BP up) of the golf club head 1200. The Izz can be adjusted between about 185 $kg*mm^2$ and about 385 $kg*mm^2$, preferably between 200 $kg*mm^2$ and 315 $kg*mm^2$. The Ixx can be adjusted between about 80 $kg*mm^2$ and about 215 $kg*mm^2$, preferably between 100 $kg*mm^2$ and 200 $kg*mm^2$. A change in Izz from a forward-most position to a rearward-most position can provide a change in Izz that is no less than 30 $kg*mm^2$. The Zup can be adjusted between about 10 mm and about 22 mm, preferably between 11 and 18, even more preferably in at least one weight position no more than 15 mm. The BP up can be adjusted between about 18.0 mm and about 29.0 mm, preferably between 18.5 mm and 25 mm. In some embodiments, the BP projection of the club head 1200 can be between 0 to 4 mm with a large repositionable weight. In some embodiments, the BP projection is between about 0 mm and 2 mm with the weight in a forward position and between about 2 mm and about 4.0 mm with the weight in the rearward position. A maximum change in Zup from a forward position to a rearward position is no more than 2 mm, preferably no more than 1.5 mm, more preferably no more than 1.0 mm. A maximum change in BPup from a forward position to a rearward position is no more than 2 mm, preferably no more than 1.5 mm, more preferably no more than 1.0 mm.

For example, when the weight member 1240 is in a first, forward position, the Zup can be between 11 mm and 18 mm, and the BP up can be between 17.5 mm and 25.0 mm. When the weight member is in a second, rearward position, the Zup can be between 13 mm and 23 mm, and the BP up can be between 21 mm and 29 mm. In this example, moving the weight member 1240 from the first to the second position can shift the center of gravity (CG) by at least 3 mm, preferably between about 3 mm and about 10 mm. In this way, a relatively small movement of the weight member 1240 of between about 10 mm and about 35 mm can produce a relatively large shift in CG.

Referring to FIG. 27, the weight member 1240 may have a forward height 1242 that is less than a rearward height 1244. In some embodiments, the rearward height 1244 is configured to be greater than an internal height of the weight cavity 1295, which can be substantially the same as forward height 1242. The weight member 1240 is elongated in a front to back direction. The forward height 1242 can be between about 4 mm and about 20 mm, preferably between 6 mm and 12 mm. The rearward height 1244 can be between about 4 mm and about 20 mm, preferably between 7 mm and 14 mm. Preferably the rearward height is greater than the forward height. The forward height 1242 can be between about 10% and about 40% a peak crown height of the club head measured from a ground plane to a peak crown height (crown apex) relative to a z-axis, preferably between 13% mm and 31% mm of a peak crown height. The rearward height 1244 can be between about 10% and about 40% a peak crown height, preferably between 13% and 37%. The length 1247 of the weight member 1240 can be between about 30 mm and about 55 mm, preferably between 38 mm and 55 mm. Preferably the length 1247 of the weight member 1240 can be between about 35% and about 65% of a total length of the club head as measured from a leading edge of the club head to a trailing edge of the club head as measured along the y-axis, preferably between 44% and 57%. In some embodiments, the length 1247 of the weight member 1240 is no less than 50% of a total length of the club head. The width 1243 of the weight member 1240 can be between about 10 mm and about 40 mm, preferably between 15 mm and 35 mm, more preferably between 22 mm and 28 mm. In some embodiments, the width 1243 of the weight member 1240 can be between about 15% and 35% of a club head length measured heel to toe per the USGA club head measurement rule, preferably about 20% and 30%, and even more preferably between about 22% and 28% of a club head length. The USGA rule states: "If the club does not have a defined heel, then the toe-heel dimension (length) shall be the distance between parallel planes making contact with the toe of the club (toe plane) and a point 0.875" above the sole (floor plane) of the club on the heel side (heel plane)." R&A Rules Limited and United States Golf Association, PROTOCOL FOR MEASURING THE CLUBHEAD SIZE OF WOOD CLUBS, TPX3003 Rev. 2.1 9 Apr. 2019. USGA rules can be found at the following website: https://www.usga.org/content/dam/usga/pdf/2019/equipment-standards/TPX3003%20Protocol%20for%20Measuring%20the%20Clubhead%20Size%20of%20Wood%20Clubs.pdf, last visited Dec. 17, 2020.

Referring to FIG. 27, when the weight member 1240 is in second, rearward position, at least a portion of the rear surface of the weight member 1240 is configured to engage an inner surface of the rear portion. The inner surface of the rear portion is further configured to act as a back stop for the weight member 1240 in the event that the fastener 1250 loosens or fails. The inner surface of the rear portion is slanted to allow the weight member 1240 to translate rearward as the weight member 1240 is removed and forward as the weight member 1240 is inserted. The weight member 1240 can be provided with a front chamfer on leading edge of the weight member 1240 to assist during weight member 1240 installation and to avoid the leading edge contacting the surfaces of the weight cavity 1295.

Figure 28:
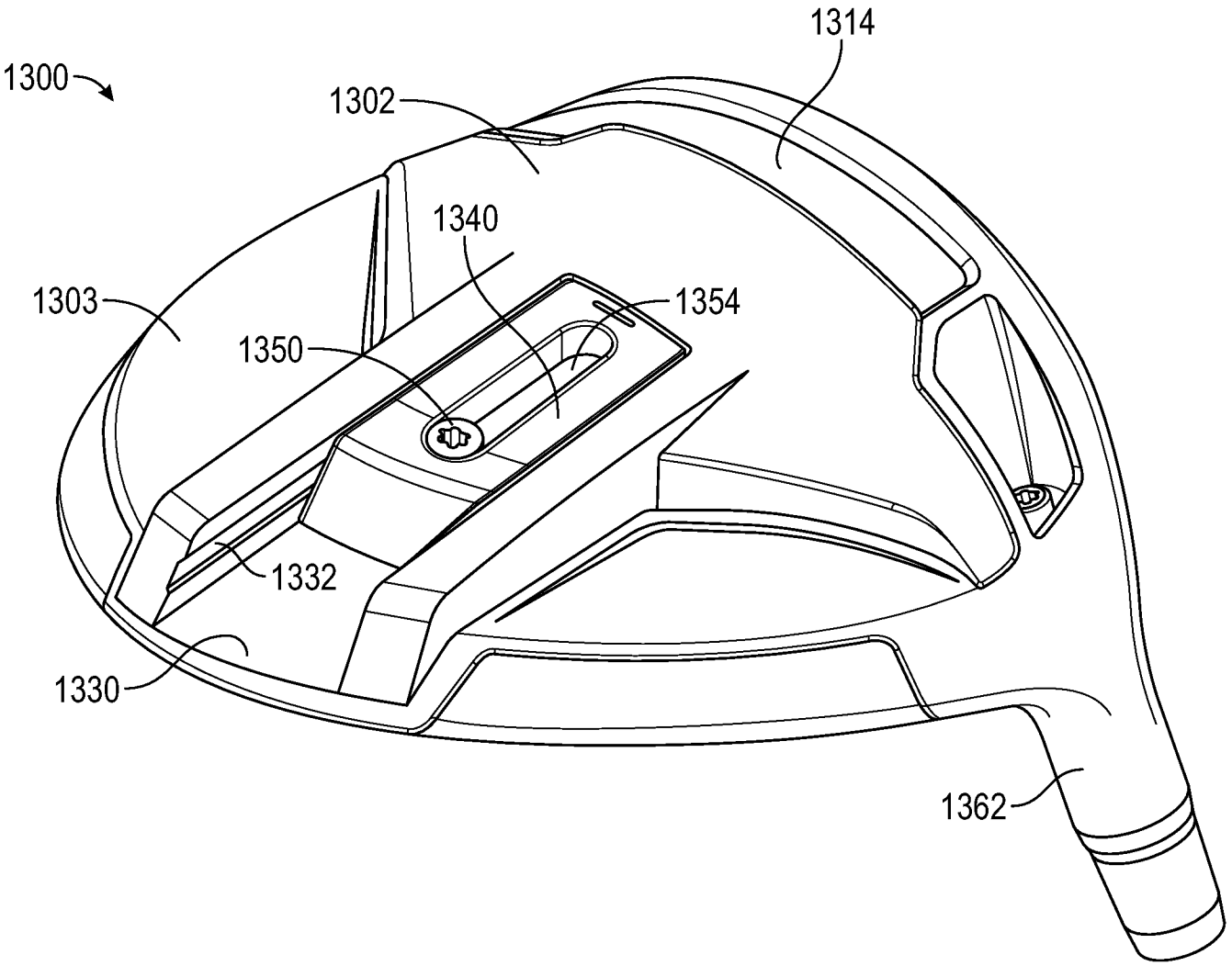
FIG. 28 is a bottom view of another exemplary golf club head disclosed herein, with a weight member positioned in a in a first, forward position.
Figure 29:
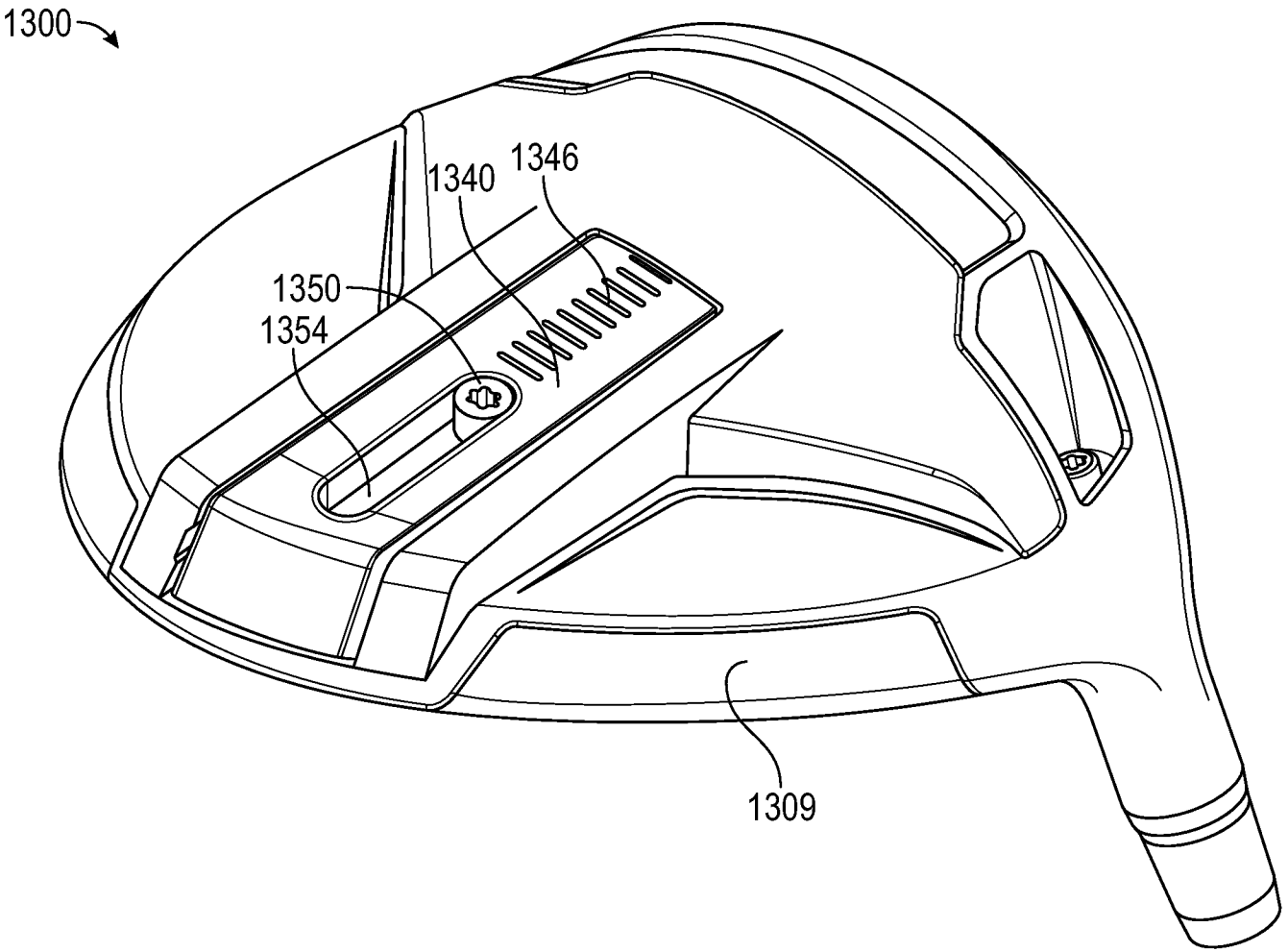
FIG. 29 is a bottom view of the golf club head of FIG. 29, with the weight member positioned in a in a second, rearward position.

FIGS. 28-29 illustrate another exemplary golf club head 1300 that embodies the inventive technologies disclosed herein. The golf club head 1300 is similar to other golf club heads discussed herein. The golf club head 1300 includes a body 1302 with a sole 1303, a hosel 1362, and a front channel 1314. The body 1302 can include a weight channel 1330 configured to receive the repositionable weight member 1340. The weight channel 1330 includes one or more grooves 1332 for engaging the weight member 1340. The weight member 1340 includes one or more corresponding protrusions 1334 (depicted in FIG. 30) to engage the one or more grooves 1332. In some embodiments, the weight member is rotated as the weight member 1340 is inserted in the grooves 1332.

In some embodiments, one or more grooves 1332 (depicted in FIG. 28) are provided in a heel side and/or a toe side of the weight channel 1330. An exemplary toe side groove 1332 is depicted in FIG. 28. Additional and different grooves 1332 can be provided in the weight channel 1330. The one or more grooves 1332 are configured to engage the weight member 1340 to prevent the weight member 1340 from twisting and/or falling out of the weight channel 1330. When adjusted, the weight member 1340 slides along the groove(s) 1332 in a front-to-back path along the sole 1303. The groove(s) 1332 can also provide additional stability to the weight member 1340 when the weight member 1340 is installed, allowing a relatively larger weight member 1340 than could be safely installed with only one or more fasteners 1350. A fastener 1350 can be installed through a weight slot 1354 of the weight member 1340 to secure the weight member 1340 within the weight channel 1330.

In some embodiments, two or more indicators 1346 (depicted in FIG. 29) are provided to indicate the position of the weight member 1340 within the weight channel 1330. For example, each weight indicator 1346 can be provided for a different position of the weight member 1340. Each indicator 1346 can show a set amount of adjustment for the weight member 1340, such as providing an indicator 1346 for each of millimeter of adjustment. In some embodiments, the weight member can be between 50 g and 70 g, preferably about 60 g. In some embodiments, the indicators 1346 indicate the change in CG as a result of adjusting the weight member 1340. In some embodiments, the weight member can move CG by between 2 mm and 6 mm, preferably between 3 mm and 5 mm.

In some embodiments, at least a portion of the composite crown 1309 can wrap into at least a portion of the heel portion (depicted in FIG. 29). In some embodiments, at least a portion of the composite crown 1309 can wrap into at least a portion of the skirt, toe portion, and/or sole portion. In some embodiments, an outermost layer of the composite crown 1309 may be a woven layer. In some embodiments, at least a portion of the composite crown 1309 is formed from carbon. In some embodiments, the weight member 1340 defines at least a portion of the rear member. For example, as depicted in FIG. 29, when the weight member 1340 is in a rearward most position, a rear surface of the weight member 1340 can be flush with the skirt and can at least partially define a rear surface of the rear portion.

Figure 30:
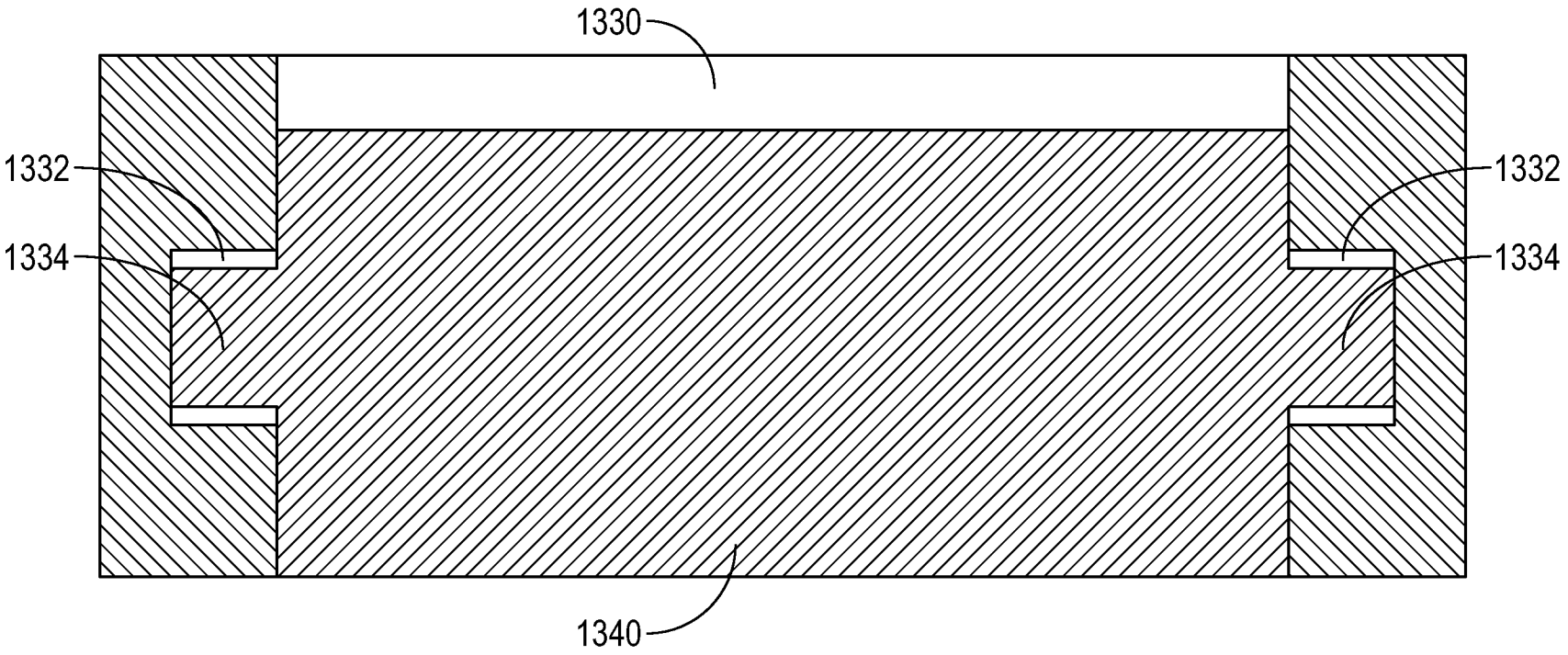
FIG. 30 is a rear cross-sectional view of the weight channel and weight member of the golf club head of FIG. 26.

FIG. 30 is a section view showing one or more grooves 1332 in the weight channel 1330 and one or more weight protrusions 1334 configured to engage the one or more grooves 1332. The section view is taken through a portion of the weight member 1340 outside of the weight slot 1354 where fastener 1350 passes through the weight member 1340.

As depicted in FIG. 30, the weight channel 1330 can include at least two grooves 1332 and at least two protrusions 1334. The one or more weight channel grooves 1332 and corresponding protrusions 1334 on the weight member 1340 are configured to secure the weight member 1340 in the weight channel 1330 when the fastener 1350 is loosened and/or in the unlikely event of the fastener 1350 failing. When the fastener 1350 is loosened or fails, the weight member is configured to remain at least partially secured within the weight channel 1330.

In some embodiments, the one or more grooves 1332 and corresponding protrusions 1334 on the weight member 1340 are configured to provide for a clamping system like the other embodiments discussed herein where a fastener threads into a threaded port to secure the weight member in a desired position. In a clamping system, tightening the fastener 1350 can be configured to pull the weight member 1340 inward toward the interior cavity 1322 (not depicted) of the golf club body 1302 and putting the fastener 1350 in a state of tension.

In some embodiments, the one or more grooves 1332 and corresponding protrusions 1334 on the weight member 1340 are configured to provide a compression system where the fastener 1350 can press against an inner wall of the weight channel 13 (e.g., a lower channel surface 1231 as depicted in FIG. 24), which can eliminate the need for a threaded port 1352 (not depicted) to receive the fastener 1350. In a compressive system, tightening the fastener 1350 is configured to push the weight member 1340 outward away from the interior cavity 1322 and puts the fastener 1350 in a state of compression. A compression system can place some, if not all of the load on the one or more channel grooves 1332 and the one or more protrusions 1334 extending from the weight member 1340 that engage the one or more grooves 1332.

Compression system embodiments can place more load on the bearing surfaces (i.e., the one or more grooves 1332 and the corresponding one or more weight protrusions 1334) and there is a greater likelihood of failure of the bearing surfaces, such as catastrophic failure resulting in the weight member 1340 breaking free from the golf club head 1300. In tension system embodiments, the one or more grooves 1332 can act as a secondary safety mechanism to trap the weight member 1340 within the weight channel 1330 in the unlikely event that the fastener 1350 fails. In some embodiments, a tension system (e.g., using fastener 1350 in tension) can secure a weight member 1340 with greater mass compared to a compression system (e.g., using fastener 1350 in compression) which can secure a weight member with a lesser mass.

Figure 31:
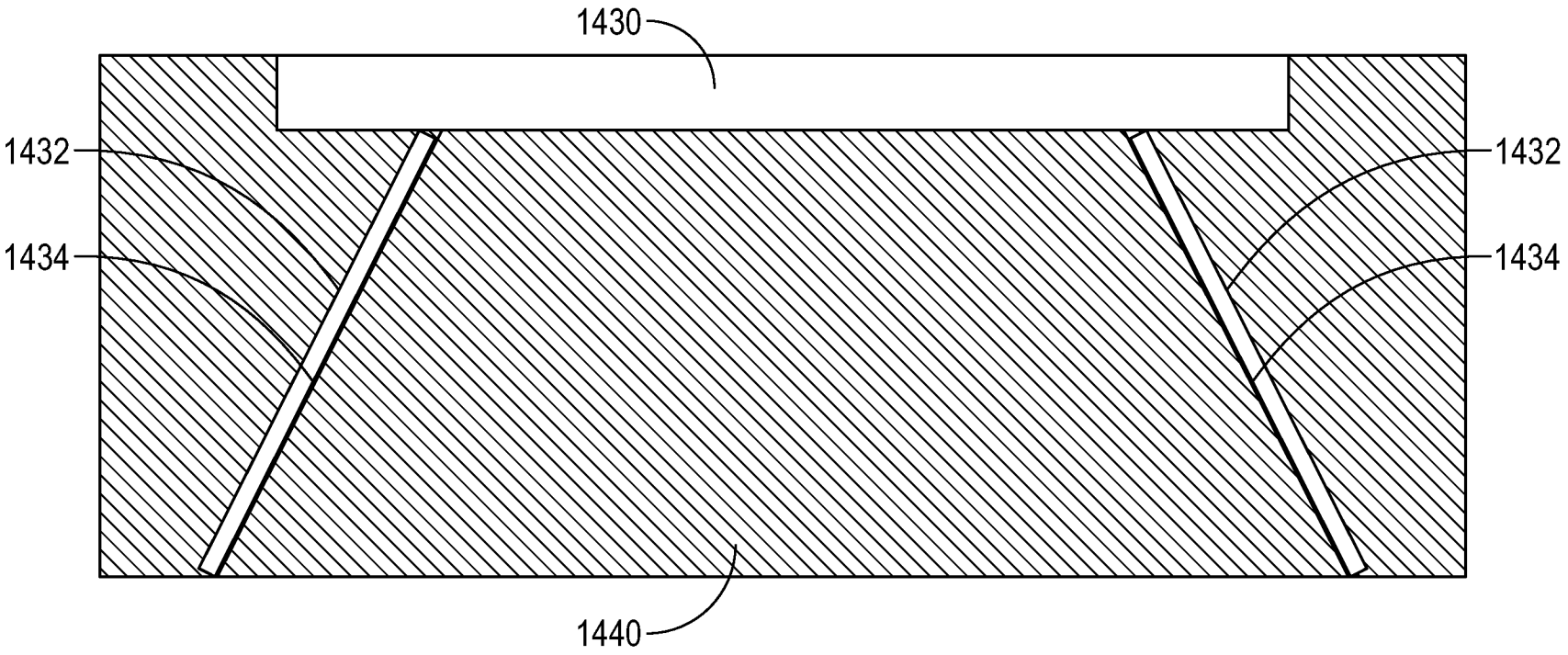
FIG. 31 is a rear cross-sectional view of a weight channel and weight member applicable to the exemplary golf club heads disclosed herein.

FIG. 31 is a section view that is showing one or more ledges 1432 in the weight channel 1430 and the one or more weight surfaces 1434 configured to engage the one or more ledges 1432. The section view is taken through a portion of the weight member 1440 outside of the weight slot 1454 (not depicted) where fastener 1450 (not depicted) passes through the weight member 1440. This weight channel 1430 and weight member 1440 embodiment can be used with the club heads discussed herein, including club heads 1200, 1300, and other exemplary club heads.

As depicted in FIG. 31, the weight channel 1430 can include at least two ledges 1432 and at least two weight surfaces 1434. The one or more weight channel ledges 1432 and corresponding weight surfaces 1434 on the weight member 1440 are configured to secure the weight member 1440 in the weight channel 1430 when the fastener 1450 is loosened and/or in the unlikely event of the fastener 1450 failing. When the fastener 1450 is loosened or fails, the weight member is configured to remain at least partially secured within the weight channel 1430.

In some embodiments, the one or more weight channel ledges 1432 and corresponding weight surfaces 1434 on the weight member 1440 can be configured in a compression system as discussed herein. For example, the one or more weight channel ledges 1432 and corresponding weight surfaces 1434 on the weight member 1440 may be superior to the one or more grooves 1332 and corresponding protrusions 1334 on the weight member 1340 depicted in FIG. 30 provided in a compression system because one or more weight channel ledges 1432 and corresponding weight surfaces 1434 on the weight member 1440 have fewer failure points on the bearing surfaces (e.g., the groove and/or protrusions shearing or breaking off). The one or more weight channel ledges 1432 and corresponding weight surfaces 1434 on the weight member 1440 can also provide a greater surface area of contact for the compression. In other embodiments, the one or more weight channel ledges 1432 and corresponding weight surfaces 1434 on the weight member 1440 can be configured in a tension system as discussed herein.

Additional club head features are disclosed in U.S. Pat. No. 10,773,135, filed Aug. 28, 2019, issued Sep. 15, 2020, which is incorporated herein by reference in its entirety.

Design Parameters for Golf Club Heads with Slidably Repositionable Weight(s)

Although the following discussion cites features related to golf club head 100 and its variations (e.g. 400, 500, 1100, 1200), the many design parameters discussed below substantially apply to golf club heads 600 and 700 due to the common features of the club heads. With that in mind, in some embodiments of the golf clubs described herein, the location, position or orientation of features of the golf club head, such as the golf club head 100, 400, 500, 600, 700, 1100 and 1200, can be referenced in relation to fixed reference points, e.g., a golf club head origin, other feature locations or feature angular orientations. The location or position of a weight or weight assembly, such as the weight member 140, 440, 640, 740, 1140 and 1240 is typically defined with respect to the location or position of the weight's or weight assembly's center of gravity. When a weight or weight assembly is used as a reference point from which a distance, i.e., a vectorial distance (defined as the length of a straight line extending from a reference or feature point to another reference or feature point) to another weight or weight assembly location is determined, the reference point is typically the center of gravity of the weight or weight assembly.

The location of the weight assembly on a golf club head can be approximated by its coordinates on the head origin coordinate system. The head origin coordinate system includes an origin at the ideal impact location of the golf club head, which is disposed at the geometric center of the striking surface 105 (see FIGS. 1A and 1B). As described above, the head origin coordinate system includes an x-axis and a y-axis. The origin x-axis extends tangential to the face plate at the origin and generally parallel to the ground when the head is ideally positioned with the positive x-axis extending from the origin towards a heel of the golf club head and the negative x-axis extending from the origin to the toe of the golf club head. The origin y-axis extends generally perpendicular to the origin x-axis and parallel to the ground when the head is ideally positioned with the positive y-axis extending from the head origin towards the rear portion of the golf club. The head origin can also include an origin z-axis extending perpendicular to the origin x-axis and the origin y-axis and having a positive z-axis that extends from the origin towards the top portion of the golf club head and negative z-axis that extends from the origin towards the bottom portion of the golf club head.

As described above, in some of the embodiments of the golf club head 100 described herein, the weight channel 130 extends generally from a heelward end 136 oriented toward the heel side 106 of the golf club head to a toeward end 138 oriented toward the toe side 108 of the golf club head, with both the heelward end 136 and toeward end 138 being at or near the same distance from the front portion of the club head. As a result, in these embodiments, the weight member 140 that is slidably retained within the weight channel 130 is capable of a relatively large amount of adjustment in the direction of the x-axis, while having a relatively small amount of adjustment in the direction of the y-axis. In some alternative embodiments, the heelward end 136 and toeward end 138 may be located at varying distances from the front portion, such as having the heelward end 136 further rearward than the toeward end 138, or having the toeward end 138 further rearward than the heelward end 136. In these alternative embodiments, the weight member 140 that is slidably retained within the weight channel 130 is capable of a relatively large amount of adjustment in the direction of the x-axis, while also having from a small amount to a larger amount of adjustment in the direction of the y-axis.

For example, in some embodiments of a golf club head 100 having a weight member 140 that is adjustably positioned within a weight channel 130, the weight member 140 can have an origin x-axis coordinate between about −40 mm and about 40 mm, depending upon the location of the weight assembly within the weight channel 130. In specific embodiments, the weight member 140 can have an origin x-axis coordinate between about −35 mm and about 35 mm, or between about −30 mm and about 30 mm, or between about −25 mm and about 25 mm, or between about −20 mm and about 20 mm, or between about −15 mm and about 15 mm, or between about −13 mm and about 13 mm. Thus, in some embodiments, the weight member 140 is provided with a maximum x-axis adjustment range (Max Δx) that is less than 80 mm, such as less than 70 mm, such as less than 60 mm, such as less than 50 mm, such as less than 40 mm, such as less than 30 mm, such as less than 26 mm.

On the other hand, in some embodiments of the golf club head 100 having a weight member 140 that is adjustably positioned within a weight channel 130, the weight member 140 can have an origin y-axis coordinate between about 5 mm and about 80 mm. More specifically, in certain embodiments, the weight member 140 can have an origin y-axis coordinate between about 5 mm and about 50 mm, between about 5 mm and about 45 mm, or between about 5 mm and about 40 mm, or between about 10 mm and about 40 mm, or between about 5 mm and about 35 mm. Additionally or alternatively, in certain embodiments, the weight member 140 can have an origin y-axis coordinate between about 35 mm and about 80 mm, between about 45 mm and about 75 mm, or between about 50 mm and about 70 mm. Thus, in some embodiments, the weight member 140 is provided with a maximum y-axis adjustment range (Max Δy) that is less than 45 mm, such as less than 30 mm, such as less than 20 mm, such as less than 10 mm, such as less than 5 mm, such as less than 3 mm. Additionally or alternatively, in some embodiments having a rearward channel, the weight member is provided with a maximum y-axis adjustment range (Max Δy) that is less than 110 mm, such as less than 80 mm, such as less than 60 mm, such as less than 40 mm, such as less than 30 mm, such as less than 15 mm.

In some embodiments, a golf club head can be configured to have a constraint relating to the relative distances that the weight assembly can be adjusted in the origin x-direction and origin y-direction. Such a constraint can be defined as the maximum y-axis adjustment range (Max Δy) divided by the maximum x-axis adjustment range (Max Δx). According to some embodiments, the value of the ratio of (Max Δy)/(Max Δx) is between 0 and about 0.8. In specific embodiments, the value of the ratio of (Max Δy)/(Max Δx) is between 0 and about 0.5, or between 0 and about 0.2, or between 0 and about 0.15, or between 0 and about 0.10, or between 0 and about 0.08, or between 0 and about 0.05, or between 0 and about 0.03, or between 0 and about 0.01.

As discussed above, in some driver-type golf club head embodiments, the mass of the weight member, e.g. weight member 640 and/or weight member 740, is between about 1 g and about 50 g, such as between about 3 g and about 40 g, such as between about 5 g and about 25 g. In some alternative embodiments, the mass of the weight member 640 and/or 740 is between about 5 g and about 45 g, such as between about 9 g and about 35 g, such as between about 9 g and about 30 g, such as between about 9 g and about 25 g.

As discussed above, in some fairway-type golf club head embodiments, the mass of the weight member, e.g., weight member 140, is between about 50 g and about 90 g, such as between about 55 g and about 80 g, such as between about 60 g and about 75 g. In some alternative embodiments, the mass of the weight member 140 is between about 5 g and about 45 g, such as between about 9 g and about 35 g, such as between about 9 g and about 30 g, such as between about 9 g and about 25 g.

In some embodiments, a golf club head can be configured to have constraints relating to the product of the mass of the weight assembly and the relative distances that the weight assembly can be adjusted in the origin x-direction and/or origin y-direction. One such constraint can be defined as the mass of the weight assembly ($M_{WA}$) multiplied by the maximum x-axis adjustment range (Max Δx). According to some embodiments, the value of the product of $M_{WA}$×(Max Δx) is between about 250 g·mm and about 4950 g·mm. In specific embodiments, the value of the product of $M_{WA}$×(Max Δx) is between about 500 g·mm and about 4950 g·mm, or between about 1000 g·mm and about 4950 g·mm, or between about 1500 g·mm and about 4950 g·mm, or between about 2000 g·mm and about 4950 g·mm, or between about 2500 g·mm and about 4950 g·mm, or between about 3000 g·mm and about 4950 g·mm, or between about 3500 g·mm and about 4950 g·mm, or between about 4000 g·mm and about 4950 g·mm.

According to some embodiments, the value of the product of $M_{WA}$×(Max Δx) is between about 250 g·mm and about 2500 g·mm. In specific embodiments, the value of the product of $M_{WA}$×(Max Δx) is between about 350 g·mm and about 2400 g·mm, or between about 750 g·mm and about 2300 g·mm, or between about 1000 g·mm and about 2200 g·mm, or between about 1100 g·mm and about 2100 g·mm, or between about 1200 g·mm and about 2000 g·mm, or between about 1200 g·mm and about 1950 g·mm, or between about 1250 g·mm and about 1900 g·mm, or between about 1250 g·mm and about 1750 g·mm.

Another constraint relating to the product of the mass of the weight assembly and the relative distances that the weight assembly can be adjusted in the origin x-direction and/or origin y-direction can be defined as the mass of the weight assembly ($M_{WA}$) multiplied by the maximum y-axis adjustment range (Max Δy). According to some embodiments, the value of the product of $M_{WA}$×(Max Δy) is between about 0 g·mm and about 1800 g·mm. In specific embodiments, the value of the product of $M_{WA}$×(Max Δy) is between about 0 g·mm and about 1500 g·mm, or between about 0 g·mm and about 1000 g·mm, or between about 0 g·mm and about 500 g·mm, or between about 0 g·mm and about 250 g·mm, or between about 0 g·mm and about 150 g·mm, or between about 0 g·mm and about 100 g·mm, or between about 0 g·mm and about 50 g·mm, or between about 0 g·mm and about 25 g·mm.

As noted above, one advantage obtained with a golf club head having a repositionable weight, such as the golf club head 100 having the weight member 140, is in providing the end user of the golf club with the capability to adjust the location of the CG of the club head over a range of locations relating to the position of the repositionable weight. In particular, the present inventors have found that there is a distance advantage to providing a center of gravity of the club head that is lower and more forward relative to comparable golf clubs that do not include a weight assembly such as the weight member 140 described herein.

In some embodiments, the golf club head 100 has a CG with a head origin x-axis coordinate (CGx) between about −10 mm and about 10 mm, such as between about −4 mm and about 9 mm, such as between about −3 mm and about 8 mm, such as between about −2 mm to about 5 mm, such as between about −0.8 mm to about 8 mm, such as between about 0 mm to about 8 mm. In some embodiments, the golf club head 100 has a CG with a head origin y-axis coordinate (CGy) greater than about 15 mm and less than about 50 mm, such as between about 22 mm and about 43 mm, such as between about 24 mm and about 40 mm, such as between about 26 mm and about 35 mm. In some embodiments, the golf club head 100 has a CG with a head origin z-axis coordinate (CGz) greater than about −8 mm and less than about 3 mm, such as between about −6 mm and about 0 mm. In some embodiments, the golf club head 100 has a CG with a head origin z-axis coordinate (CGz) that is less than 0 mm, such as less than −2 mm, such as less than −4 mm, such as less than −5 mm, such as less than −6 mm.

As described herein, by repositioning the weight member 140 within the weight channel 130 of the golf club head 100, the location of the CG of the club head is adjusted. For example, in some embodiments of a golf club head 100 having a weight member 140 that is adjustably positioned within a weight channel 130, the club head is provided with a maximum CGx adjustment range (Max ΔCGx) attributable to the repositioning of the weight member 140 that is greater than 1 mm, such as greater than 2 mm, such as greater than 3 mm, such as greater than 4 mm, such as greater than 5 mm, such as greater than 6 mm, such as greater than 8 mm, such as greater than 10 mm, such as greater than 11 mm.

Moreover, in some embodiments of the golf club head 100 having a weight member 140 that is adjustably positioned within a weight channel 130, the club head is provided with a CGy adjustment range (Max ΔCGy) that is less than 6 mm, such as less than 3 mm, such as less than 1 mm, such as less than 0.5 mm, such as less than 0.25 mm, such as less than 0.1 mm.

Additionally or alternatively, in some embodiments of the golf club head 100 having a weight member 140 that is adjustably positioned within a rearward channel, the club head is provided with a CGy adjustment range (Max ΔCGy) that is less than 10 mm, such as less than 5 mm, such as less than 3 mm, such as less than 1 mm, such as less than 0.5 mm, such as less than 0.25 mm, such as less than 0.1 mm.

In some embodiments, a golf club head can be configured to have a constraint relating to the relative amounts that the CG is able to be adjusted in the origin x-direction and origin y-direction. Such a constraint can be defined as the maximum CGy adjustment range (Max ΔCGy) divided by the maximum CGx adjustment range (Max ΔCGx). According to some embodiments, the value of the ratio of (Max ΔCGy)/(Max ΔCGx) is between 0 and about 0.8. In specific embodiments, the value of the ratio of (Max ΔCGy)/(Max ΔCGx) is between 0 and about 0.5, or between 0 and about 0.2, or between 0 and about 0.15, or between 0 and about 0.10, or between 0 and about 0.08, or between 0 and about 0.05, or between 0 and about 0.03, or between 0 and about 0.01.

In some embodiments, a golf club head can be configured such that only one of the above constraints apply. In other embodiments, a golf club head can be configured such that more than one of the above constraints apply. In still other embodiments, a golf club head can be configured such that all of the above constraints apply.

Table 3 below lists various properties of an exemplary golf club head, which may be similar to golf club head 100, having a weight assembly retained within a front channel.

TABLE 3

| Property | Value in Exemplary Golf Club Head |
|---|---|
| Slidable weight assembly (g) | 66 |
| volume (cc) | 150 |
| delta1 (mm) | 10.7-11.0 |
| max CGx (mm) | 5.3 |
| min CGx (mm) | 0.3 |
| max CGz (mm) | 13.1 Zup |
| min CGz (mm) | 13.1 Zup |
| max CGy (mm) | 11.0 Delta1 |
| min CGy (mm) | 10.7 Delta1 |
| distance of weight assembly to striking face (mm) | From center face to CG of weight assembly: ~31 mm. From leading edge to most forward portion of weight assembly: ~17 mm |
| channel length (mm) | ~81 mm |
| channel width (mm) | ~40 mm |
| channel depth (mm) | ~12 mm |
| Izz (kg · mm$^2$) | 209 kg · mm$^2$ |
| Ixx (kg · mm$^2$) | 93 kg · mm$^2$ |

Table 4 below lists various properties of an exemplary golf club head, which may be similar to golf club head 100, having a weight assembly retained within a front channel, and located at center, toe, and heel positions, respectively:

TABLE 4

| Property | Value in Exemplary Golf Club Head | | |
|---|---|---|---|
| | Center | Toe | Heel |
| CGx (mm) | 2.8 | 0.3 | 5.3 |
| Zup (mm) | 13.1 | 13.1 | 13.1 |
| Delta 1 (mm) | 10.7 | 11.0 | 11.0 |
| Balance Point Up (mm) | 19.532 | 19.684 | 19.732 |
| CGx Delta (mm) | | −2.5 | 2.5 |
| BP Delta (mm) | | 0.152 | 0.200 |
| BP Delta/CGx Delta (mm/mm) | | **−0.061** | **0.080** |
| Absolute value BP Delta/CGx Delta (mm/mm) | | **0.061** | **0.080** |

In table 4 above, BP Delta or Balance Point Up Delta represents the change in the Balance Point Up relative to the Balance Point Up when the weight is in the center position. For example, when the weight is in toewardmost position the Balance Point Up is 19.684 mm compared to 19.532 mm in the center position resulting in a delta or change of 0.152 mm. Similarly, in the heel position the BP Delta is 0.200 mm (19.732 mm-19.532 mm). BP Delta/CGx Delta (mm/mm) is again calculated relative to the center position. For example, BP Delta for the heelwardmost position relative to center is 0.200 mm and the CGx delta from center to heel is 2.5 mm (5.3 mm-2.8 mm) resulting in a ratio of 0.08. It was found that this track configuration produced a very large CGx movement with very little impact to Balance Point Up, which was lacking in earlier designs.

In some embodiments described herein, BP Delta in a toewardmost position is no more than 0.50 mm, and is between 0.12 mm and 0.50 mm, such as between 0.13 mm and 0.40 mm, such as between 0.14 mm and 0.30 mm. In some embodiments described herein, BP Delta in a heelwardmost position is no more than 0.30 mm, and is between 0.12 mm and 0.30 mm, such as between 0.13 mm and 0.25 mm, such as between 0.15 mm and 0.25 mm.

In some embodiments described herein, a BP Delta/CGx Delta (mm/mm) when the weight is in the toewardmost position is no more than 0.170 (absolute value). More specifically, the BP Delta/CGx Delta for the toewardmost position relative the center position can be between 0.170 (absolute value) and 0.040 (absolute value). In some embodiments described herein, a BP Delta/CGx Delta (mm/mm) when the weight is in the heelwardmost position is no more than 0.120 (absolute value). More specifically, the BP Delta/CGx Delta for the heelwardmost position relative the center position can be between 0.120 (absolute value) and 0.060 (absolute value). In some embodiments described herein, the summation of the BP Delta/CGx Delta (mm/mm) in the toewardmost position (absolute value) and the BP Delta/CGx Delta (mm/mm) in the heelwardmost position (absolute value) is no more than 0.29, and is between 0.11 and 0.29, such as between 0.12 and 0.28, such as between 0.13 and 0.25. Unexpectedly, the location of the weight bearing channel in the front portion of the club head can lead to synergies in golf club performance. First, because $\Delta_1$ (delta 1) is relatively small, dynamic lofting is reduced; thereby reducing spin that otherwise may reduce distance. Additionally, because the projection of the CG is below the center-face, the gear effect biases the golf ball to rotate toward the projection of the CG—or, in other words, with forward spin. This is countered by the loft of the golf club head imparting back spin. The overall effect is a relatively low spin profile. However, because the CG is below the center face (and, thereby, below the ideal impact location) as measured along the z-axis, the golf ball will tend to rise higher on impact. The result is a high launching but lower spinning golf shot on purely struck shots, which leads to better ball flight (higher and softer landing) with more distance due to less energy loss from spin.

The distance between weight channels/weight ports and weight size can contribute to the amount of CG change made possible in a golf club head, particularly in a golf club head used in conjunction with a removable sleeve assembly, as described above.

In some exemplary embodiments of a golf club head having two, three or four weights, a maximum weight mass multiplied by the distance between the maximum weight and the minimum weight is between about 100 g·mm and about 3,750 g·mm or about 200 g·mm and 2,000 g·mm. More specifically, in certain embodiments, the maximum weight mass multiplied by the weight separation distance is between about 500 g·mm and about 1,500 g·mm, between about 1,200 g·mm and about 1,400 g·mm.

When a weight or weight port is used as a reference point from which a distance, i.e., a vectorial distance (defined as the length of a straight line extending from a reference or feature point to another reference or feature point) to another weight or weights port is determined, the reference point is typically the volumetric centroid of the weight port. When a movable weight club head and sleeve assembly are combined, it is possible to achieve the highest level of club trajectory modification while simultaneously achieving the desired look of the club at address. For example, if a player prefers to have an open club face look at address, the player can put the club in the "R" or open face position. If that player then hits a fade (since the face is open) shot but prefers to hit a straight shot, or slight draw, it is possible to take the same club and move the heavy weight to the heel port to promote draw bias. Therefore, it is possible for a player to have the desired look at address (in this case open face) and the desired trajectory (in this case straight or slight draw).

In yet another advantage, by combining the movable weight concept with an adjustable sleeve position (effecting loft, lie and face angle) it is possible to amplify the desired trajectory bias that a player may be trying to achieve.

For example, if a player wants to achieve the most draw possible, the player can adjust the sleeve position to be in the closed face position or "L" position and also put the heavy weight in the heel port. The weight and the sleeve position work together to achieve the greater draw bias possible. On the other hand, to achieve the greatest fade bias, the sleeve position can be set for the open face or "R" position and the heavy weight is placed in the top port.

As described above, the combination of a large CG change (measured by the heaviest weight multiplied by the distance between the ports) and a large loft change (measured by the largest possible change in loft between two sleeve positions, Δloft) results in the highest level of trajectory adjustability. Thus, a product of the distance between at least two weight ports, the maximum weight, and the maximum loft change is important in describing the benefits achieved by the embodiments described herein.

In one embodiment, the product of the distance between at least two weight ports, the maximum weight, and the maximum loft change is between about 50 mm·g·deg and about 8,000 mm·g·deg, preferably between about 2000 mm·g·deg and about 6,000 mm·g·deg, more preferably between about 2500 mm·g·deg and about 4,500 mm·g·deg, or even more preferably between about 3000 mm·g·deg and about 4,100 mm·g·deg. In other words, in certain embodiments, the golf club head satisfies the following expressions in Equations 4-7. Notably, the maximum loft change may vary between 2-4 degrees, and the preferred embodiment having a maximum loft change of 4 degrees or ±2 degrees.

$$50\ \text{mm·g·degrees} < Dwp \cdot Mhw \cdot \Delta\text{loft} < 8{,}000\ \text{mm·g·degrees} \quad (4)$$

$$2000\ \text{mm·g·degrees} < Dwp \cdot Mhw \cdot \Delta\text{loft} < 6{,}000\ \text{mm·g·degrees} \quad (5)$$

$$2500\ \text{mm·g·degrees} < Dwp \cdot Mhw \cdot \Delta\text{loft} < 4{,}500\ \text{mm·g·degrees} \quad (6)$$

$$3000\ \text{mm·g·degrees} < Dwp \cdot Mhw \cdot \Delta\text{loft} < 4{,}100\ \text{mm·g·degrees} \quad (7)$$

In the above expressions, Dwp, is the distance between two weight port centroids (mm), Mhw, is the mass of the heaviest weight (g), and Δloft is the maximum loft change (degrees) between at least two sleeve positions. A golf club head within the ranges described above will ensure the highest level of trajectory adjustability.

Additional disclosure regarding providing both a movable weight and an adjustable shaft assembly to a golf club head can be found in U.S. Pat. No. 8,622,847, the entire contents of which are incorporated by reference.

According to some exemplary embodiments of a golf club head described herein, head an areal weight, i.e., material density multiplied by the material thickness, of the golf club head sole, crown and skirt, respectively, is less than about 0.45 g/cm2 over at least about 50% of the surface area of the respective sole, crown and skirt. In some specific embodiments, the areal weight is between about 0.05 g/cm$^2$ and about 0.15 g/cm$^2$, between about 0.10 g/cm$^2$ and about 0.20 g/cm$^2$ between about 0.15 g/cm$^2$ and about 0.25 g/cm$^2$, between about 0.25 g/cm$^2$ and about 0.35 g/cm$^2$ between about 0.35 g/cm$^2$ and about 0.45 g/cm$^2$, or between about 0.45 g/cm$^2$ and about 0.55 g/cm$^2$.

According to some exemplary embodiments of a golf club head described herein, the head comprises a skirt with a thickness less than about 0.8 mm, and the head skirt areal weight is less than about 0.41 g/cm$^2$ over at least about 50% of the surface area of the skirt. In specific embodiments, the skirt areal weight is between about 0.15 g/cm$^2$ and about 0.24 g/cm$^2$, between about 0.24 g/cm$^2$ and about 0.33 g/cm$^2$ or between about 0.33 g/cm$^2$ and about 0.41 g/cm$^2$.

Some of the exemplary golf club heads described herein can be configured to have a constraint defined as the moment of inertia about the golf club head CG x-axis (Ixx) multiplied by the total movable weight mass. According to some embodiments, the second constraint is between about 1.4 kg$^2$·mm$^2$ and about 40 kg$^2$·mm$^2$. In certain embodiments, the second constraint is between about 1.4 kg$^2$·mm$^2$ and about 2.0 kg$^2$·mm$^2$, between about 2.0 kg$^2$·mm$^2$ and about 10 kg$^2$·mm$^2$ or between about 10 kg$^2$·mm$^2$ and about 40 kg$^2$·mm$^2$.

Some of the exemplary golf club heads described herein can be configured to have another constraint defined as the moment of inertia about the golf club head CG z-axis (Izz) multiplied by the total movable weight mass. According to some embodiments, the fourth constraint is between about 2.5 kg$^2$·mm$^2$ and about 72 kg$^2$·mm$^2$. In certain embodiments, the fourth constraint is between about 2.5 kg$^2$·mm$^2$ and about 3.6 kg$^2$·mm$^2$ between about 3.6 kg$^2$·mm$^2$ and about 18 kg$^2$·mm$^2$ or between about 18 kg$^2$·mm$^2$ and about 72 kg$^2$·mm$^2$.

In some embodiments described herein, a moment of inertia about a golf club head CG z-axis (Izz) can be greater than about 190 kg·mm$^2$. More specifically, the moment of inertia about head CG z-axis 203 can be between about 190 kg·mm$^2$ and about 300 kg·mm$^2$, between about 300 kg·mm$^2$ and about 350 kg·mm$^2$, between about 350 kg·mm$^2$ and about 400 kg·mm$^2$, between about 400 kg·mm$^2$ and about 450 kg·mm$^2$, between about 450 kg·mm$^2$ and about 500 kg·mm$^2$ or greater than about 500 kg·mm$^2$.

In some embodiments described herein, a moment of inertia about a golf club head CG x-axis (Ixx) can be greater than about 80 kg·mm$^2$. More specifically, the moment of inertia about the head CG x-axis can be between about 80 kg·mm$^2$ and about 180 kg·mm$^2$, between about 180 kg·mm$^2$ and about 250 kg·mm$^2$ between about 250 kg·mm$^2$ and about 300 kg·mm$^2$, between about 300 kg·mm$^2$ and about 350 kg·mm$^2$, between about 350 kg·mm$^2$ and about 400 kg·mm$^2$, or greater than about 400 kg·mm$^2$.

Additional disclosure regarding areal weight and calculating values for moments of inertia providing both a movable weight and an adjustable shaft assembly to a golf club head can be found in U.S. Pat. No. 7,963,861, the entire contents of which are incorporated by reference.

Additional Embodiments with Slidably Respositional Weights

Figure 32:
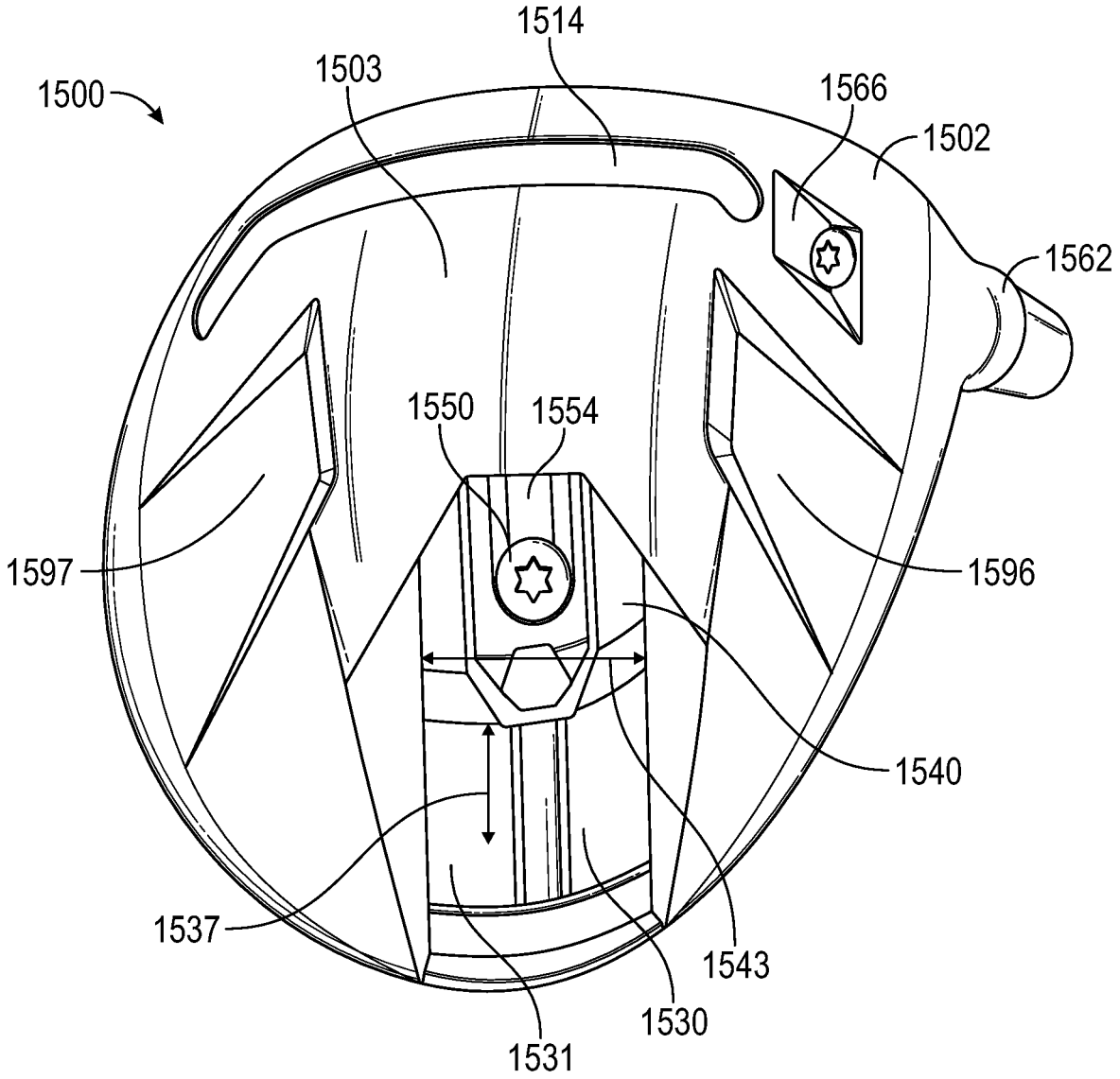
FIG. 32 is a bottom view of an exemplary golf club head having a front-rear adjustable weight that is partially covered.

FIG. 32 shows a bottom view of an exemplary golf club head 1500 that has a forward/rearward sliding weight with a stationary weight fastener on the sole of the club head, similar to the club heads 1200 and 1300. The club head 1500 can have any of the properties and features described herein with regard to the club heads 1200 and 1300.

The club head 1500 can comprise a body 1502 having a sole portion 1503, a forward sole slot 1514 just behind the bottom of the face, a hosel 1562 and a hosel recess 1566 for fastening a shaft to the club head. The body 1502 can also include recessed sole portions 1596, 1597 at the heel and toe sides of the sole.

The club head 1500 can comprise a weight 1540 that has a slot 1554 and a stationary fastener 1550 that extends through the slot and fastens to the body 1502. The weight can be relatively large like the weight 1240, having a width 1543 similar to the width 1243. The weight 1540 is positioned along a track 1530 having a surface 1531 that the weight moves along in a forward-rearward direction. The slot 1554 is oriented in the forward-rearward direction and defines the maximum extent the weight 1540 can move. The fastener 1550 contacts the rear end of the slot 1554 (as shown) when the weight is in its forwardmost position, and contacts the front end of the slot when the weight is in its rearwardmost position.

The forward part of the weight 1540 is covered by the sole portion 1503, while the rearward part of the weight is exposed behind the sole portion. The lateral sides of the weight 1540 can be at least partially covered by rearward portions of the body bordering the track 1530. A cross-section view of the club head 1500 can look similar to views shown in FIGS. 25 and 27, though the club head can have differences, such as being larger, being a driver vs a fairway for example. In addition to providing mass distribution adjustability, having the forward part of the weight covered by part of the sole portion can provide club head volume variability, as described with the club heads 1200 and 1300, and can also provide an aerodynamic benefit over a more exposed sliding weight design.

Figure 33:
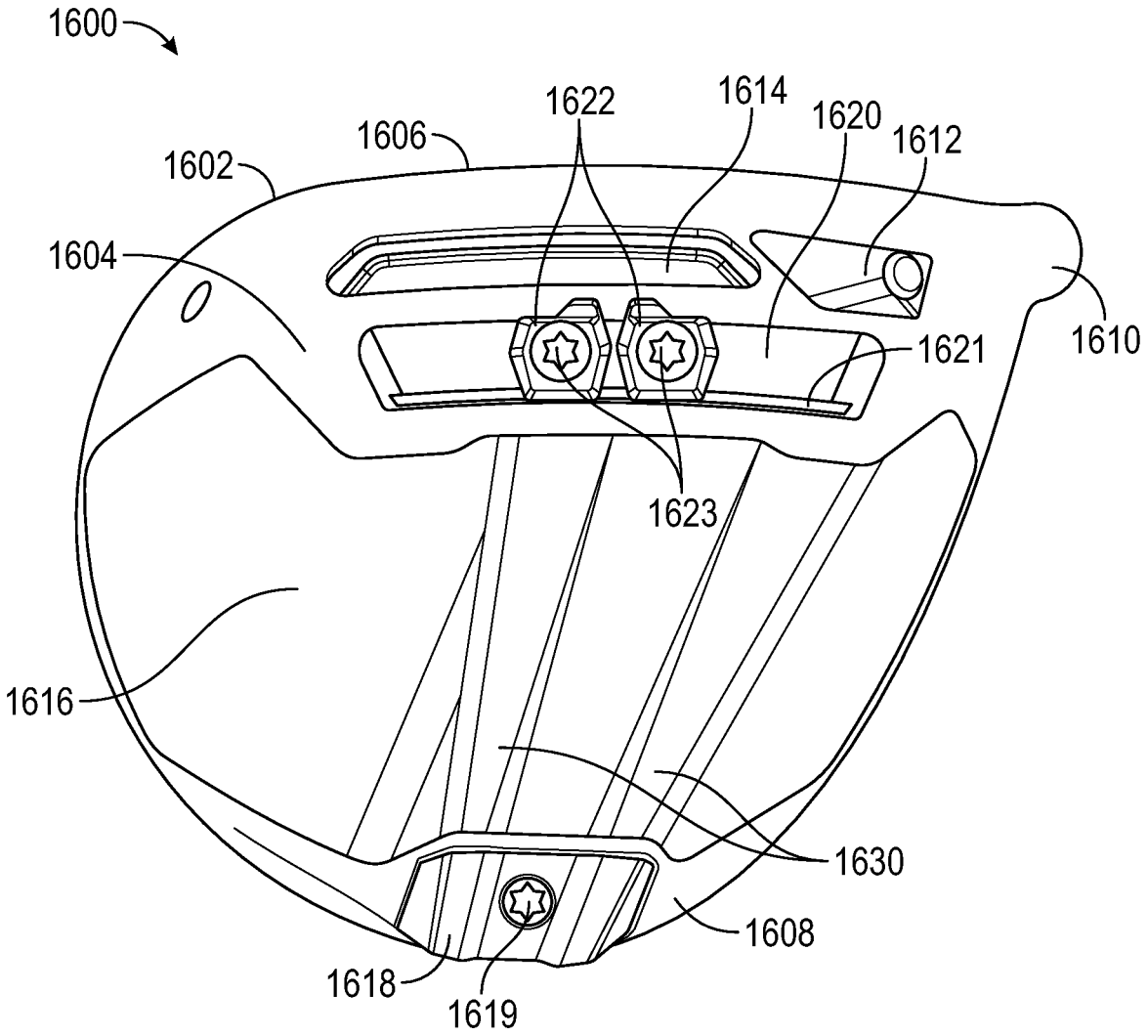
FIG. 33 is a bottom view of an exemplary golf club head having two heel-toe adjustable weights and a stationary rear weight.

FIG. 33 shows a bottom view of an exemplary golf club head 1600 that has two laterally sliding weights and a stationary rear weight. The club head 1600 can comprise a body 1602 having a sole portion 1604, a forward portion 1606, a rear portion 1608, a hosel 1610, a hosel recess 1612, a forward sole slot 1614, and a sliding weight track 1620 extending in a heel-toe direction just behind the forward sole slot and hosel recess. The club head 1600 can also comprise a sole insert 1616 that forms a part of the sole between the sole portion 1604 and the rear portion 1608 of the body 1600. The sole insert 1616 can comprise, for example, a low-density material such as a carbon-fiber composite material, and can be bonded to and enclose a lower opening in the body 1602. The club head 1600 can also comprise a stationary rear weight 1618 that is secured to a rear end of the body via fastener 1619.

The weight track 1620 can include one or more rails, or ledges, 1621 that the weights 1622 engage with and slide along. Each weight 1622 can have its own fastener 1623 that extends through the weight and secures the weight as a desired position along the track. The fasteners 1623 move along the track 1620 with the weights 1622. In some embodiments, the weights 1622 can comprise two or more pieces that clamp onto the rail 1621 by tightening the fastener 1623. Each weight can be adjustably positioned independently along the track to adjust the mass distribution properties of the club head. The track 1620 and the bottom of the weights 1623 are not covered by any part of the body and are exposed to ground contact, air flow dynamics, etc.

Additional Embodiments with Slotted Sliding Weight and Stationary Fastener

Some club heads can include a weight track with a sliding weight where the fastener screw is stationary relative to the body and the weight has a slot that moves relative to the stationary screw. Such a weight track and slotted weight can be oriented in a front-rear direction, a toe-heel direction, along another axis, along multiple axes, and/or along a curved path.

Such embodiments can solve at least the following problems. There is significant mass allocated to the structure in sliding weight tracks where the fastener moves with the weight (such as the club head 1600), which mass can be located very close to the front/back CG of the head. The additional mass can be partly in the form of one or more rails or ledges that the weights ride along and clamp onto. Because this additional mass is close the CG, the mass does not affect improvement of the inertial properties of the head as much as if the same mass was located farther away from the CG. Embodiments with a stationary fastening screw and a slotted weight that moves relative to the screw can also be simpler from a casting perspective and more mass efficient in that such embodiments can eliminate the rails that the weight rides along. The weight itself can also be simplified to just one piece, as opposed to two pieces that clamp together. There can also be no need to include a nut to engage the fastener shaft, which can also reduce mass and complexity. In addition, embodiments with a stationary fastening screw and a slotted weight that moves relative to the screw can also allow for more discretionary mass to be put into the weight, and as such the length of the track can be shortened while providing equivalent adjustability. For example, with a heel-toe oriented weight track, such an embodiment can maintain the same CGx adjustment range compared to a longer sliding weight track with clamping rails (like the club head 1600) because the weight is heavier despite the shorter track length. Because the track is shorter, it can also be positioned further forward. With the mass of the track infrastructure and the mass of the weight moved forward, the CG of the weight track system can be further away from the overall CG of the club head. This can improve (increase) inertia properties of the head.

Figure 34:
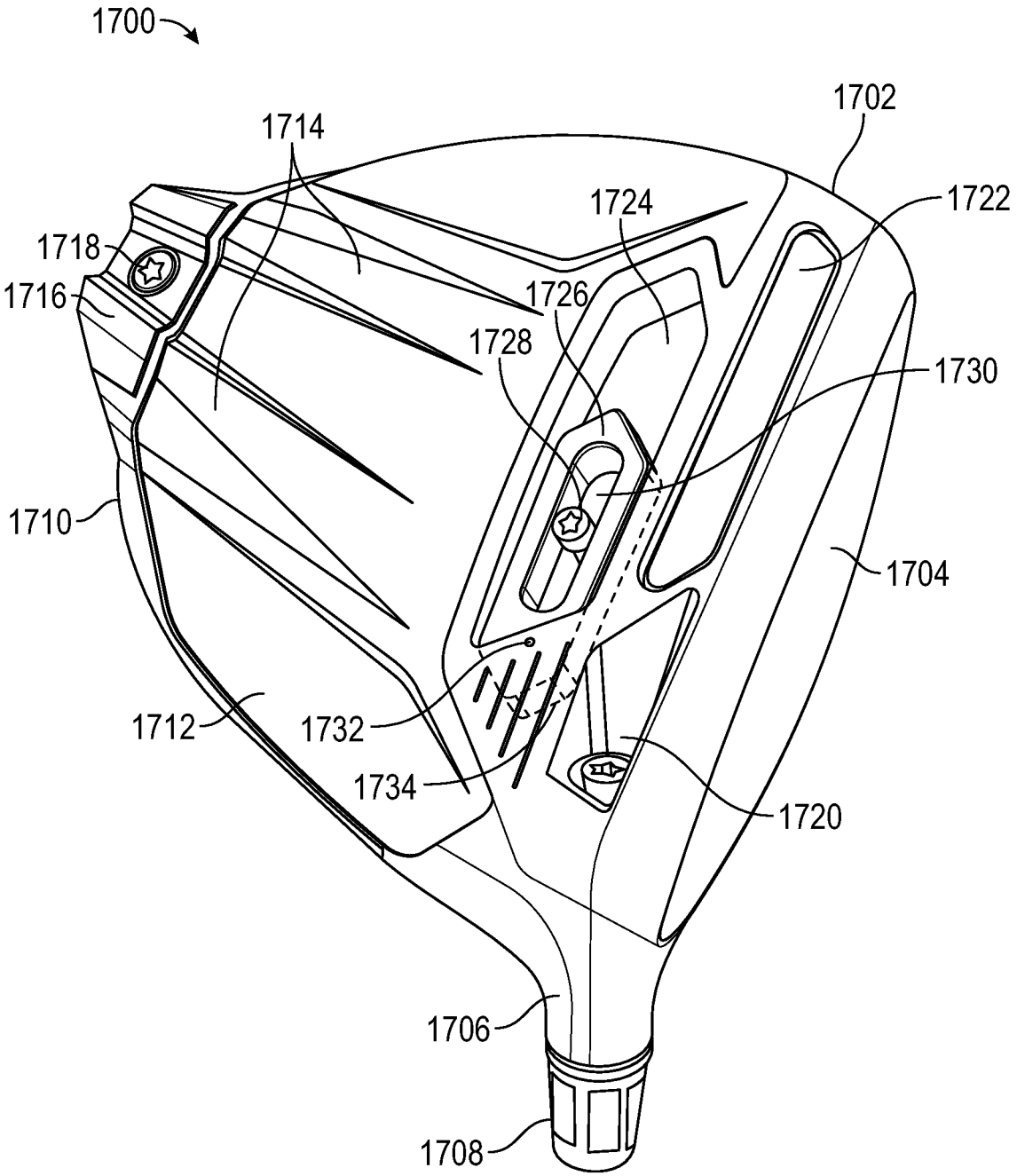
FIG. 34 is a bottom view of an exemplary golf club head having a heel-toe adjustable weight that is partially covered, and a stationary rear weight.

FIG. 34 shows an exemplary club head 1700 that includes a heel-toe weight track with a slotted weight that moves relative to a stationary weight fastener. The club head 1700 can comprise a body 1702, a face portion 1704, a hosel 1706, head-shaft coupler 1708, rear portion 1710, sole insert 1712 coupled to the body and having a lower density than the body, stationary rear weight 1716 with fastener 1718, hosel recess 1720, and front sole slot 1722, similar to the club head 1600. The club head also includes a crown, which can include a crown insert coupled to the body, which crown insert can comprise a composite material or other material that is less dense than the body. The club head 1700 can also include a heel-toe weight track 1724 positioned behind the slot 1722 and hosel recess 1720, with a slotted adjustable weight 1726 secured by stationary fastener 1728. The weights can have a greater density than the body. The weight 1726 is adjustably positionable in a heel-toe direction along the track 1724. A slot 1730 in the weight 1726 rides along the fastener 1728 and defines a maximum extent the weight can move in the heel-toe directions.

An overhang portion 1732 of the sole can cover a heel end portion of the track 1724. A heel end portion 1734 of the weight 1726 can be covered by the overhang portion 1732, at least when the weight is in a heelward position along the track 1724. In some embodiments, at least a portion of the weight 1726 is always covered by the overhang portion 1732 no matter where the weight is along the track. In some embodiments, up to half of the weight can be covered by the overhang when the weight is in the heelward position. The covered part of the weight can telescope within the body, resulting in variation of the total volume of the club head, as described with reference to the club heads 1200 and 1300. The overhang portion 1732 can also create a stable sit point for contacting the ground instead of the weight when the club head is in the normal address position. The overhang portion 1732 can also help improve aerodynamics during a swing, such as by reducing drag associated with a large open cavity and weight protuberances.

Figure 35:
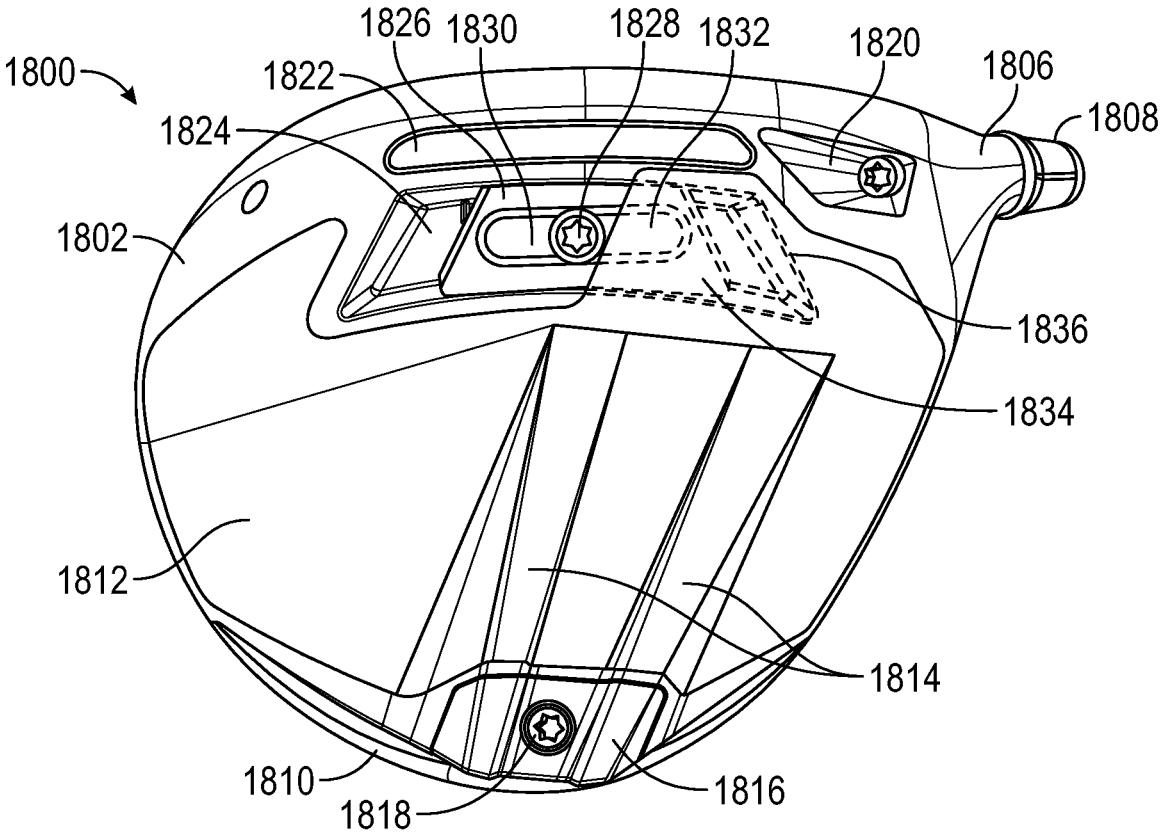
FIG. 35 is a bottom view of another exemplary golf club head having a heel-toe adjustable weight that is partially covered, and a stationary rear weight.

FIG. 35 shows another exemplary club head 1800 that includes a heel-toe weight track with a slotted weight that moves relative to a stationary weight fastener. The club head 1800 can comprise a body 1802 having a forward portion 1804, a hosel 1806 with head-shaft coupler 1808, a rear portion 1810, a hosel recess 1820, and a front sole slot 1822, as well as a sole insert 1812 with raised ridges 1814 coupled to the body and having a lower density than the body, and a stationary swappable rear weight 1816 with rear weight fastener 1818, similar to the club heads 1600 and 1700. The weights can have a greater density than the body.

The rear portion 1810 of the body can, in some embodiments, comprise a separately formed rear ring portion that is attached to the front body portion 1802 at the heel and toe sides, and the rear ring can be formed of a different material (e.g., polymeric material, aluminum, or other lower density material) than the front body portion (e.g., titanium). The rear portion 1810 can include a rear recess and fastener port for receiving the swappable rear weight 1816 via rear weight fastener 1818. The rear weight 1816 can be swapped with alternative rear weights have different masses (and/or different materials) to adjust the mass characteristics of the club head. More information regarding the construction of club heads, in particular the front body portions and rear ring portions, as well as crown and sole inserts and weight tracks and weight members, can be found in U.S. Pub. No. 2021/

0113896 published Apr. 22, 2021, which is incorporated by reference herein in its entirety.

Figure 36:
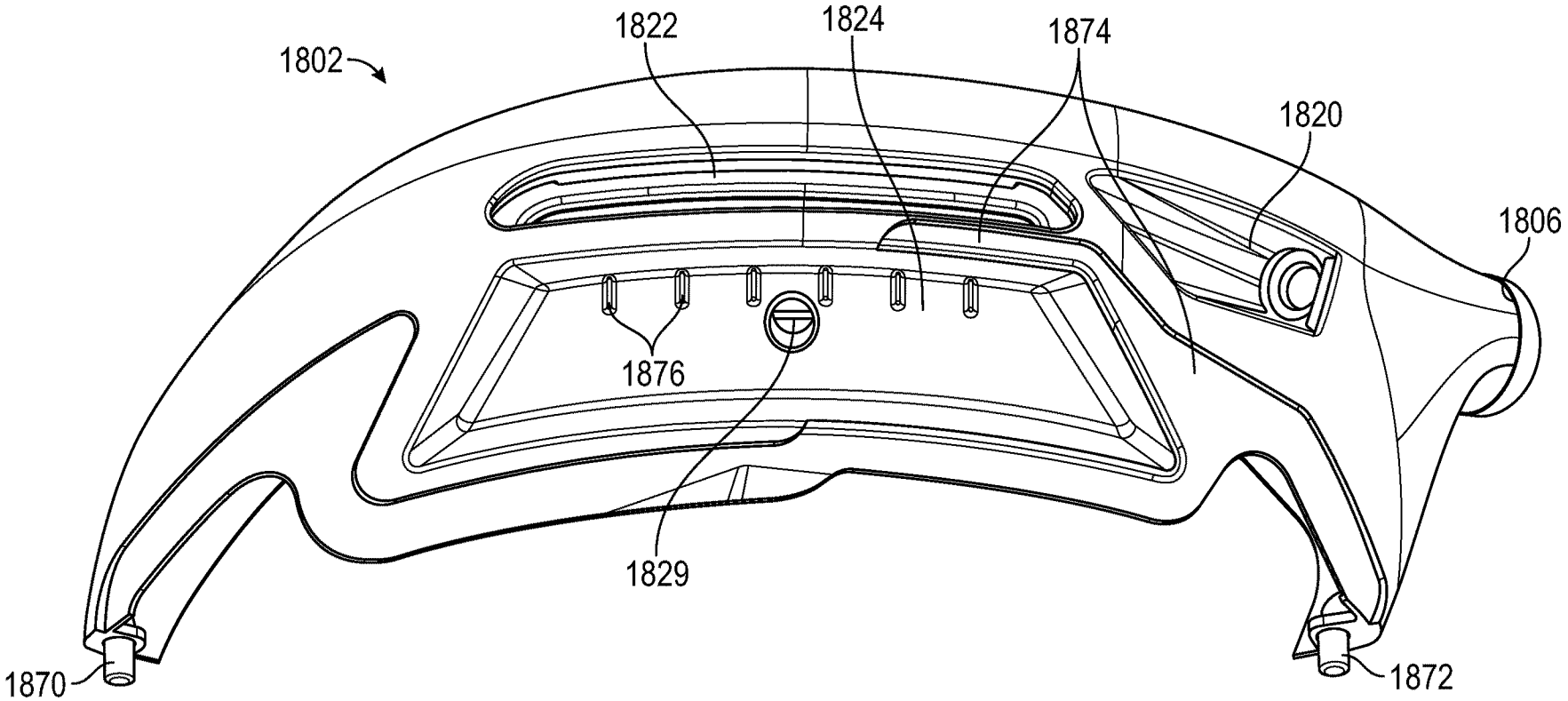
FIG. 36 shows a bottom view of a front body portion of the club head of FIG. 35 in isolation.

An exemplary front body portion 1802 is shown in FIG. 36, which can be a cast component. As shown in FIG. 36, the front body portion 1802 can include a toe connector 1870 and a heel connector 1872 that can engage with corresponding connection portion on the rear (ring) portion 1810 to secure the two parts together. The front body portion 1802 and the rear portion 1810 can each include a portion of an annular recessed ledge 1874 to which the sole insert 1812 is attached, closing a lower opening of the body. As shown in FIG. 36, the recessed ledge 1874 can extend around the heel side and part of the front side of the weight track 1824 to accommodate a portion of the sole insert (e.g., the overhang portion 1832 discussed herein) that covers part of the weight track and weight member.

The club head 1800 also includes a crown, which can include a crown insert coupled to the body. The front body portion 1802 and rear portion 1810 can each include portions of an annular crown ledge that extends around an upper opening, and the crown insert can attach to the crown ledge and close the upper opening (similar to the crown structures shown in FIGS. 1B, 3, 10, 11, 15, 23B, 25, and 27). The crown insert can comprise a composite material or other material that is less dense than the body. The sole insert 1812 can also comprise a composite material or other material that is less dense than the body. For example, in some embodiments, at least a portion of the body 1802 is formed of a titanium alloy, the adjustable weight member 1826 is formed from a material having a density no less than 7.8 g/cc, at least a portion of the crown (e.g., the crown insert) is formed of a material having a density of no more than 2 g/cc, and/or at least a portion of the sole (e.g., the sole insert) is formed of a material having a density of no more than 2 g/cc.

Figure 37:
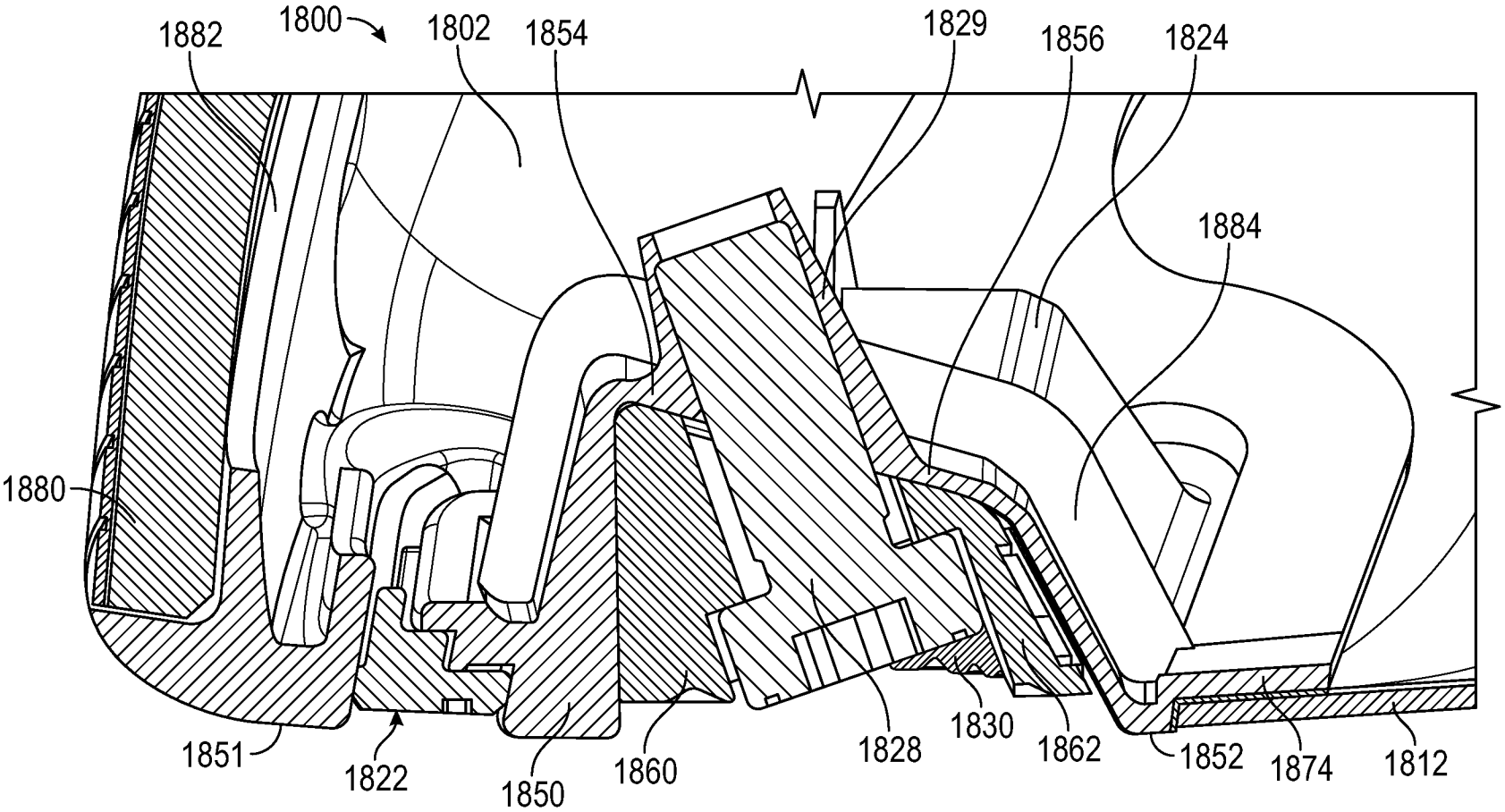
FIG. 37 is a cross-section view of the club head of FIG. 35 illustrating the position of the weight and fastener within the weight track.

The club head 1800 can also include a heel-toe oriented weight track 1824 positioned behind the front sole slot 1822, with a slotted adjustable weight 1826 secured by stationary fastener 1828. As shown in FIG. 36, the weight track 1824 can have a generally trapezoidal shape. The weight member 1826 can also have a generally trapezoidal shape. The weight member 1826 is adjustably positionable in a heel-toe direction along the track 1824. The weight track and weight member can also be slightly arcuate such that the weight member moves along a slightly curved path. A slot 1830 in the weight 1826 interfaces with the fastener 1828 and the heel-toe length of the slot 1830 can define a maximum extent the weight can move in the heel-toe directions. The slot 1830 in the weight can include recessed ledge around the outer perimeter of the slot the fastener head sits within. The fastener includes a threaded shaft portion that engages with a corresponding threaded port 1829 in the body, as illustrated in FIG. 37. When the threaded shaft portion is tightened within the port, the fastener head presses against the recessed ledge to secure the weight member against the walls of the track. As shown in FIG. 36, the track 1824 can also include ridges 1876 or other features that help the weight member engage with the weight track and prevent the weight member from unintentionally moving relative to the weight track when the fastener 1828 is tightened. Such ridges can also serve as indexing/reference features to help adjust the weight to a desired position without having to measure the exact position. Similar ridges and/or corresponding recesses can be included on other walls of the track and/or on contacting surfaces of the weight as well. In some embodiments, the weight tack and weight can taper in front-rear width moving from the sole upward (as illustrated in FIG. 37), such that the front and/or rear walls of the weight are angled and press against the front and rear walls of the track to help "wedge" the weight into the track and better secure the weight within the track when the fastener is tightened. The fastener 1828 and port 1829 can also be angled from vertical, as shown in FIG. 37.

The mass of the front adjustable weight 1826 may range between 8 grams and 30 grams, preferably 10 grams and 25 grams, and more preferably 15 grams and 23 grams. The swappable rear weight 1816 may range from 8 grams and 30 grams, preferably 10 grams and 25 grams, more preferably 15 grams and 23 grams, and even more preferably 12-18 grams. In some embodiments, the rear weight may weigh more than the front weight in order to provide greater inertia i.e. forgiveness to the golfer. A combined mass of the front weight and the rear weight may range from 30-60 grams, preferably 35-55 grams, or greater than about 35 grams.

In some embodiments, a moment of inertia about the golf club head CG y-axis (Iyy) can be greater than about 250 $kg \cdot mm^2$. More specifically, the moment of inertia about the head CG y-axis can be between 250 $kg \cdot mm^2$ and 400 $kg \cdot mm^2$, between about 250 $kg \cdot mm^2$ and about 350 $kg \cdot mm^2$, between about 275 $kg \cdot mm^2$ and about 325 $kg \cdot mm^2$, between about 300 $kg \cdot mm^2$ and about 350 $kg \cdot mm^2$, between about 350 $kg \cdot mm^2$ and about 400 $kg \cdot mm^2$, or greater than about 400 $kg \cdot mm^2$. In some embodiments described herein, a summation of a moment of inertia about a golf club head CG x-axis (Ixx) and a moment of inertia about a golf club head CG x-axis (Izz) can be greater than about 700 $kg \cdot mm^2$. More specifically, a summation of Ixx plus Izz may be between about 700 $kg \cdot mm^2$ and 1100 $kg \cdot mm^2$, between about 725 $kg \cdot mm^2$ and 875 $kg \cdot mm^2$, between 790 $kg \cdot mm^2$ and 950 $kg \cdot mm^2$, between 800 $kg \cdot mm^2$ and 850 $kg \cdot mm^2$, or greater than about 800 $kg \cdot mm^2$.

An overhang portion 1832 of the sole insert 1812 can cover a heel end portion 1836 of the track 1824. For example, the overhang portion 1832 of the sole insert can cover about 25-50% of the weight track, about 30-40% of the weight track, and/or about 33-37% of the weight track. A heel end portion 1834 of the weight 1826 can also be covered by the overhang portion 1832, at least when the weight is in a heelward position along the track 1824. In some embodiments, at least a portion of the weight 1826 is always covered by the overhang portion 1832 no matter where the weight is along the track. In some embodiments, up to half of the weight can be covered by the overhang when the weight is in the heelwardmost position. The overhang portion 1832 can allow space for the fastener 1828 to be inserted through the weigh slot into the fastener port 1829.

Figure 38C:
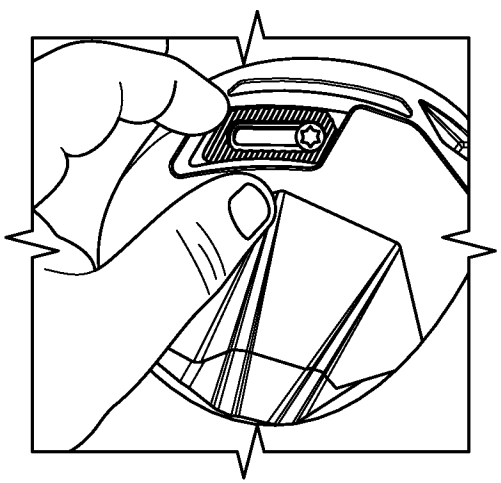
FIGS. 38A-38C illustrate a process of inserting a weight member into a weight track.
Figure 38B:
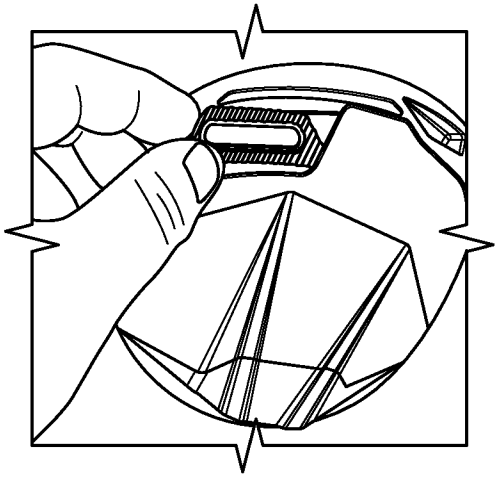
Figure 38A:
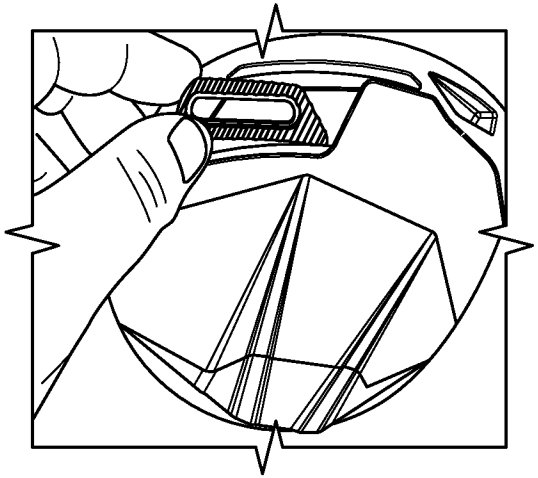
Figure 39:
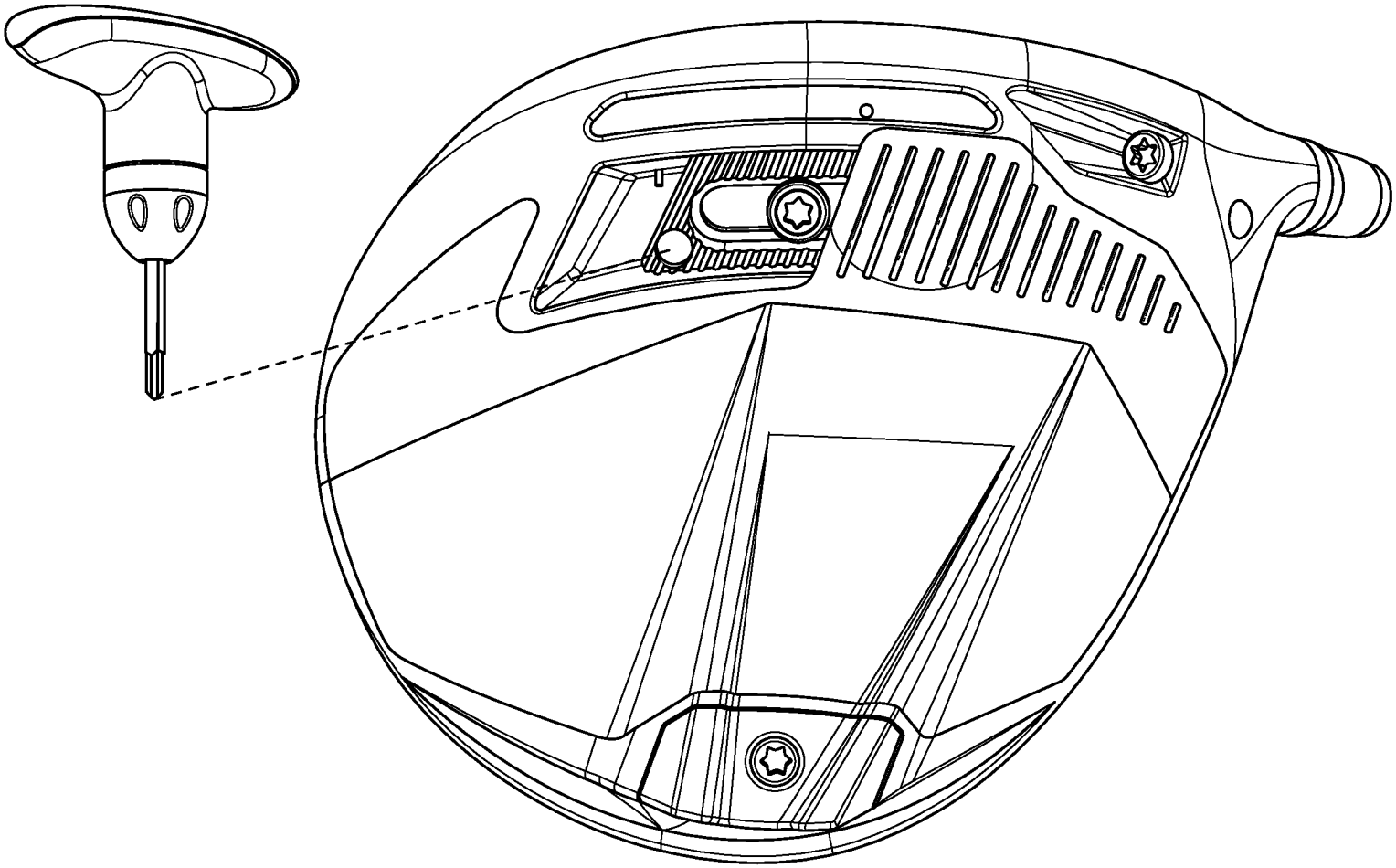
FIG. 39 shows an alternative weight member that includes a hole/recess and ridges for moving the weight along the weight track.

The weight 1826 can be inserted into, and removed from, the track 1824 from the uncovered toe side of the track, when not fastened by the fastener 1828, by angling the weight into or out of the track and moving the weight in a heel-toe direction generally parallel with the path of the weight track. FIGS. 38A-38C illustrate how the weight member can be inserted into the weight track, tucked under the overhang portion of the sole insert, and secured with the fastener. The overhang portion of the sole insert can be sized and positioned so that it leaves enough of the toe end of the track uncovered to provide space for the weight member to slide into or out of the track for insertion and removal. The one-piece weight member simplifies these processes compared to multi-piece weight members, such as those that clamp onto rails or ledges of the weight track for fastening. The fastener 1828 can be removed or at least uncoupled from the port 1829 before the weight member is removed from the weight track during removal, and the fastener can be inserted through the slot in the weight member after the weight member is inserted into the track during insertion. FIG. 39 shows an embodiment where the weight member includes a hole or recess on the toe end that can be used to move the weight. A tool, such as a wrench used to tighten/loosen the fastener, can be inserted into the hole/recess in the weight and used to pull or push the weight in either direction along the weight track. This can allow the weight to be moved farther under the overhang and still be retrievable with just a small part of the weight protruding out from under the overhang (the part with the hole/recess). The weight can also include ridges, bumps, or other grip features on the external surface (such as the ridges illustrated in FIG. 39) to help a user grip and move the weight with fingers.

The covered part of the weight can telescope within the club head under the overhang, resulting in variation of the total water-displaced volume of the club head, as described with reference to the club heads 1200 and 1300. The overhang portion 1832 can also protect the weight and track from impact and debris and can create a stable sit point for contacting the ground instead of the weight/track when the club head is in the normal address position. The overhang portion 1832 can also help improve aerodynamics during a swing, such as by reducing drag associated with a large open track cavity and weight protuberances.

In some embodiments, in addition to the overhang portion 1832, the club head 1800 can include trip steps, vortex generators, or similar features forward of the weight track 1824 that help mitigate whistling sounds or other unwanted sounds that can be caused by the weight/track when the club head is traveling at high speed (e.g., during a swing). More information about trip steps, vortex generators, or similar features can be found in U.S. Pub. 2020/0139208, published May 7, 2020, which is incorporated by reference herein in its entirety. As discussed therein, in some embodiments, a surface of the sole may comprise one or more surface features, such as a plurality of vortex generators, which can for example each comprise a "wishbone" shape. These vortex generators can be raised up from the surface of the sole, such as at a height of less than 0.75 mm, such as between 0 and 0.75 mm, or between 0.2 and 0.6 mm, or between 0.3 and 0.5 mm, with a narrow end of the raised portion angled toward the rear portion of the golf club head so as to improve playability properties of the golf club head, such as to reduce "whistling" during a golf swing.

While in the illustrated embodiment, these vortex generators 436 are shown as being positioned on a sole 414, they may be placed, e.g., on a crown of a golf club head, elsewhere on the sole, or e.g., along a sole panel, along a toe surface, or at other locations on the surface of the golf club head in this or any of the golf club head embodiments illustrated herein, as desired.

Additionally, in club heads like 1700 and 1800, the weight track can be asymmetric with the track being deeper at the forward part and the weight can similarly be thick in the front and therefore more mass-biased further forward, as illustrated in FIG. 37. FIG. 37 is a cross-sectional view of the club head 1800 taken along a front-rear vertical plane looking toeward, showing the forward sole portion 1851 of the body 1802, front sole slot 1822 with a plug inserted therein, an intermediate sole portion 1850 between the slot 1822 and the weight track 1824, a rear sole portion 1852 of the body 1802 behind the weight track, the sole insert 1812 overlapping a rear ledge 1874 of the body 1802, and a receptacle, or port, 1829 that receives the stationary fastener 1828. The receptacle 1829 can be threaded and receive a threaded fastener 1828, for example. The weight track 1824 can be reinforced by internal ribs as shown, such as rib 1884 that extends in a front/rear direction around the inner side of the track. As also shown in FIG. 37, the body 1802 can include a front opening formed in part by an annular ledge 1882 that receives a face insert 1880, which can comprise a material (e.g., metallic or composite) different from the body and can be attached to the body via adhesive, welds, fasteners, or other methods.

As shown in FIG. 37, the weight track 1824 has a deeper wall 1854 forward of the port 1829 and a shallower wall 1856 rearward of the port. A forward portion 1860 of the weight 1826 is thicker/taller and has more of the total mass of the weight while a rearward portion 1862 of the weight is thinner/shorter and has less of the total mass of the weight. Such an asymmetric weight and track configuration can allow for more extreme weight splitting, which can allow the club head to maintain balance point, maintain delta1, and increase Ixx and Izz compared to the club head 1600 of FIG. 33, as shown in Table 5.

TABLE 5

| | Value in Exemplary Golf Club Head | |
|---|---|---|
| Property | Club Head 1600 | Club Head 1800 |
| CGx (mm) | −2.3 | −2.9 |
| CGz (mm) | −5.28 | −5.44 |
| Delta 1 (mm) | 22.1 | 23.2 |
| Delta 2 (mm) | 37.3 | 37.7 |
| Head Mass (g) | 201.3 | 201.9 |
| Ixx (kg * $mm^2$) | 317 | 335 |
| Iyy (kg * $mm^2$) | 282 | 286 |
| Izz (kg * $mm^2$) | 459 | 481 |
| Total Inertia (kg * $mm^2$) | 776 | 816 |
| BP Projection (mm) | 0.7 | 0.6 |

In view of the many possible embodiments to which the principles of the disclosed technology may be applied, it should be recognized that the illustrated embodiments are only preferred examples of the technology and should not be taken as limiting the scope of the invention. Rather, the scope of the invention is at least as broad as the full scope of the following claims. We therefore claim as our invention all that comes within the scope and spirit of these claims.

The invention claimed is:

1. A golf club head comprising:

a body defining an interior cavity, a sole defining a bottom portion of the golf club head, a crown defining a top portion of the golf club head, a face defining a forward portion of the golf club head, a rearward portion of the golf club head opposite the face, and a hosel;

a weight channel formed in the sole and defining a path along the sole, the path being oriented in a generally heel-toe direction, the weight channel defining a weight channel path axis, wherein a forward portion of the weight channel is covered by an overhang portion of the sole and at least a rearward portion of the weight channel is uncovered;

a weight member positioned in the weight channel, the weight member configured to be adjusted to any of a range of selectable positions along the path to adjust mass properties of the golf club head, wherein the weight member comprises a slot that is elongated in the generally heel-toe direction; and a fastener that extends through the slot in the weight member and secures the weight member to the body in any of the selectable positions along the path, wherein when the weight member is in any of the selectable positions the fastener is secured to the body at a same fixed location on the body that is independent of the position of the weight member;

wherein the weight member is asymmetric about the weight channel path axis.

2. The golf club head of claim 1, wherein the weight member comprises a first portion forward of the weight channel path axis and a second portion rearward of the weight channel path axis, and the first portion has a greater mass than the second portion.

3. The golf club head of claim 2, wherein the first portion of the weight member is thicker than the second portion of the weight member.

4. The golf club head of claim 3, wherein an upper surface of the weight member tapers from a forward side of the weight member to a rearward side of the weight member.

5. The golf club head of claim 4, wherein a center of mass of the weight member is closer to the forward side of the weight member than to the rearward side of the weight member.

6. The golf club head of claim 2, wherein a majority of the first portion of the weight member is forward of the fastener.

7. The golf club head of claim 1, wherein the golf club head defines a first axis extending in a front-rear direction and passing through the fastener, and the weight member is symmetric about the first axis.

8. The golf club head of claim 7, wherein the golf club head defines a second axis extending in a heel-toe direction and passing through the fastener, and the weight member is asymmetric about the second axis.

9. The golf club head of claim 1, wherein the weight member is entirely external to the interior cavity of the golf club head.

10. A golf club head comprising:

a body defining an interior cavity, a sole defining a bottom portion of the golf club head, a crown defining a top portion of the golf club head, a face defining a forward portion of the golf club head, a rearward portion of the golf club head opposite the face, and a hosel;

a weight channel formed in the sole and defining a path along the sole;

a weight member positioned in the weight channel, the weight member configured to be adjusted to any of a range of selectable positions along the path to adjust mass properties of the golf club head, wherein the weight member comprises a first end portion, a second end portion, and an elongated slot between the first end portion and the second end portion; and a fastener that extends through the slot in the weight member and secures the weight member to the body in any of the selectable positions along the path, wherein when the weight member is in any of the selectable positions the fastener is secured to the body at a same fixed location on the body that is independent of the position of the weight member;

wherein a midpoint of a length of the slot of the weight member is offset from a midpoint of a length of the weight member.

11. The golf club head of claim 10, wherein:

the first end portion of the weight member comprises a first end and the second end portion of the weight member comprises a second end;

the slot of the weight member comprises a first end and a second end;

the weight member comprises a first distance between the first end of the slot and the first end of the weight member;

the weight member comprises a second distance between the second end of the slot and the second end of the weight member; and the first distance and the second distance are unequal.

12. The golf club head of claim 11, wherein the first distance between the first end of the weight member and the first end of the slot is greater than the second distance between the second end of the slot and the second end of the weight member.

13. The golf club head of claim 11, wherein the midpoint of the slot of the weight member is closer to the second end of the weight member than to the first end of the weight member.

14. The golf club head of claim 10, wherein:

the path of the weight channel is oriented in a generally front-rear direction;

the first end portion of the weight member is a front end portion;

the second end portion of the weight member is a rear end portion; and the midpoint of the slot of the weight member is closer to the rear end portion of the weight member than to the front end portion of the weight member.

15. The golf club head of claim 14, wherein:

the weight member comprises a front end and a rear end;

the slot of the weight member comprises a front end and a rear end;

the weight member comprises a first distance between the front end of the slot and the front end of the weight member;

the weight member comprises a second distance between the rear end of the slot and the rear end of the weight member; and the first distance and the second distance are unequal.

16. The golf club head of claim 15, wherein the first distance between the front end of the weight member and the front end of the slot is greater than the second distance between the rear end of the slot and the rear end of the weight member.

17. The club head of claim 10, wherein:

the club head has a center of gravity (CG) which is the origin of a coordinate system having a CG x-axis extending through the CG origin in a toe-to-heel direction, a CG y-axis extending through the CG origin in a front-to-back direction and perpendicular to the CG x-axis, and a CG z-axis extending through the CG origin in a generally vertical direction perpendicular to the CG x-axis, the CG y-axis, and to a ground plane when the club head is in a normal address position;

the club head has a volume between 400 cc and 470 cc;

the club head has a moment of inertia about the CG x-axis (Ixx), a moment of inertia about the CG y-axis (Iyy), and a moment of inertia about the CG z-axis (Izz); and wherein a summation Ixx+Izz is between 700 $kg \cdot mm^2$ and 1100 $kg \cdot mm^2$, and Iyy is between 250 $kg \cdot mm^2$ and 400 $kg \cdot mm^2$.

18. The club head of claim 17, wherein at least a portion of the crown comprises a composite material, and at least a portion of the sole comprises a composite material.

19. The club head of claim 18, wherein at least a portion of the face comprises a composite material.

20. A golf club head comprising:

a body defining an interior cavity, a sole defining a bottom portion of the golf club head, a crown defining a top portion of the golf club head, a face defining a forward portion of the golf club head, a rearward portion of the golf club head opposite the face, and a hosel;

a weight member configured to be adjusted to any of a range of selectable positions, wherein the weight member comprises a slot that is elongated; and a fastener that extends through the slot in the weight member and secures the weight member to the body in any of the selectable positions, wherein when the weight member is in any of the selectable positions the fastener is secured to the body at a same fixed location on the body that is independent of the position of the weight member;

wherein the weight member is asymmetric;

wherein when the weight member is in at least one of the selectable positions a portion of the golf club head covers at least a portion of the weight member.

21. The golf club head of claim 20, wherein the weight member comprises a first portion forward of the slot and a second portion rearward of the slot, and the first portion has a greater mass than the second portion.

22. The club head of claim 20, wherein:

the club head has a center of gravity (CG) which is the origin of a coordinate system having a CG x-axis extending through the CG origin in a toe-to-heel direction, a CG y-axis extending through the CG origin in a front-to-back direction and perpendicular to the CG x-axis, and a CG z-axis extending through the CG origin in a generally vertical direction perpendicular to the CG x-axis, the CG y-axis, and to a ground plane when the club head is in a normal address position;

the club head has a volume between 400 cc and 470 cc;

the club head has a moment of inertia about the CG x-axis (Ixx), a moment of inertia about the CG y-axis (Iyy), and a moment of inertia about the CG z-axis (Izz); and wherein a summation Ixx+Izz is between 700 $kg \cdot mm^2$ and 1100 $kg \cdot mm^2$, and Iyy is between 250 $kg \cdot mm^2$ and 400 $kg \cdot mm^2$.

23. The club head of claim 22, wherein at least a portion of the crown comprises a composite material, and at least a portion of the sole comprises a composite material.

24. The club head of claim 23, wherein at least a portion of the face comprises a composite material.

* * * * *